US011618018B2

(12) United States Patent
Lee et al.

(10) Patent No.: US 11,618,018 B2
(45) Date of Patent: Apr. 4, 2023

(54) MODULAR FLUID CHIP AND FLUID FLOW SYSTEM COMPRISING SAME

(71) Applicant: KOREA ADVANCED INSTITUTE OF SCIENCE AND TECHNOLOGY, Daejeon (KR)

(72) Inventors: Moon Keun Lee, Daejeon (KR); Seok Jae Lee, Daejeon (KR); Nam Ho Bae, Daejeon (KR); Tae Jae Lee, Cheongju-si (KR); Kyoung Gyun Lee, Daejeon (KR); Yoo Min Park, Seoul (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 240 days.

(21) Appl. No.: 17/056,416

(22) PCT Filed: Jul. 25, 2019

(86) PCT No.: PCT/KR2019/009272
§ 371 (c)(1),
(2) Date: Nov. 17, 2020

(87) PCT Pub. No.: WO2020/027500
PCT Pub. Date: Feb. 6, 2020

(65) Prior Publication Data

US 2021/0308672 A1 Oct. 7, 2021

(30) Foreign Application Priority Data

Jul. 28, 2018 (KR) ..... 10-2018-0088227
Jul. 23, 2019 (KR) ..... 10-2018-0088805

(51) Int. Cl.
*B01L 3/00* (2006.01)

(52) U.S. Cl.
CPC ..... *B01L 3/5027* (2013.01); *B01L 3/502715* (2013.01); *B01L 2200/027* (2013.01);
(Continued)

(58) Field of Classification Search
CPC ..... B01L 3/5027; B01L 3/502715; B01L 2200/028
See application file for complete search history.

(56) References Cited

U.S. PATENT DOCUMENTS 5,580,523 A 12/1996 Bard
10,603,660 B2 3/2020 Alles et al.
(Continued)

FOREIGN PATENT DOCUMENTS

CN 101267885 A 9/2008
CN 102056838 A 5/2011
(Continued)

OTHER PUBLICATIONS

A Partial European Search Report dated Oct. 8, 2021 in connection with European Patent Application No. 19844384.8 which corresponds to the above-referenced U.S. application.
(Continued)

*Primary Examiner* — Jennifer Wecker
*Assistant Examiner* — Mickey Huang
(74) *Attorney, Agent, or Firm* — Invenstone Patent, LLC

(57) ABSTRACT

A modular fluid chip according to an embodiment of the present disclosure includes a body including at least one first hole which allows fluid to flow therethrough; and a housing receiving the body therein, and including a second hole which corresponds to the at least one first hole and allows the fluid to flow therethrough, and a fluid connection part which is connectable to another modular fluid chip.

15 Claims, 54 Drawing Sheets

(52) U.S. Cl.
CPC . *B01L 2200/028* (2013.01); *B01L 2300/0861* (2013.01); *B01L 2300/0883* (2013.01); *B01L 2300/161* (2013.01)

(56) References Cited

U.S. PATENT DOCUMENTS

| | | | |
|---|---|---|---|
| 2003/0136451 | A1 | 7/2003 | Beebe et al. |
| 2004/0228771 | A1 | 11/2004 | Zhou et al. |
| 2005/0255003 | A1 | 11/2005 | Summersgill et al. |
| 2006/0263914 | A1 | 11/2006 | Sando et al. |
| 2009/0132204 | A1 | 5/2009 | Bodlaender et al. |
| 2009/0156966 | A1 | 6/2009 | Kontschieder et al. |
| 2009/0257920 | A1 | 10/2009 | Facer et al. |
| 2010/0258211 | A1 | 10/2010 | Burns et al. |
| 2012/0093692 | A1 | 4/2012 | Blomberg et al. |
| 2015/0352550 | A1 | 12/2015 | Bhargava et al. |
| 2018/0078936 | A1 | 3/2018 | Owens et al. |

FOREIGN PATENT DOCUMENTS

| | | | |
|---|---|---|---|
| CN | 105636697 | A | 6/2016 |
| CN | 107541452 | A | 1/2018 |
| EP | 3190172 | A2 | 7/2017 |
| JP | 2012529650 | A | 11/2012 |
| KR | 10-2005-0057222 | A | 6/2005 |
| KR | 10-2014-0015941 | A | 2/2014 |
| KR | 10-2015-0008234 | A | 1/2015 |
| KR | 10-2015-0138997 | A | 12/2015 |
| KR | 10-2017-0049564 | A | 5/2017 |
| WO | 00/62918 | A2 | 10/2000 |
| WO | 2015-090339 | A1 | 6/2015 |
| WO | 2015-138696 | A1 | 9/2015 |
| WO | 2015/191723 | A1 | 12/2015 |
| WO | 2017-201438 | A1 | 11/2017 |

OTHER PUBLICATIONS

A European Search Report dated Nov. 26, 2021 in connection with European Patent Application No. 19844384.8 which corresponds to the above-referenced U.S. application.

A Chinese Office Action dated Nov. 12, 2021 in connection with Chinese Patent Application No. 201980050280.8 which corresponds to the above-referenced U.S. application.

A Korean Office Action dated Nov. 29, 2021 in connection with Korean Patent Application No. 10-2021-0110987 which corresponds to the above-referenced U.S. application.

A Korean Notice of Allowance dated Dec. 13, 2021 in connection with Korean Patent Application No. 10-2019-0088822 which corresponds to the above-referenced U.S. application.

A Korean Office Action dated Dec. 27, 2020 in connection with Korean Patent Application No. 10-2019-0088805 which corresponds to the above-referenced U.S. application.

(a)

(b)

(a)

(b)

(a)

(b)

(a)

(b)

(a)

(b)

(a)

(b)

(a)

(b)

MODULAR FLUID CHIP AND FLUID FLOW SYSTEM COMPRISING SAME

CROSS-REFERENCE TO RELATED APPLICATIONS

This application is a national stage of International Application No. PCT/KR2019/009272, filed on Jul. 25, 2019, which claims the benefit of priority to Korean Application(s) No. 10-2018-0088227, filed on Jul. 28, 2018 and 10-2019-0088805, filed on Jul. 23, 2019 in the Korean Intellectual Property Office, the disclosures of which are incorporated herein by reference.

TECHNICAL FIELD

The present disclosure relates to a modular fluid chip and a fluid flow system comprising the same, and more particularly, a modular fluid chip capable of implementing a fluid flow system of various structures by connecting a plurality of fluid chips that can perform different functions, and a fluid flow system comprising the same.

BACKGROUND ART

Lab-on-a-chip (LOC) technology has received considerable attention to overcome disadvantages of existing diagnostic techniques. The Lab-on-a-chip technology (LOC) is a representative example of the convergence technology of NT, IT and BT and refers to a technology to perform all sample pretreatment and analysis steps, such as sample dilution, mixture, reaction, separation, and quantification, on a single chip, by using techniques, for example, MEMS and NEMS.

Microfluidic devices to which such lab-on-a-chip technology (LOC) is applied analyze and diagnose a flow of a fluid sample flowing through a reaction channel or a reaction between a reagent and the fluid sample supplied to the reaction channel. In addition, such microfluidic devices are manufactured in a form in which a number of units required for analysis are provided on a small chip of a size of several $cm^2$, which is formed of glass, silicon or plastic, in such a manner that various steps of processing and manipulation can be performed on a single chip.

Specifically, the microfluidic device is configured to include a chamber capable of trapping a small amount of fluid, a reaction channel through which the fluid can flow, a valve capable of controlling a flow of fluid, and various functional units capable of performing a preset function by receiving the fluid.

However, since conventional microfluidic devices are manufactured to have functions associated with a plurality of microfluidic devices according to a purpose of an experiment, the entirety of the devices should be newly manufactured, even if a change or a problem occurs in one function. Accordingly, there are problems that a manufacturing cost increases and management is not facilitated.

Also, once the microfluidic device is manufactured, since it is difficult to change a design of the manufactured device, and the manufactured device is not compatible with other microfluidic devices, there are problems in that other experiments other than set experiments cannot be performed.

In addition, conventional microfluidic devices are limited in size and specifications that can be manufactured, so that a structural expansion thereof is infeasible. Accordingly, since it is necessary to predict the entire experiment result after performing only a portion of experiments, there is a problem in obtaining accurate experimental data.

Technical Problem

The present disclosure is conceived to solve the above problems, and an object of the present disclosure is to provide a modular fluid chip capable of implementing a fluid flow system of various structures without restriction in shape or size by connecting a plurality of fluid chips that may perform different functions as needed, whereby various and accurate experimental data can be obtained, and when a specific portion is deformed or damaged, only the fluid chip corresponding thereto can be replaced, and a fluid flow system comprising the modular fluid chip.

The technical problem to be achieved by the present disclosure is not limited to the problems mentioned above, and other problems not mentioned can be clearly understood by those skilled in the art from the following description.

Technical Solution

A modular fluid chip according to a first embodiment of the present disclosure to solve the above problems includes a body including at least one first hole which allows fluid to flow therethrough; and a housing receiving the body therein and including a second hole which corresponds to the at least one first hole and allows the fluid to flow therethrough, and a fluid connection part which is connectable to another modular fluid chip.

The body may be formed in a form of a module capable of performing one function and may be selectively replaceable in the housing.

The other modular fluid chip may include a body capable of performing a function different from the one function.

The housing may be connectable to the other modular fluid chip in a horizontal or vertical direction, and when the housing and the other modular fluid chip are connected in a horizontal or vertical direction, the first hole and the second hole may be aligned with and communicate with a first hole and a second hole provided in the other modular fluid chip.

The body may further include a fluid channel which is in communication with the first hole and allows the fluid to flow therethrough.

The fluid channel may include any one of a straight channel, a streamline channel, a channel having at least one well, a channel having a valve, a channel having at least one branch, a cross-shaped channel, a Y-shaped channel, a channel having a sensor, a channel having an electrical output unit, and a channel having an optical output unit.

The first hole, the second hole and the fluid channel may be formed to have a circular, elliptical or polygonal shape in cross-section, and the first hole, the second hole, and the fluid channel may be formed to have a preset size within a range of a circle having a diameter equal to or greater than 10 nm and equal to or less than 1 Cm.

The housing may be formed of at least one of a ceramic, a metal and a polymer.

The modular fluid chip further includes a coupling unit for coupling with the other modular fluid chip, wherein the coupling unit may include a material having magnetism.

The coupling unit may include a convex portion and a concave portion corresponding to each other.

The coupling unit may include a fastening portion connectable to the other modular fluid chip.

The modular fluid chip may further include a cover which is coupled to the housing to surround the body and is formed of a transparent material.

The modular fluid chip may further include an imaging part disposed on the cover; and a light source disposed in the housing or the cover.

The modular fluid chip may further include a temperature controller installed in the housing or the cover to heat or cool the body.

In addition, a modular fluid chip according to a second embodiment of the present disclosure includes a body including at least one first hole which allows fluid to flow therethrough; a housing receiving the body therein and including a coupling unit which is connectable to another modular fluid chip; and a fluid connector received in the housing and including a third hole which is aligned to correspond to the first hole.

When connected to the other modular fluid chip, the fluid connector may be in close contact with a fluid connector provided in the other modular fluid chip and form an interface, thereby blocking leakage of fluid between the housing and the other modular fluid chip.

The fluid connector may be formed of an elastomer.

The fluid connector may be disposed on at least one of an outside and an inside of the housing.

A convex portion or a concave portion capable of being coupled to the housing may be formed in the fluid connector.

The fluid connector may include a seating portion which is received in an outside of the housing and is connectable to the other modular fluid chip; and a convex portion which is received in an inside of the housing and is connectable to the body.

The modular fluid chip may further include an O-ring which is disposed between the seating portion and the convex portion to connect the seating portion and the convex portion.

In addition, a modular fluid chip according to a third embodiment of the present disclosure includes a body including at least one first hole which allows fluid to flow therethrough; a housing receiving the body therein, and including a second hole which corresponds to the at least one first hole and allows the fluid to flow therethrough, and a fluid connector which is connectable to another modular fluid chip; and at least one sensor capable of detecting a signal generated from the fluid.

The at least one sensor may detect at least one of an electric signal, a fluorescent signal, an optical signal, an electrochemical signal, a chemical signal, and a spectroscopic signal.

The at least one sensor may be formed of any one of a metal, an organic-inorganic composite, and an organic conductor.

The at least one sensor may be formed of a metal electrode including at least one material of Au, Mg, Ti, Cr, Mn, Fe, Co, Ni, Cu, Zn, Ga, Al, Zr, Nb, Mo, Ru, Ag, and Sn.

The at least one sensor may be formed of an organic electrode including at least one material of a conductive polymer and carbon.

The at least one sensor may be formed of an organic-inorganic composite electrode in which at least one material among materials constituting the metal electrode and at least one material among materials constituting the organic electrode are mixed.

The at least one sensor may be formed of a material having transparency so as to detect at least one of the fluorescent signal, the optical signal, and the spectroscopic signal.

In addition, a modular fluid chip according to a fourth embodiment of the present disclosure includes a housing; and at least one coupling portion provided in the housing so as to couple with another modular fluid chip.

The coupling portion may include at least one protrusion which protrudes from an outer surface of the housing; and at least one receiving groove which is provided in the outer surface of the housing.

The protrusion and the receiving groove may be alternately arranged along a circumference of the housing.

The protrusion and the receiving groove may be formed in a shape in which they correspond to each other.

The protrusion may include an inclined surface formed at an end thereof.

The coupling portion may further include a plurality of magnetic members.

The plurality of magnetic members may be disposed inside the protrusion and the receiving groove.

The plurality of magnetic members may be installed on the outer surface of the housing along a circumference of the housing, but may be disposed at positions different from those of the protrusion and the receiving groove.

The coupling portion may include a blocking member which is configured to be disposed on one side of the magnetic member and block magnetism of the magnetic member.

The modular fluid chip further includes a body received in the housing, wherein in the body, at least one flow channel which is aligned with and communicates with a flow channel provided in the other modular fluid chip, when the housing is connected to the other modular fluid chip, may be formed.

In addition, a modular fluid chip including at least one fluid channel according to a fifth embodiment of the present disclosure includes a connection member configured to be connected to another modular fluid chip and allow the flow channel to communicate with a flow channel provided in the other modular fluid chip.

The modular fluid chip may further include a body including the at least one fluid channel in an inside thereof and configured to be connected to the other modular fluid chip through the connection member.

The connection member may be configured to be coupled to the body and coupled to a body provided in the other modular fluid chip.

The connection member may be configured to be connected to a body provided in the other modular fluid chip through another connection member provided in the other modular fluid chip.

The modular fluid chip may further include a housing receiving the body and the connection member therein.

The connection member may include a flange portion which protrudes from an outer surface thereof, and the housing may include a flange receiving groove which receives and supports the flange portion to thereby limit a movement of the connection member.

The connection member may include a first body and a second body having different materials, wherein the first body may have a tube shape having a hollow inside thereof so as to communicate with the flow channel, and the second body may be coupled to surround a circumference of the first body.

The second body may have a higher hardness than that of the first body.

The connection member may include inclined surfaces formed at both ends thereof.

The body may include a coupling groove which communicates with the at least one flow channel, and the connection member may be inserted into the coupling groove and be in communication with the at least one flow channel.

The modular fluid chip may further include a sealing portion which is press-fitted between the body and the connection member and is configured to allow for sealing between the body and the connection member.

The sealing portion may include a front ferrule portion configured to be press-fitted between the body and the connection member; a rear ferrule portion configured to be press-fitted between the front ferrule portion and the connection member, simultaneously with pressing the front ferrule portion; and a press portion configured to be fastened to the body and press the rear ferrule portion.

The connection member may be formed integrally with the body.

The body may include a glass or wood material.

The coupling portion may further include a tightening portion which is installed in the housing and the other modular fluid chip and is configured to allow the housing and the other modular fluid chip to be in close contact with each other by converting a rotational motion into a linear motion when it is coupled.

The tightening portion may include a shaft portion which includes a fastener capable of being fastened to the housing at one side thereof and includes a caught portion having a projection shape at the other side thereof; and a cam portion which is installed in the other modular fluid chip to receive the caught portion therein and when subjected to external force, which presses the caught portion received therein while rotating in a circumferential direction to thereby linearly move the caught portion in an axial direction.

In addition, a fluid flow system including modular fluid chips according to an embodiment of the present disclosure includes a first modular fluid chip capable of implementing a first function; and at least one second modular fluid chip capable of implementing a second function different from the first function and being connected to the first modular fluid chip in at least one direction of a horizontal direction and a vertical direction.

Each of the first modular fluid chip and the second modular fluid chip may include a body which includes at least one first hole allowing fluid to flow therethrough, and a housing which receives the body therein and includes a second hole and a coupling unit aligned to correspond to the at least one first hole and allowing fluid to flow therethrough, wherein when the first modular fluid chip and the second modular fluid chip are connected, the holes provided in the first modular fluid chip and the holes provided in the second modular fluid chip communicate with each other, and portions where the holes provided in the first modular fluid chip and the holes provided in the second modular fluid chip communicate with each other may be formed in sizes and shapes in which they correspond to each other.

The housing provided in the first modular fluid chip and the housing provided in the second modular fluid chip may be formed to have the same shape or size specification.

Each of the first modular fluid chip and the second modular fluid chip may further include a fluid connector including a third hole aligned to correspond to the first hole and the second hole.

The holes provided in the first modular fluid chip and the holes provided in the second modular fluid chip may have a shape in which a change in fluid pressure is minimized at the portions where the holes provided in the first modular fluid chip and the holes provided in the second modular fluid chip communicate with each other and a composition of fluid or a shape of micro-droplets is maintained.

The holes provided in the first modular fluid chip and the holes provided in the second modular fluid chip may be configured to be aligned horizontally or vertically with respect to the fluid channel formed in the body.

According to an embodiment of the present disclosure, a fluid chip capable of performing one function is formed in the form of a module, whereby a fluid flow system of various structures can be implemented without restriction in shape or size by connecting a plurality of fluid chips capable of performing different functions as necessary. Through this, various and accurate experimental data can be obtained, and when a specific portion is deformed or damaged, only the fluid chip corresponding thereto can be replaced, thereby reducing manufacture and maintenance costs.

In addition, a housing which is connectable to another modular fluid chip, and a body which has a channel formed therein and is selectively replaced in the housing are each formed in a module shape. Accordingly, it is feasible to easily change a position of a selected section and a shape of the channel in one fluid flow system, as needed. Through this, it is feasible to promptly change experimental conditions, thereby allowing for a variety of experiments during a preset period of time, as compared to conventional fluid flow system, and when a part is defective or damaged, only the housing or the body corresponding to the part can be promptly replaced.

In addition, when the modular fluid chip and the other modular fluid chip are connected, holes of the respective fluid chips are in an aligned state and communicate with each other, and at connection portions of the modular fluid chip and other modular fluid chip, fluid connectors that are in close contact with each other and form an interface are provided. Thus, leakage of fluid at the connection portions during the flow of fluid is prevented, and a change in fluid pressure is minimized, and furthermore, a composition of the fluid or a shape of microdroplets can be maintained.

DETAILED DESCRIPTION OF EMBODIMENTS

Figure 1:
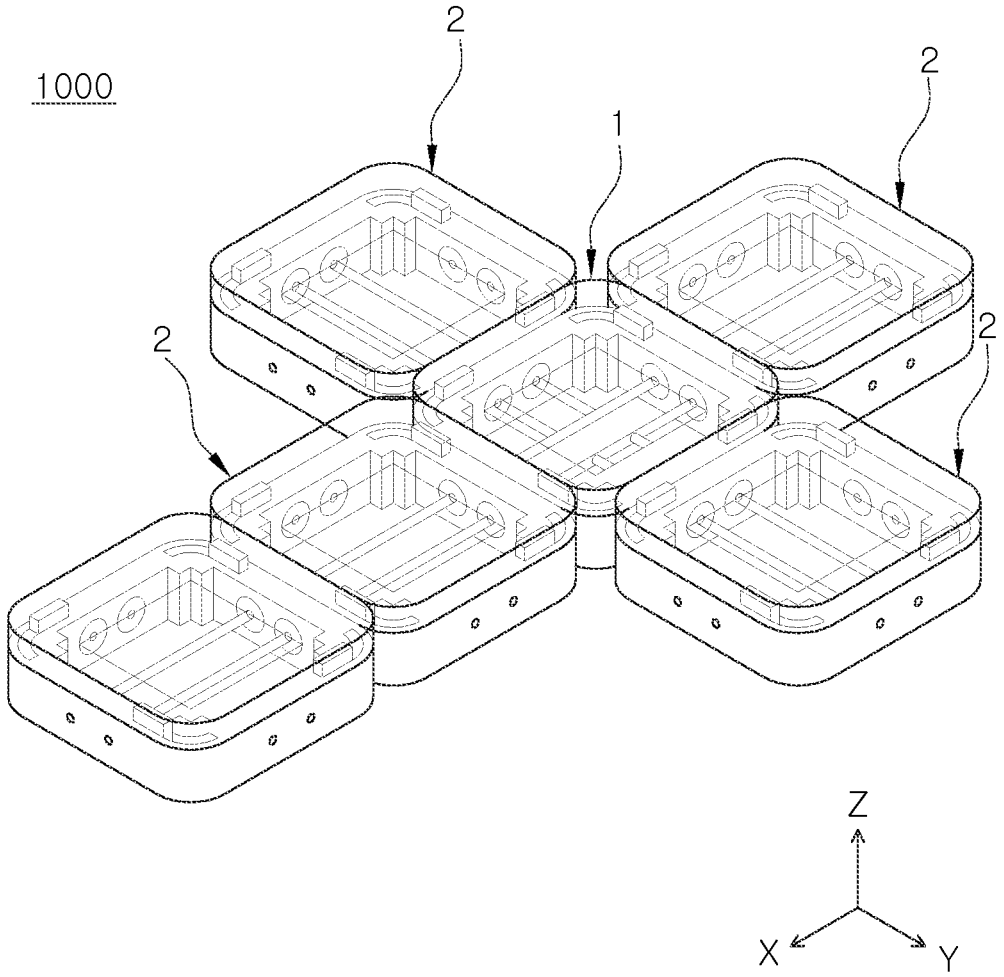
FIG. 1 is a perspective view of a fluid flow system in which modular fluid chips are connected in horizontal directions according to an embodiment of the present disclosure.

Hereinafter, various embodiments will be described More specifically with reference to the accompanying drawings. The embodiments may be variously modified. Specific embodiments may be depicted in the drawings and concretely explained in the detailed description. However, specific embodiments disclosed in the accompanying drawings are only intended to facilitate understanding of various embodiments. Therefore, it is not intended to limit the technical idea to the specific embodiments disclosed in the accompanying drawings, and it should be understood to include all equivalents or substitutes included in the spirit and scope of the invention.

Terms such as first or second may be used to describe various components, but the components should not be limited by the terms. The terms are only for the purpose of distinguishing one component from another component.

In this specification, it should be understood that term "include" or "have" indicates that a feature, a number, a step, an operation, a component, a part, or the combination thereof described in the specification is present, but does not exclude a possibility of presence or addition of one or more other features, numbers, steps, operations, components, parts or combinations thereof, in advance. When a component is said to be "connected" or "accessed" to another component, it may be directly connected to or accessed to that other component, but it is to be understood that other components may exist in between. On the other hand, when a component is said to be "directly connected" or "directly accessed" to another component, it should be understood that there is no other component in between.

Meanwhile, "a module" or "a unit, part or portion" for a component used in the specification performs at least one function or operation. And, the "module" or "unit, part or portion" may perform a function or operation by hardware, software, or a combination of hardware and software. In addition, a plurality of "modules" or a plurality of "units, parts or portions" except for modules" or "units, parts or portions" that should be performed in a specific hardware or is performed by at least one processor may be integrated into at least one module. Singular expressions used herein include plural expressions unless they have definitely opposite meanings in the context.

In addition, in the description of the present disclosure, when it is determined that specific description about the related known technique may unnecessarily obscure the gist of the present disclosure, a detailed description thereof is abbreviated or omitted.

Figure 34:
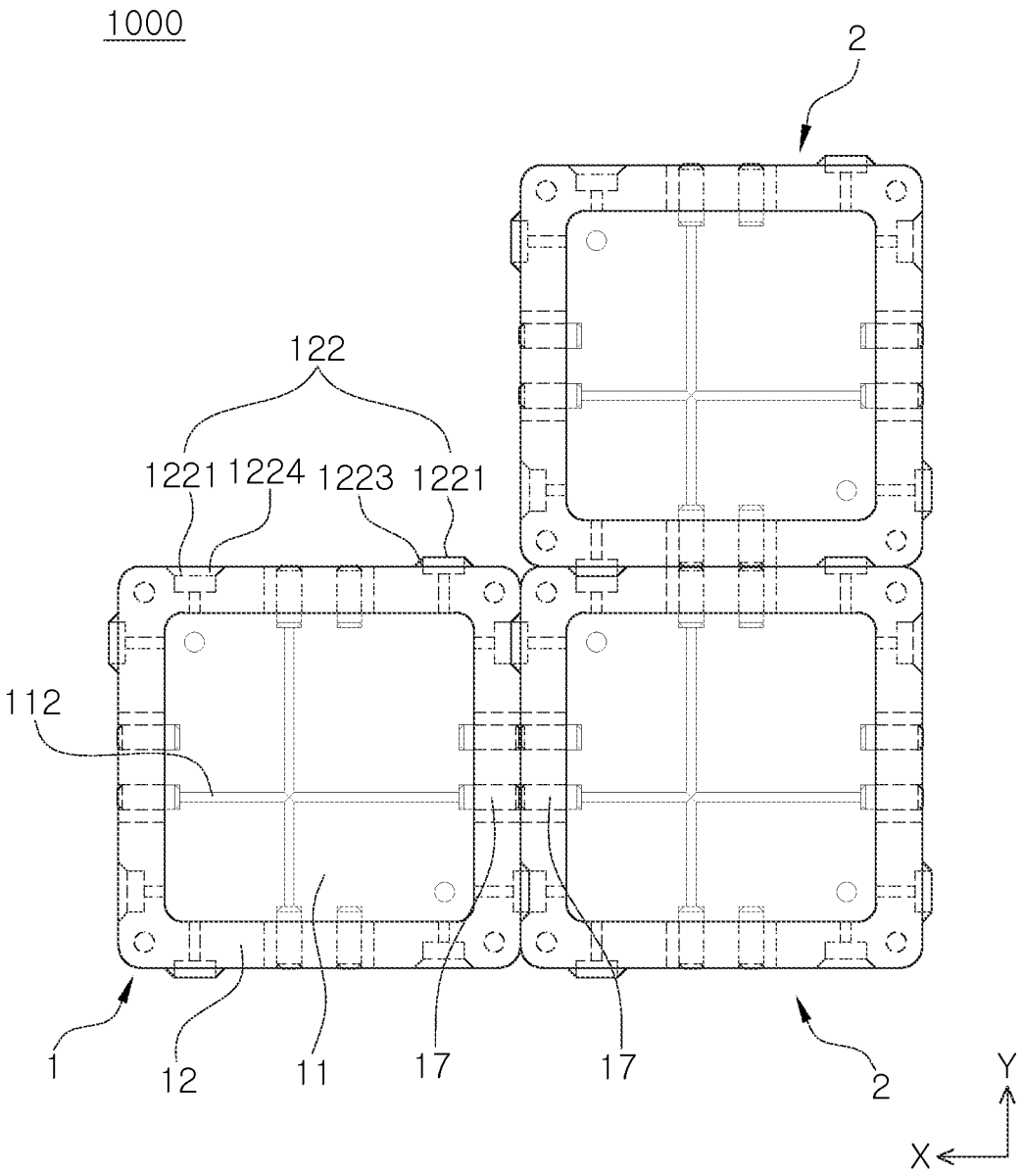
FIG. 34 is a plan view illustrating a fluid flow system implemented through a modular fluid chip according to another embodiment of the present disclosure.

Referring to FIGS. 1 and 34, a modular fluid chip 1 (hereinafter, referred to as 'modular fluid chip 1') according to an embodiment of the present disclosure is formed in the form of a module capable of performing one function, and is connected to other modular fluid chips 2 to implement a fluid flow system 1000 of various structures.

The fluid flow system 1000 implemented through the modular fluid chip 1 may perform, from fluid such as liquid samples including body fluid, blood, saliva, and a skin cell, analysis/detection processes such as sample collection, sample shredding, extraction of substances such as genes or proteins from collected samples, filtering, mixing, storage, valve, amplification using a polymerase chain reaction including RT-PCR and the like, an antigen-antibody reaction, affinity chromatography and electrical sensing, electrochemical sensing, capacitor type electrical sensing, and optical sensing with or without a fluorescent material. However, the fluid flow system 1000 implemented through the modular fluid chip 1 is not necessarily limited to having functions described above, and may perform various functions for fluid analysis and diagnosis. For example, in the embodiment, the modular fluid chips 1 and 2 are illustrated to perform a function for movement of fluid, but the fluid flow system 1000 may be configured to allow a series of processings, for example, processes in which after fluid is introduced and cells in the fluid are shredded and filtered, a gene is amplified and then, a fluorescent substance is attached to the amplified gene to be observed.

In addition, the fluid flow system 1000 implemented through the modular fluid chip 1 can implement a factory-on-a-chip technology through connection with another fluid flow system 1000. Through this, fluid analysis and diagnosis on different fluids may be simultaneously performed in the respective fluid flow systems 1000, and all experiments (for example, chemical reactions and material synthesis or the like) associated with fluid that may be performed using the fluid flow systems 1000 may be performed simultaneously through a plurality of the fluid flow systems 1000.

In addition, the modular fluid chip 1 may be connected to the other modular fluid chips 2 in horizontal directions (an X-axis direction and a Y-axis direction) to implement one fluid flow system 1000.

More specifically, the modular fluid chip 1 may be connected to the other modular fluid chips 2 in the X-axis direction and Y-axis direction that indicate the horizontal directions in the drawings to thereby implement one fluid flow system 1000 including a plurality of fluid flow and analysis sections. Accordingly, fluid can move freely in the X-axis direction and Y-axis direction. For example, the number of the other modular fluid chips 2 that may be connected in the X-axis direction and Y-axis direction around the modular fluid chip 1 may be 1 to 10,000.

The modular fluid chip 1 according to various embodiments of the present disclosure will be described in more detail.

Figure 2:
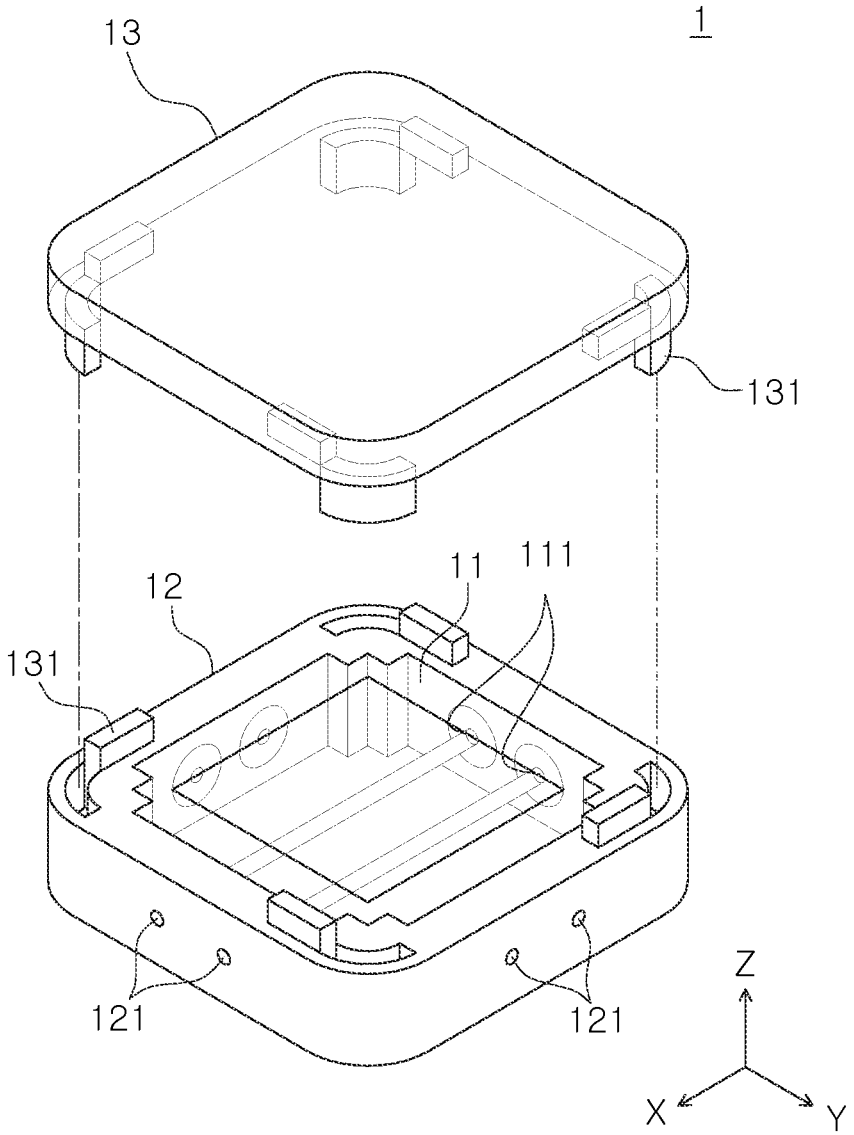
FIG. 2 is a perspective view illustrating a state in which a cover of the modular fluid chip according to an embodiment of the present disclosure is separated.
Figure 3:
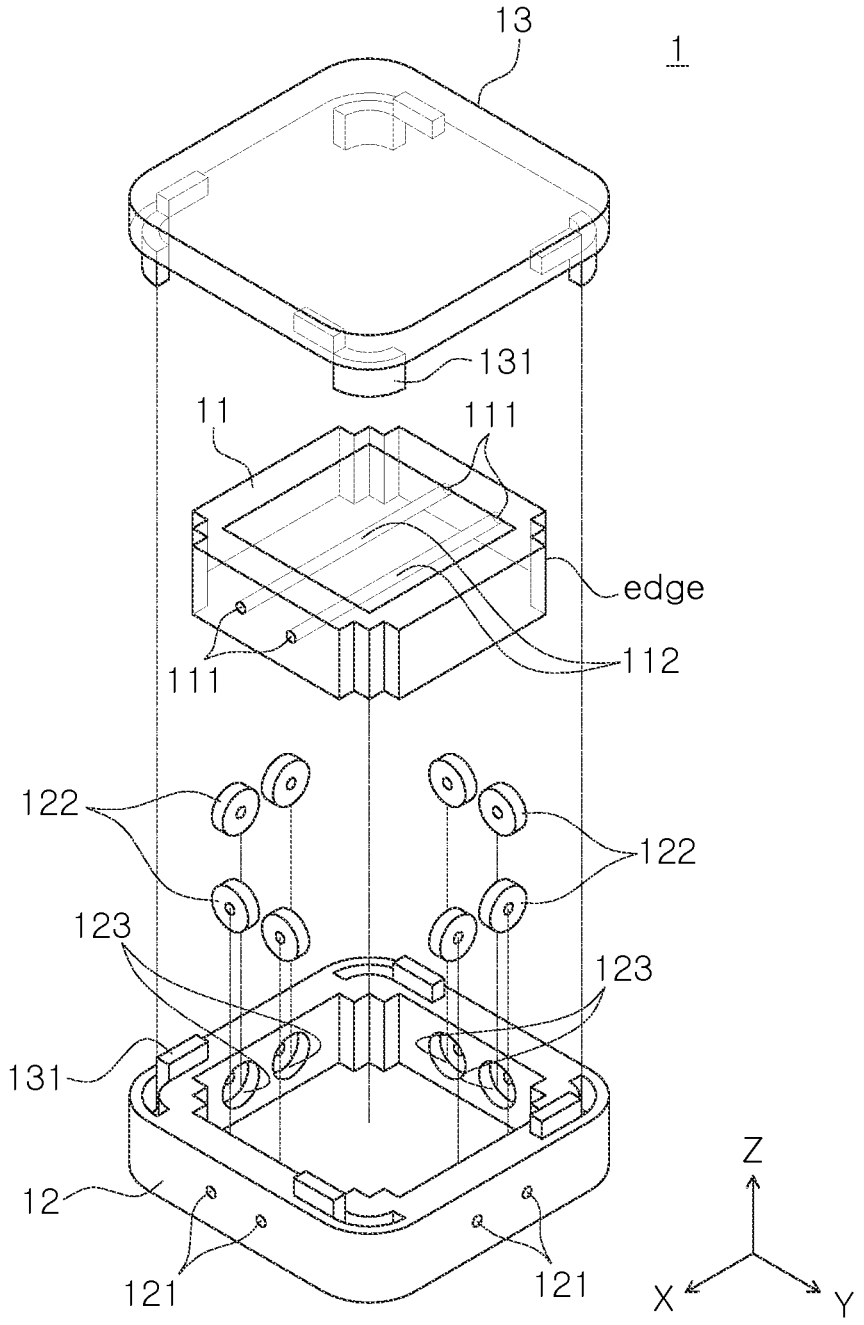
FIG. 3 is an exploded perspective view of FIG. 2.

Referring to FIGS. 2 and 3, the modular fluid chip 1 according to a first embodiment of the present disclosure includes a body 11.

The body 11 is formed in the form of a module capable of performing one function and is received in a housing 12, and the body 11 may be selectively replaced in the housing 12 if necessary. In addition, the body 11 may be formed in a shape corresponding to an inner surface of the housing 12 in which a receiving space is formed, and may be formed to have the same height as the housing 12 based on a Z-axis direction in the drawings. For example, the body 11 may be manufactured using techniques, such as MEMS, 3D printing, injection molding, CNC machining, imprinting, polymer casting and the like.

In addition, when the body 11 is coupled to the housing 12, it may be accurately fixed to a set position and may be formed in a polyhedral structure in such a manner that it is in surface-contact with the inner surface of the housing 12.

In addition, the body 11 may be formed to have transparency as a whole or a part in such a manner that a flow of fluid flowing in an interior from an exterior of the body 11 can be visually confirmed. For example, the body 11 may be formed of at least one of an amorphous material such as glass, wood, a polymer resin, a metal, and an elastomer, or may be formed through a combination thereof.

In addition, a portion of the body 11 may be formed of an elastomer material.

For example, a portion of the body 11 where fluid flows or contact with other components is made may be formed of an elastomer material. When the body 11 is partially formed of an elastomeric material, the body 11 may be manufactured through double injection molding or the like.

Figure 7:
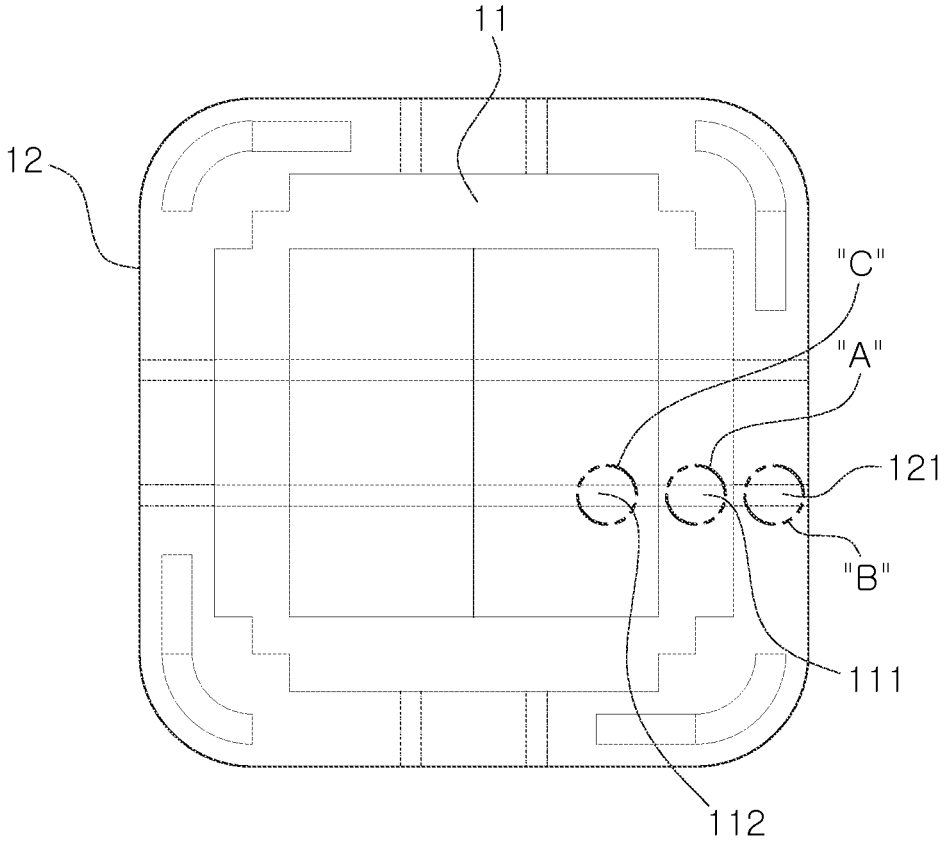
FIG. 7 is a plan view of the modular fluid chip according to an embodiment of the present disclosure.

Referring to FIGS. 3 and 7, a first hole 111 is formed in the body 11 to guide a flow of fluid.

The first hole 111 communicates with a second hole 121 of the housing 12 to be described later and the fluid channel 112 to be described later that is formed in the inside of the body 11, to thereby guide the flow of fluid in at least one direction of the X-axis direction and the Y-axis direction. For example, the first hole 111 is formed in a predetermined section from the outer surface of the body 11 toward the inside of the body 11, but may be formed in a section having a size smaller than that of a section in which the fluid channel 112 is formed.

Figure 8:
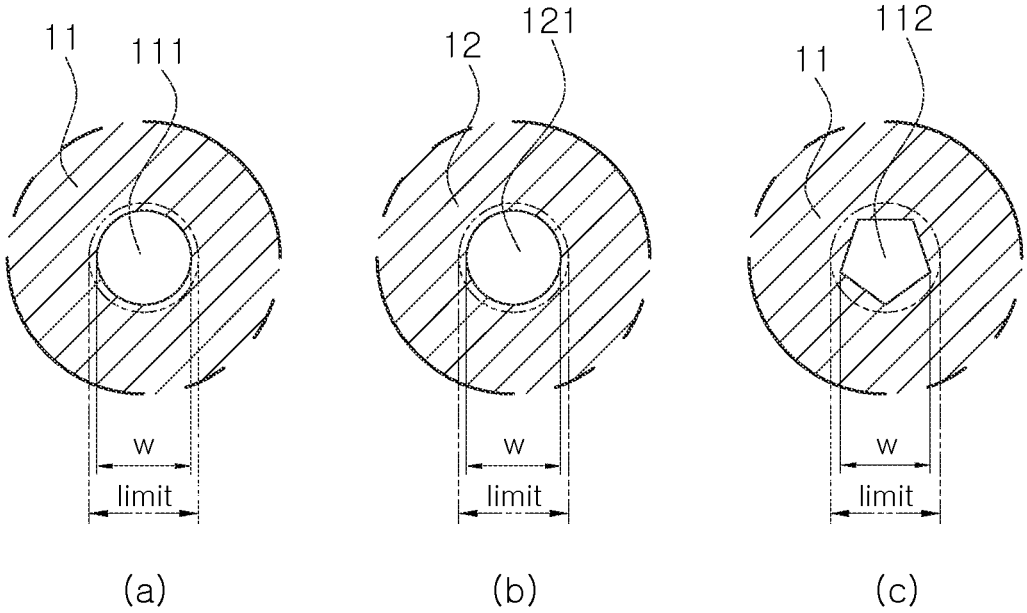
FIG. 8 is a view illustrating cross-sections of portions "A", "B" and "C" of FIG. 7.

In addition, the first hole 111 may be formed in a shape corresponding to the second hole 121 provided in the housing 12 and the fluid channel 112 provided in the body 11. Accordingly, the first hole 111 may prevent a phenomenon in which a fluid flow is unstable or fluid pressure increases between the housing 12 and the body 11 during the flow of fluid. For example, the first hole 111 may have a circular shape in a cross-section as shown in FIG. 8(*a*), or may have a polygonal or elliptical shape in the cross-section although not shown in the drawings. However, the shape of the first hole 111 is not limited thereto, and may be formed in various manners within a limit in which a width w is equal to or greater than 10 nm and is equal to or less than 1 Cm.

Here, the fact that the first hole 111 and the second hole 121 have a shape and size corresponding each other and form fluid paths that are linear with respect to each other may allow for a predictable flow velocity when the fluid moves from one module to another module. In some conventional microfluidic flow devices, fluid transfers through a tube. In the case of a device using a tube, a difference in widths of channels occurs at portions where the tube and the device are connected to each other, or a space may be created in the channel, causing a vortex in fluid. This vortex not only causes a rapid change in flow velocity, but also may deform a droplet shape. Otherwise, it may give a physical impact to substances in the fluid or interrupt movement of the substances. Therefore, the fact that the first hole 111 of the body 11 and the second hole 121 of the housing 12 have the same width and are arranged in a straight line may allow for a stable flow velocity of the fluid and stable movement of the substances, in addition to a function of simply ensuring connection between the modules. In addition, the housing 12 and the second hole 121 of the housing 12 can ensure stability of the fluid described above no matter what function or shape the module has in the module system of the present application.

In addition, the fluid channel 112 may be formed in the body 11.

Referring to FIGS. 3 and 7, the fluid channel 112 may communicate with at least one first hole 111 and allow the flow of fluid. For example, referring to FIG. 8(*c*), the fluid channel 112 may have a polygonal shape in a cross-section, or may have a circular or elliptical shape in the cross-section although not shown in the drawings. However, the shape of the fluid channel 112 is not limited thereto, and may be formed in various manners within a limit in which a width w is equal to or greater than 10 nm and is equal to or less than 1 Cm.

In addition, the fluid channel 112 may be configured to perform one preset function on the flowing fluid, as well as guiding the flow of fluid in various directions.

Figure 4:
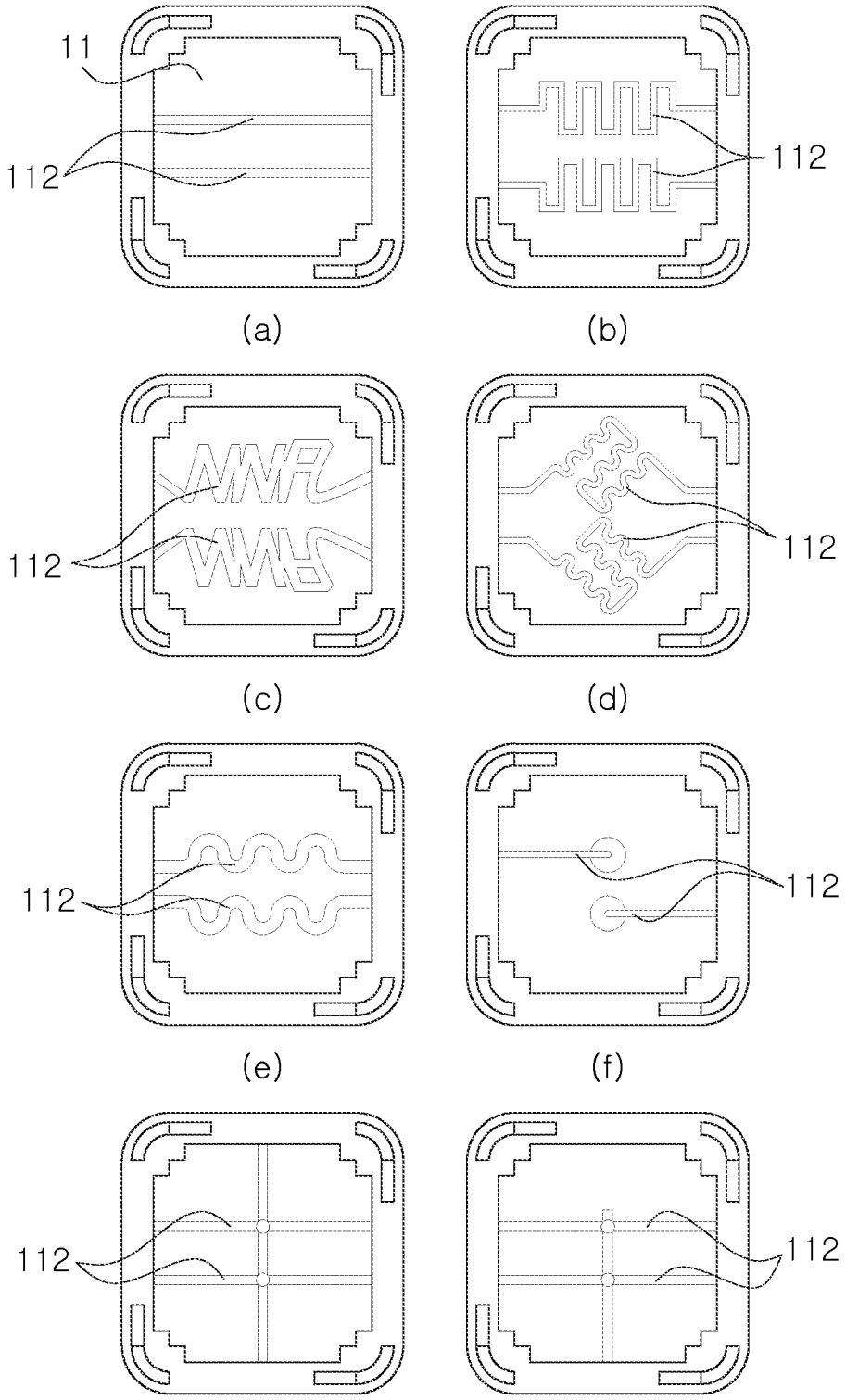
FIGS. 4 to 6 are views schematically illustrating various embodiments of channels formed in the body of the modular fluid chip according to an embodiment of the present disclosure.
Figure 5:
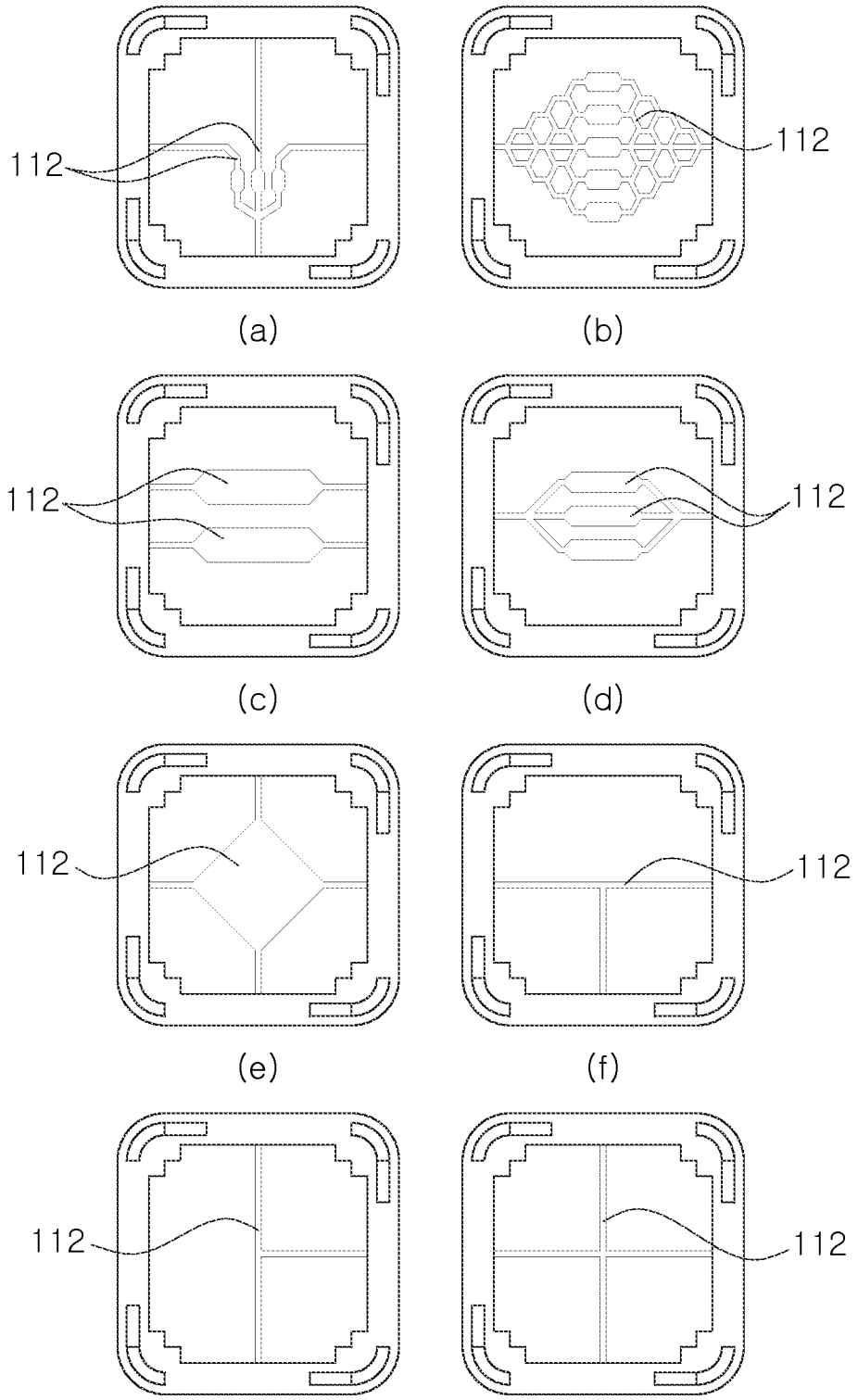
Figure 6:
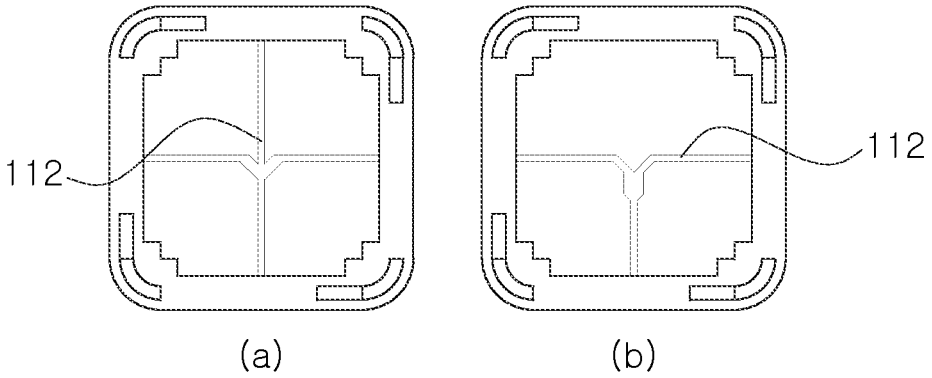

For example, referring to FIGS. 4 to 6, in the inside of the body 11, at least one fluid channel among straight fluid channels 112 (FIG. 4(*a*) and FIG. 4(*b*)), streamline fluid channels 112 (FIG. 4(*c*), FIG. 4(*d*) and FIG. 4(*e*)), fluid channels 112 having at least one well (FIG. 4(*f*), FIG. 4(*g*) and FIG. 4(*h*)), fluid channels 112 having a valve (FIG. 5(*a*), FIG. 5(*b*), FIG. 5(*c*), FIG. 5(*d*) and FIG. 5(*e*)), fluid channels 112 having at least one branch (FIG. 5(*f*) and FIG. 5(*g*)), cross-shaped fluid channels 112 (FIG. 5(*h*) and FIG. 6(*a*)), a Y-shaped fluid channel 112 (FIG. 6(*b*)), a fluid channel having a sensor (not shown), a fluid channel having an electrical output unit (not shown), and a fluid channel having an optical output unit (not shown) may be formed. However, the flow channel 112 is not necessarily limited thereto, and may be changed into various structures and shapes to thereby be applied. In addition, the fluid channel 112 may be made through a combination of the channels described above.

Meanwhile, the other modular fluid chip 2 connected to the modular fluid chip 1 may include the body 11 capable of performing a function different from the function of the body 11 of the modular fluid chip 1.

That is, different types of fluid channels 112 may be formed in the body 11 of the modular fluid chip 1 and the body 11 of the other modular fluid chip 2.

Accordingly, the plurality of the modular fluid chips 1 and 2 that are connected to each other to implement the fluid flow system 1000 may perform different functions on fluid flowing therein. Here, each of the plurality of modular fluid chips 1 and 2 connected to each other may be formed to perform only one function. For example, when one fluid chip 1 has a Y-shaped fluid channel 112 and performs a function for mixing, the other fluid chip 2 connected thereto may include a type of the fluid channel 112 different from that of the Y-shaped fluid channel 112 described above and perform a function different from that of the fluid chip 1.

In addition, the modular fluid chip 1 according to the first embodiment of the present disclosure includes the housing 12.

Referring to FIGS. 3 and 7, the housing 12 is formed in a frame structure having a receiving space formed therein, and is configured to receive the body 11 therein. In addition, the second hole 121 is formed in the housing 12, and the second hole 121 corresponds to the at least one first hole 111 provided in the body 11 and allows the flow of fluid, when the body 11 is received in the receiving space.

The second hole 121 is formed in at least one position along the circumference of the housing 12 and communicates with the first hole 111 of the body 11 to thereby guide the flow of fluid in at least one direction of the X-axis direction and the Y-axis direction.

In addition, the second hole 121 is formed in a shape corresponding to the first hole 111 provided in the body 11 and may prevent a phenomenon in which a fluid flow is unstable or fluid pressure increases between the housing 12 and the body 11 during the flow of fluid. For example, the second hole 121 may have a circular shape in a cross-section as shown in FIG. 8(*b*), or may have a polygonal or elliptical shape in the cross-section although not shown in the drawings. However, the shape of the second hole 121 is not limited thereto, and may be formed in various manners within a limit in which a width w is equal to or greater than 10 nm and is equal to or less than 1 Cm.

In addition, the housing 12 may be formed of at least one of a ceramic, a metal, and a polymer. Here, the ceramic means a material composed of an oxide, a carbide, a nitride made by combining a metal element such as silicon, aluminum, titanium, zirconium or the like, with oxygen, carbon, nitrogen. The housing 12 may be formed of one of the above ceramic materials or may be formed of a ceramic mixture in which at least one or more of the above ceramic materials are mixed. And, the metal means a material composed of an element which is named as a metal in the chemical periodic table, such as Au, Mg, Ti, Cr, Mn, Fe, Co, Ni, Cu, Zn, Ga, Al, Zr, Nb, Mo, Ru, Ag, Sn or the like. The housing 12 may be formed of any one of the above metal materials, or may be formed of a metallic mixture in which at least one or more of the above metal materials are mixed. And, the polymer refers to a material composed of COC, PMMA, PDMS, PC, TIPP, CPP, TPO, PET, PP, PS, PEEK, Teflon, PI, PU or the like. The housing 12 may be formed of any one of the above polymer materials, or may be formed of a polymer mixture in which at least one or more of the above polymer materials are mixed. In addition, the housing 12 may be formed of a mixture of the ceramic, metal, and polymer described above. However, the housing 12 is not necessarily limited thereto, and may be formed of a variety of materials.

In addition, the housing 12 may be formed of a material similar to that of the body 11 described above, or may be formed of a material different from that of the body 11.

More specifically, the housing 12 formed of at least one of a ceramic, a metal, and a polymer, and the body 11 formed of at least one of a polymer resin, an amorphous material, a metal, and an elastomer may be formed of materials similar to each other or may be formed of materials different from each other, if necessary.

Through this, the housing 12 and the body 11 can maximize adhesion of a surface-contact portion thereof to prevent mutual separation, as well as prevent fluid leakage in a connection portion thereof.

Here, the housing 12 formed separately from the body 11 is for the purpose of ensuring a stable flow of fluid when the modular fluid chips 1 are connected as described above, but is also for the purpose of providing convenience in modularizing the modular fluid chips 1. That is, since a position of the second hole 121 of the housing 12 is standardized, when designing and manufacturing the body 11, as long as the body 11 is manufactured to have a standardized entrance or exit or the first hole 111, fluid connection or interfacing between modules can be ensured. In addition, when only the body 11 is newly manufactured and coupled to the housing 12, a module having a new function may be assembled.

In addition, the housing 12 includes a fluid connection part 17.

The fluid connection part 17 is configured to connect the modular fluid chip 1 with the other modular fluid chip 2.

Figure 23:
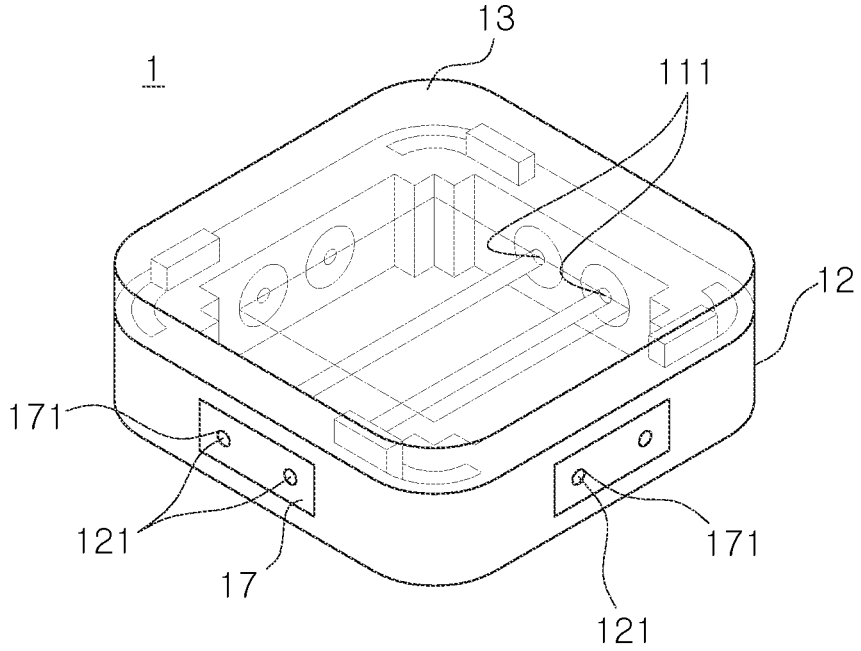
FIG. 23 is a perspective view illustrating a state in which a fluid connector is applied to the modular fluid chip according to an embodiment of the present disclosure.
Figure 24:
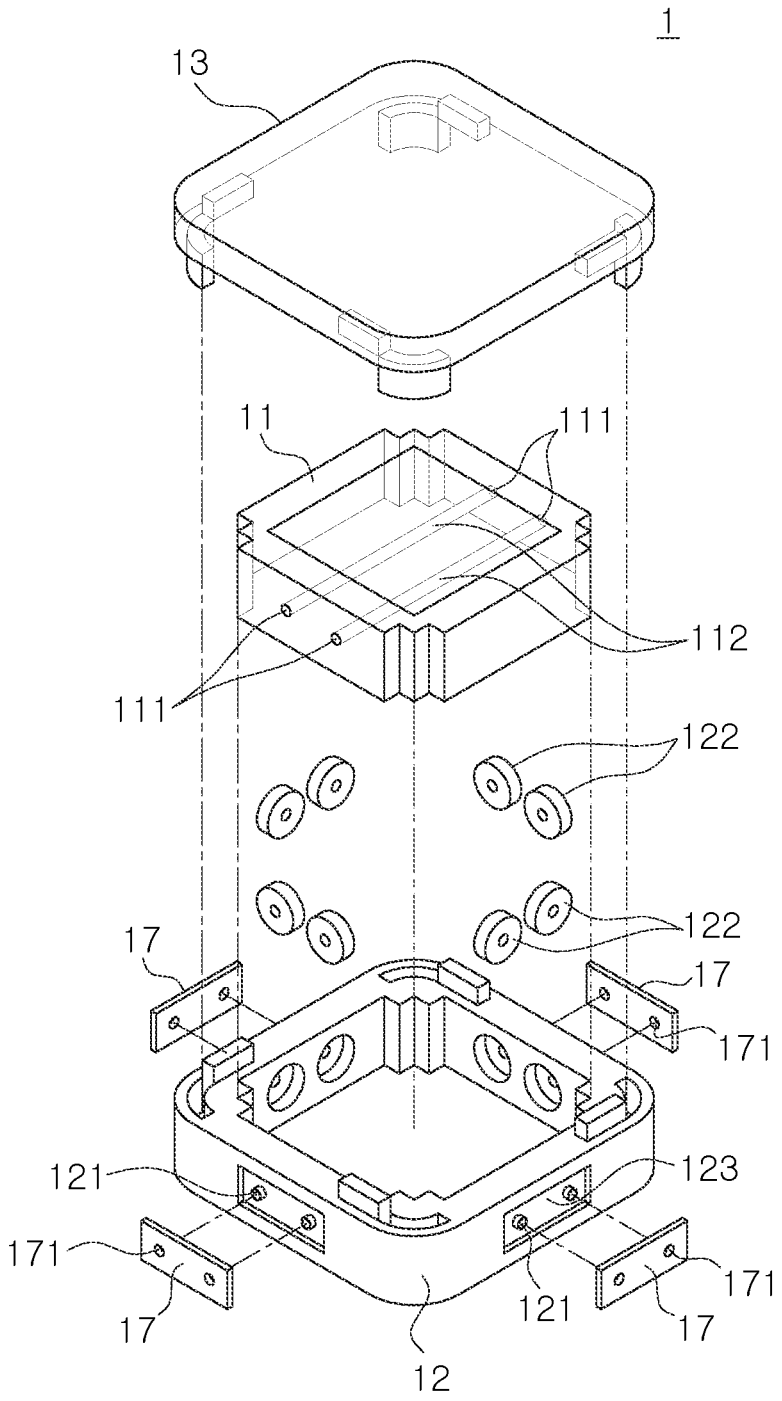
FIG. 24 is an exploded perspective view of FIG. 23.

Referring to FIGS. 23 and 24, the fluid connection part 17 may be formed in the form of a sheet or pad, and may be detachably installed on an outer surface of the housing 12. Here, a seating groove 123 corresponding to the fluid connection part 17 so that the fluid connection part 17 can be seated therein may be formed in the outer surface of the housing 12. In addition, a third hole 171 which is aligned to correspond to the first hole 111 and the second hole 121 may be formed in the fluid connection part 17.

Figure 25:
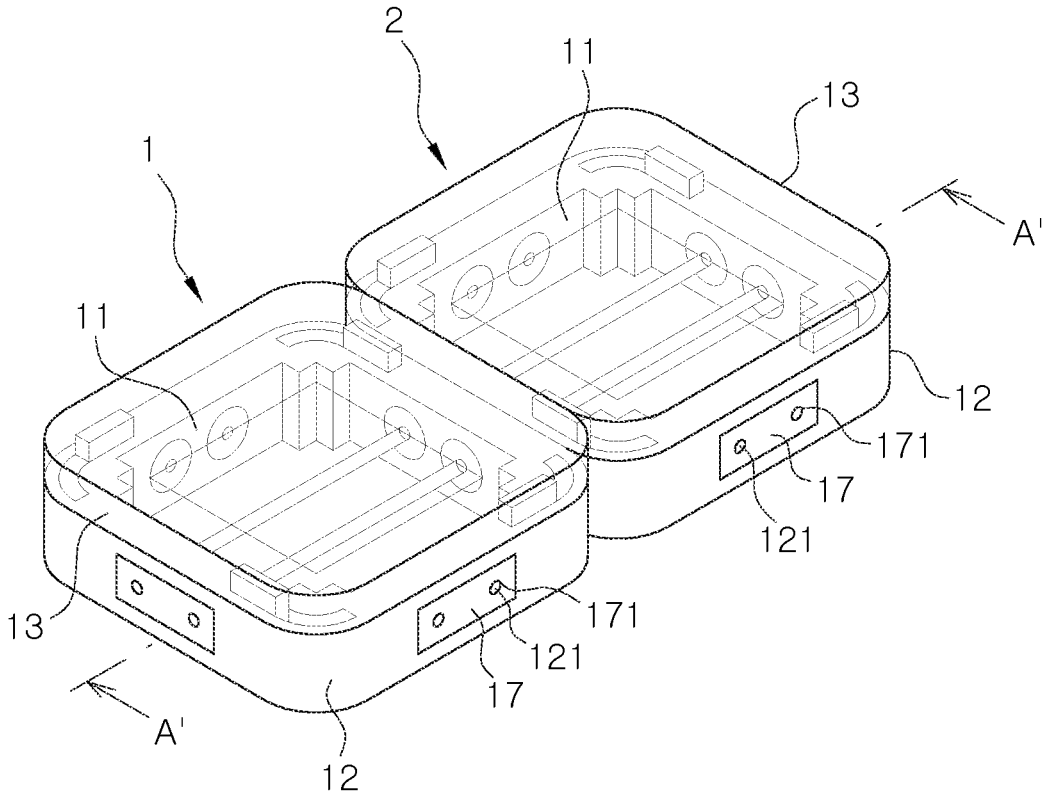
FIG. 25 is a perspective view illustrating a state in which the modular fluid chip is connected to the other modular fluid chip according to an embodiment of the present disclosure.
Figure 26:
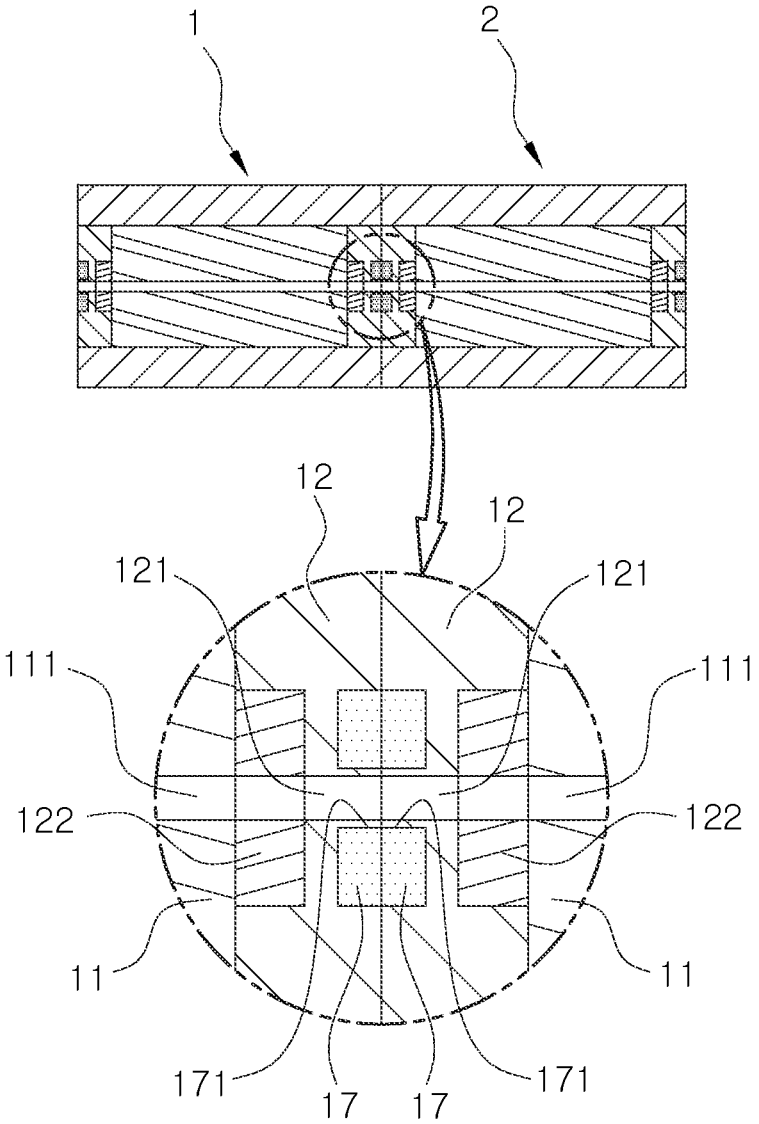
FIG. 26 is a cross-sectional view taken along line A'-A' of FIG. 25.

In addition, referring to FIGS. 25 and 26, the fluid connection part 17 may be configured to form an interface when contacting another fluid connection part 17.

More specifically, the fluid connection part 17 may be formed of an elastically deformable elastomer material and form an interface at a contact portion when contacting another fluid connection part 17. Here, an adhesive layer may be provided on one surface of the fluid connection part 17, and the adhesive layer can be adhered to one surface of another fluid connection part 17 when the fluid connection part 17 contacts the other fluid connection part 17.

However, the fluid connection part 17 is not limited thereto, and may be changed into various shapes or various materials to thereby be applied within conditions capable of performing the same function. For example, when the housing 12 is manufactured, the fluid connection part 17 may be integrally provided on the outer surface of the housing 12 through double injection molding, and may be formed in a circular or polygonal ring shape with a hole formed in a center thereof, or may be formed in a plate-like stopper shape. In addition, the fluid connection part 17 may be formed of at least one of a polymer resin, an amorphous material, and a metal, and may include at least one of chlorinated polyethylene, ethylene propylene dimethyl, silicone rubber, acrylic resin, amide resin, epoxy resin, phenol resin, polyester-based resin, polyethylene-based resin, ethylene-propylene rubber, polyvinyl butyral resin, polyurethane resin, and nitrile-butadiene-based rubber.

Therefore, when the modular fluid chip 1 and the other modular fluid chip 2 are connected in the horizontal or vertical direction, the fluid connection part 17 provided in the modular fluid chip 1 is in close contact with the fluid connection part 17 provided in the other modular fluid chip 2 and forms an interface. Through this, a connection portion between the modular fluid chip 1 and the other modular fluid chip 2 may be completely airtight to thereby block leakage of fluid. Here, a coupling unit 122 to be described later that has magnetism so as to maximize adhesion of the fluid connection unit 17 may be disposed on an inner surface of each housing 12 provided in the modular fluid chip 1 and the other modular fluid chip 2.

In addition, the fluid connection part 17 may be disposed on at least one of an outside and an inside of the housing 12.

Figure 27:
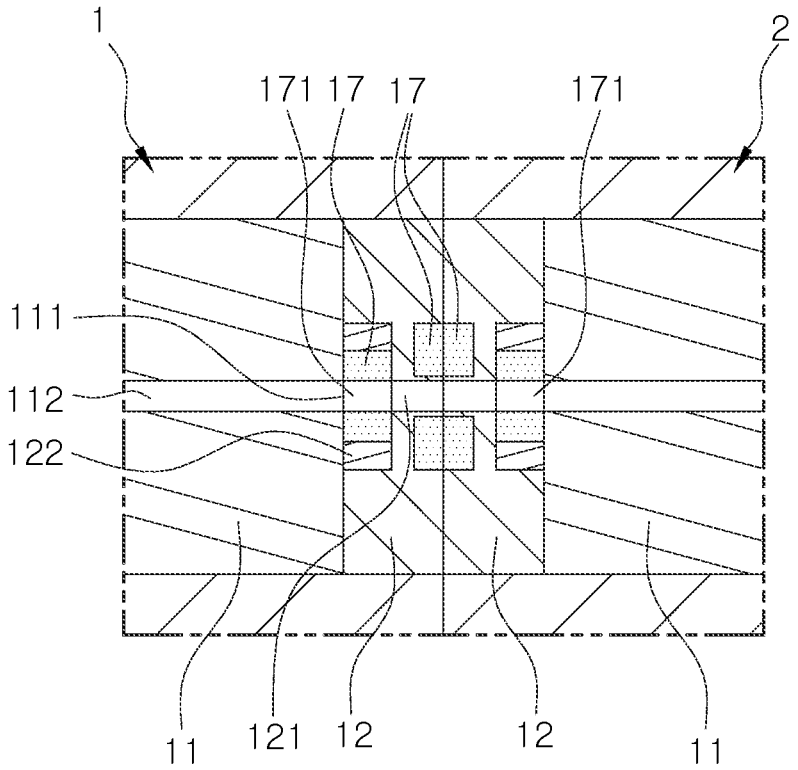
FIGS. 27 to 32 are views illustrating states in which various embodiments of the fluid connector are applied to the modular fluid chips according to an embodiment of the present disclosure.

Referring to FIG. 27, the fluid connection part 17 disposed on the outside of the housing 12 may be in close contact with the other fluid connection part 17 and form an interface, and the fluid connection part 17 disposed on the inside of the housing 12 may be in close contact with the body 11 and form an interface. Here, the coupling unit 122 having magnetism may be provided around the fluid connection part 17 disposed on the inside of the housing 12. Accordingly, it is feasible to improve airtight performance between the modular fluid chip 1 and the other modular fluid chip 2 by maximizing adhesion of the fluid connection unit 17 to be disposed on the outside of the housing 12.

In addition, the fluid connection part 17 may be formed in a structure capable of being coupled to the housing 12.

Figure 28:
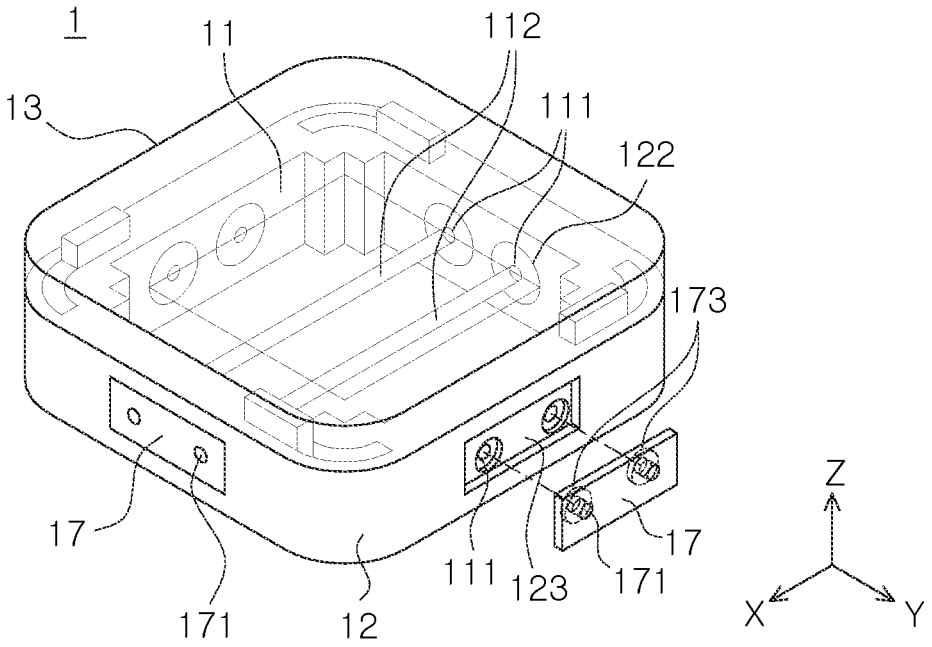
Figure 29:
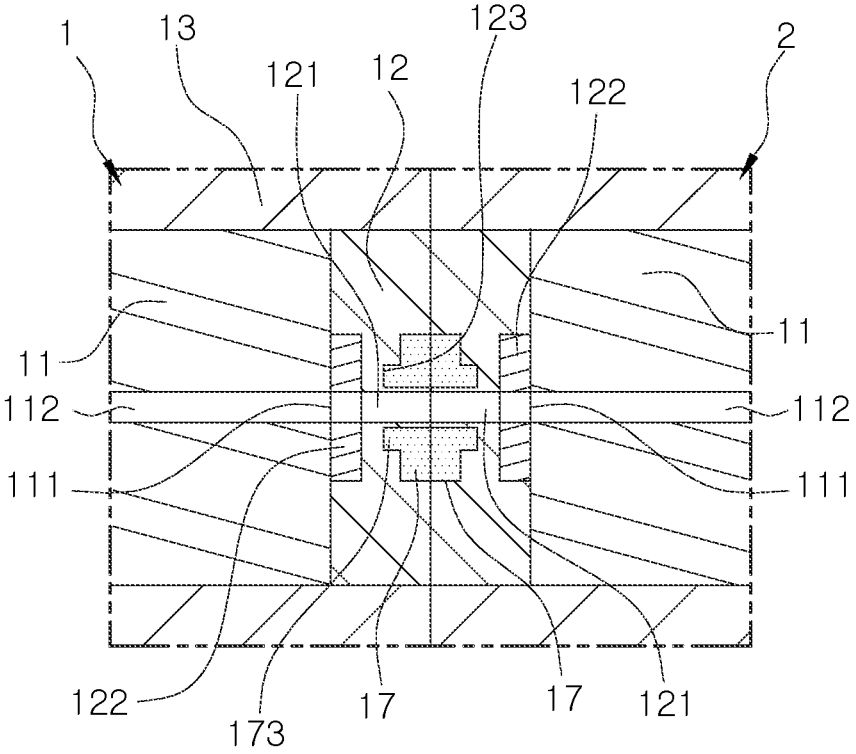

Referring to FIGS. 28 and 29, a convex portion 173 having a protrusion shape may be formed on the fluid connection part 17, and the convex portion 173 protrudes from an outer surface of the fluid connection part 17 by a predetermined length and is inserted into the seating groove 123 formed in the housing 12. Accordingly, the fluid connection part 17 is more stably coupled to the housing 12 so that the movement thereof is restricted and further, even when the modular fluid chip 1 is coupled to the other modular fluid chip 2, it is feasible to prevent the fluid connection part 17 from being separated from the housing 12.

Meanwhile, although not shown in the drawings, a concave portion having a groove shape may be formed in the fluid connection part 17, and the concave portion may be recessed from the outer surface of the fluid connection part 17 to a predetermined depth and coupled to the protrusion formed in the housing 12.

However, a coupling structure provided in the fluid connection part 17 is not necessarily limited thereto, and may be changed into various shapes to thereby be applied.

In addition, the fluid connection part 17 may be formed in a structure capable of directly communicating with the body 11 to thereby be connected to the other modular fluid chip 2.

Figure 30:
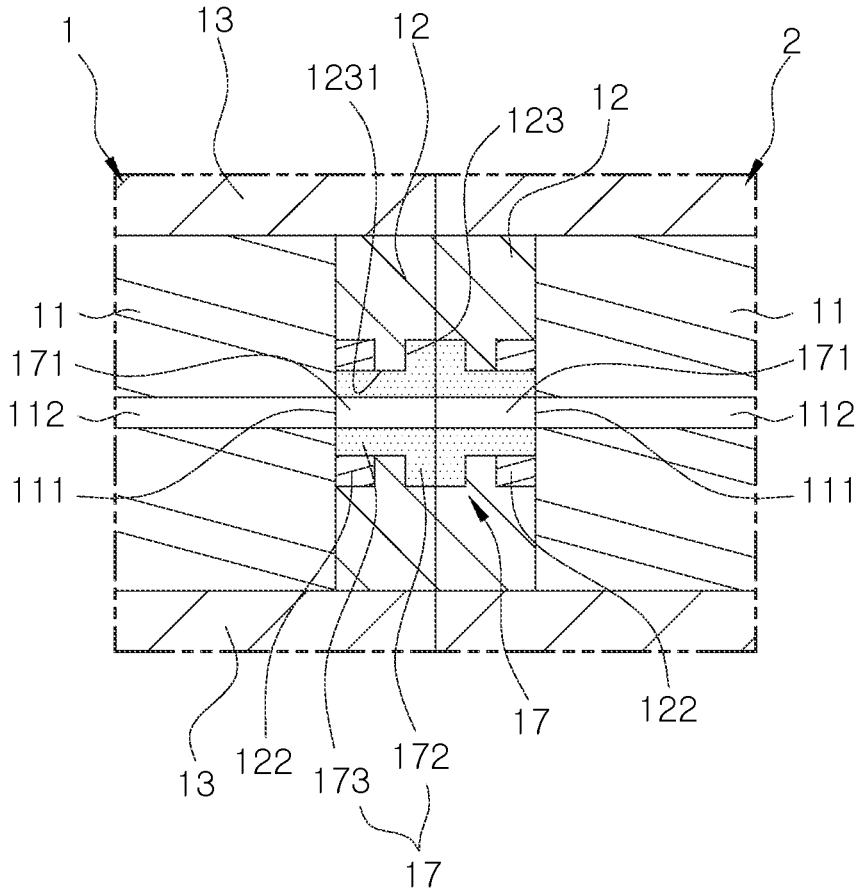

Referring to FIG. 30, the fluid connection part 17 is received in the housing 12, but may pass through the housing 12 to thereby be in close contact with the outer surface of the body 11. Accordingly, the third hole 171 provided in the fluid connection part 17 directly communicates with the first hole 111 provided in the body 11 and allows the flow of fluid.

That is, the fluid connection part 17 installed by passing through the housing 12 is in close contact with the fluid connection part 17 of the other modular fluid chip 2 at one side thereof to thereby form an interface, and is in close contact with the outer surface of the body 11 at the other side thereof to thereby form an interface, so that points at which fluid may leak may be minimized. Through this, a stable fluidic flow may be allowed.

For example, the fluid connection part 17 may include a seating portion 172 which is seated in the seating groove 123 formed in the outer surface of the housing 12 and which is connected to the other modular fluid chip 2, and the convex portion 173 which protrudes from one surface of the seating portion 172 by a predetermined length and passes through the housing 12 and which is in close contact with the outer surface of the body 11 and forms an interface. Here, a concave portion 1231 may be provided in the inner surface of the housing 12, and the concave portion 1231 is formed in a shape corresponding to an outer surface of the convex portion 173 and supports the convex portion 173. Further, the coupling unit 122 to be described later that has magnetism may be further disposed around the convex portion 173 so as to maximize adhesion of the seating portion 172.

In addition, the fluid connection part 17 may be formed in a structure in which it is divided into plural numbers, while directly communicating with the body 11.

Figure 31:
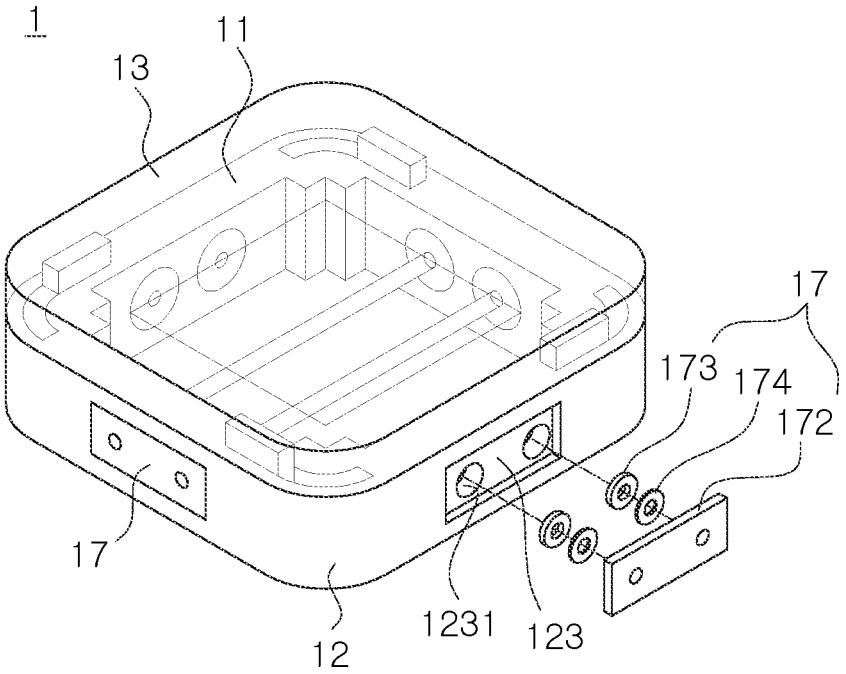
Figure 32:
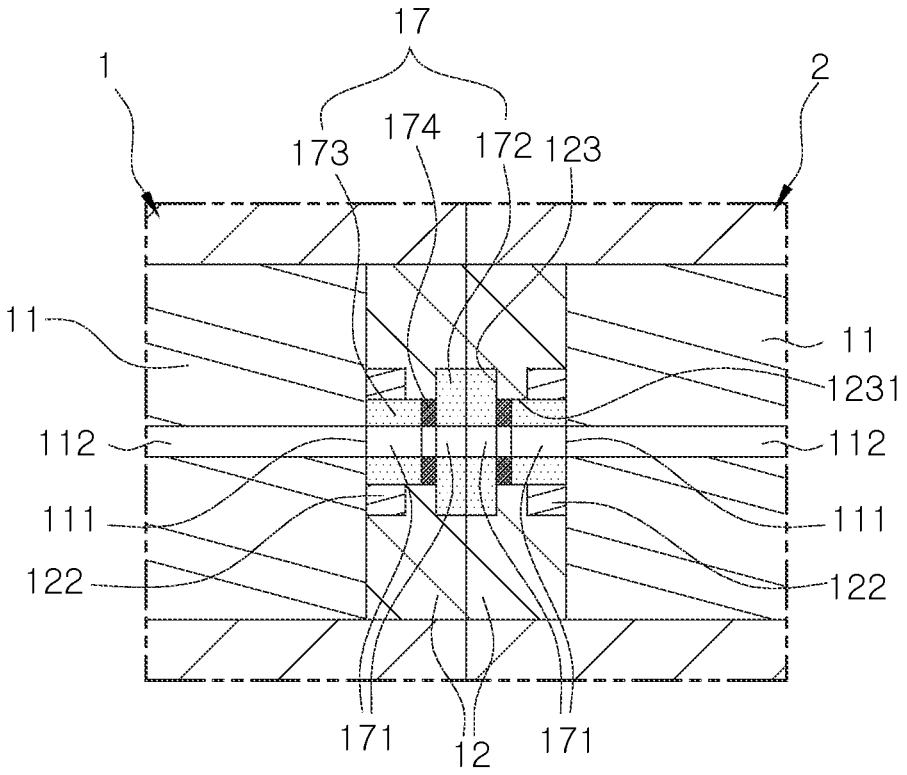

Referring to FIGS. 31 and 32, the fluid connection part 17 may include the seating portion 172, the convex portion 173, and an O-ring 174.

The seating portion 172 may be seated in the seating groove 123 formed in the outer surface of the housing 12 and may be in close contact with the other modular fluid chip 2 to thereby form an interface.

The convex portion 173 may be separated from the seating portion 172 and received in the concave portion 1231 provided inside the housing 12, and may be in close contact with the outer surface of the body 11 and form an interface.

The O-ring 174 is disposed between the seating portion 172 and the convex portion 173 to connect the seating portion 172 and the convex portion 173 to each other and uniformly distributes a load which acts on a fluid connector 17 in the axial direction when connecting the modular fluid chip 1 and other modular fluid chip 2, thereby preventing deformation of the seating portion 172 or the convex portion 173. For example, the O-ring 174 is formed of an elastic body, plastic or metallic material, and another hole communicating with the third hole 171 formed in the seating portion 172 and the convex portion 173 may be formed inside the O-ring 174.

However, the fluid connector 17 is not necessarily limited thereto, and may be changed into various forms to thereby be applied.

In addition, the modular fluid chip 1 according to the first embodiment of the present disclosure may further include the coupling unit 122.

Referring to FIGS. 1 and 3, the coupling unit 122 may be configured to couple the modular fluid chip 1 to other modular fluid chips 2 in horizontal directions (the X-axis direction and Y-axis direction).

More specifically, the coupling unit 122 is received in the housing 12 or provided integrally with the housing 12 to thereby connect the modular fluid chip 1 to the other modular fluid chips 2 in the horizontal directions (the X-axis direction and Y-axis direction) and at the same time, may automatically align and fix the modular fluid chip 1 to the other modular fluid chips 2.

Thus, the plurality of modular fluid chips 1 and 2 connected to each other in the horizontal directions may implement one fluid flow system 1000 including a plurality of fluid flow sections and fluid analysis sections.

Here, the coupling unit 122 may include a material having magnetism.

Referring to FIGS. 1 and 3, the coupling unit 122 is formed of a magnetic body having an S-pole on one side thereof and an N-pole on the other side thereof, and may be installed on the inside of the housing 12. Through this, the modular fluid chip 1 connected to the other modular fluid chip 2 can maintain a state in which it is in surface-contact with the other modular fluid chip 2.

Figure 9:
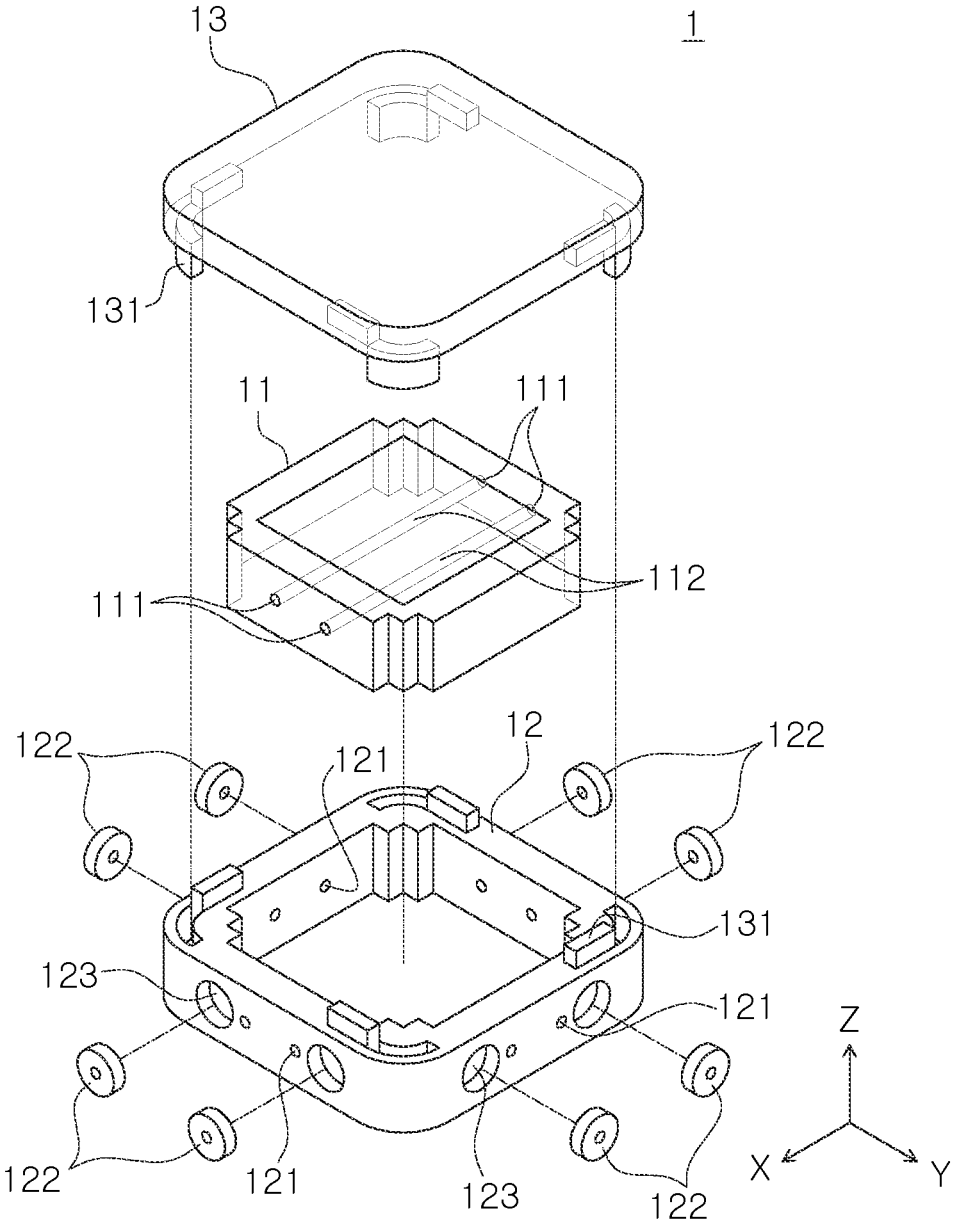
FIGS. 9 to 10 are exploded perspective views each illustrating a modified embodiment of a coupling unit having magnetism in the modular fluid chip according to an embodiment of the present disclosure.
Figure 10:
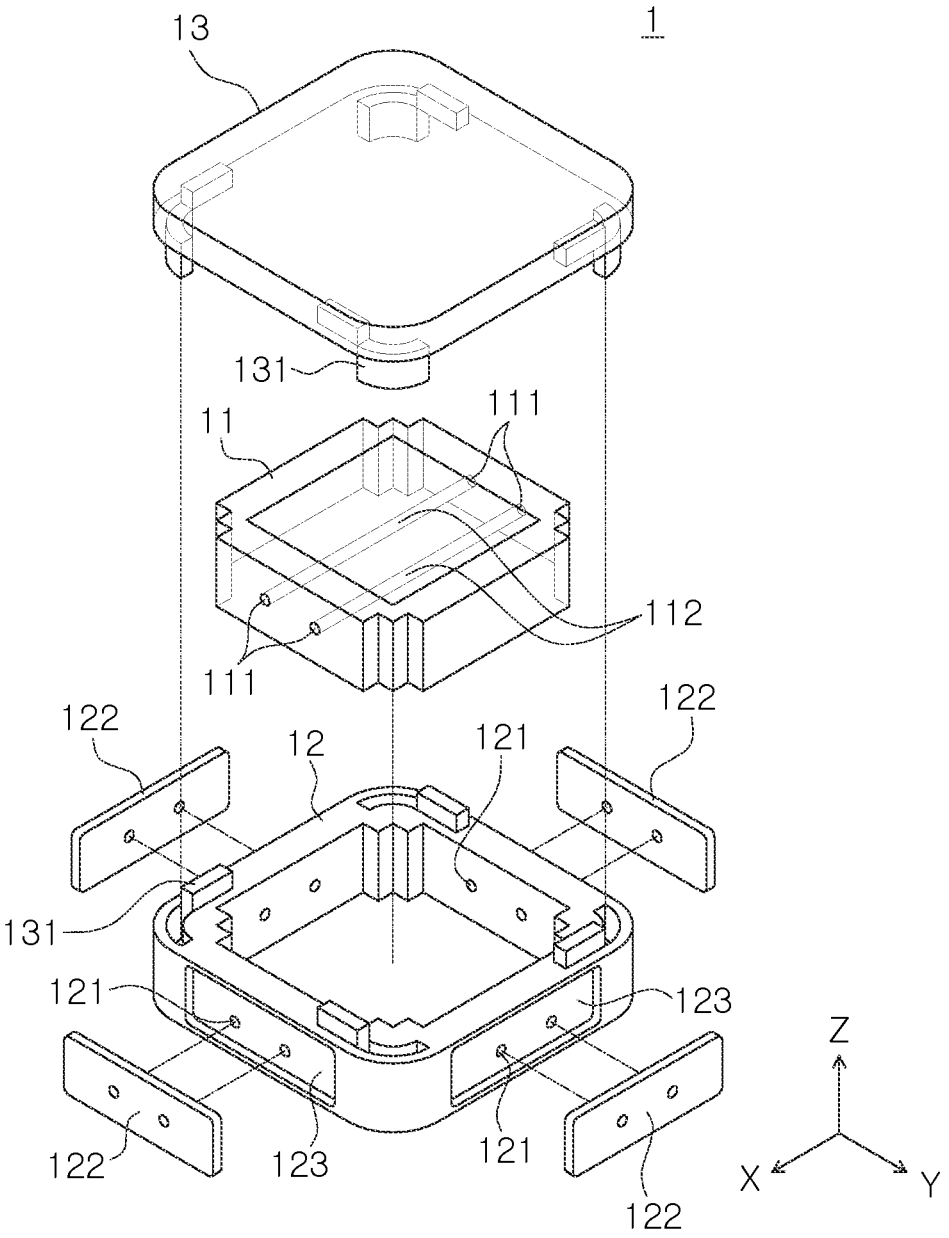

Further, referring to FIGS. 9 and 10, the coupling unit 122 may be installed on the outside of the housing 12. In this case, the seating groove 123 in which the coupling unit 122 can be seated may be formed in the outer surface of the housing 12. Accordingly, the coupling unit 122 installed on the outside of the housing 12 can further maximize binding force between the modular fluid chip 1 and the other modular fluid chip 2.

However, the coupling unit 122 is not limited thereto, and may be changed into various structures. For example, the coupling unit 122 may be provided on both the inside and the outside of the housing 12 and may be formed in a form capable of changing a direction of polarity as necessary. In addition, the coupling unit 122 may include not only a magnetic body such as a permanent magnet but may also include at least one of various magnetic materials capable of implementing the same function as the magnetic body.

In addition, referring to FIGS. 3 and 9, when the coupling unit 122 installed on the housing 12 is connected to the other modular fluid chip 2, the coupling unit 122 may be disposed in a position where it has the same central axis as the second hole 121 of the modular fluid chip 1 in such a manner that the second hole of the other modular fluid chip 2 and the second hole 121 of the modular fluid chip 1 may be arranged with and communicate with each other. Here, the housing 12 may be provided with the seating groove 123 in which the coupling unit 122 may be seated. In addition, the coupling unit 122 received in the seating groove 123 may be exposed to the outside of the housing 12 and may be formed in a shape corresponding to the seating groove 123 so as not to interfere with other components.

In addition, the coupling unit 122 provided in the modular fluid chip 1 may be formed in a structure capable of being directly connected to the coupling unit 122 provided in the other modular fluid chip 2.

Figure 16:
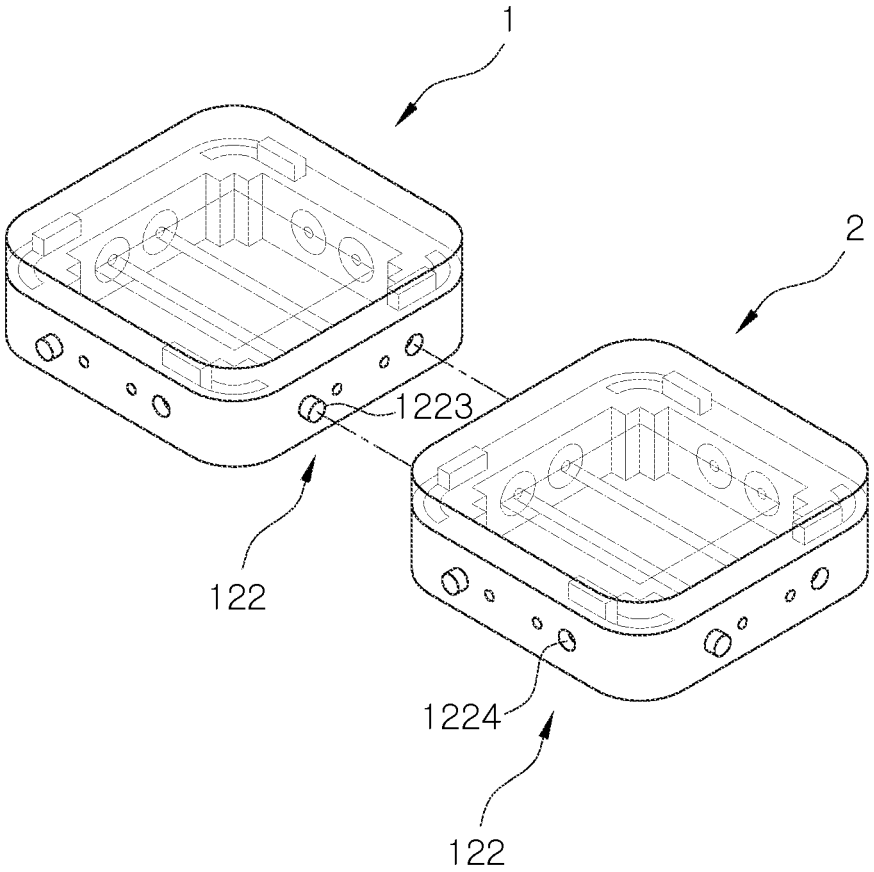
FIGS. 16 to 20 are views each schematically illustrating a state in which a coupling structure capable of being physically coupled to the modular fluid chips according to an embodiment of the present disclosure is applied.

Referring to FIG. 16, the coupling unit 122 provided in the modular fluid chip 1 and the coupling unit 122 of the other modular fluid chip 2 corresponding thereto may include a convex portion 1223 or a concave portion 1224 corresponding to each other. For example, the convex portion 1223 and the concave portion 1224 may be formed in a convexo-concave shape in which they correspond to each other. In addition, the convex portion 1223 and the concave portion 1224 may be formed in a cylindrical or polygonal column shape to prevent separation or movement of each modular fluid chip when they are coupled to each other.

Referring to FIGS. 17 to 20, the coupling unit 122 provided in the modular fluid chip 1 may include a fastening portion 1225 which can be connected to the other modular fluid chip 2.

Figure 17:
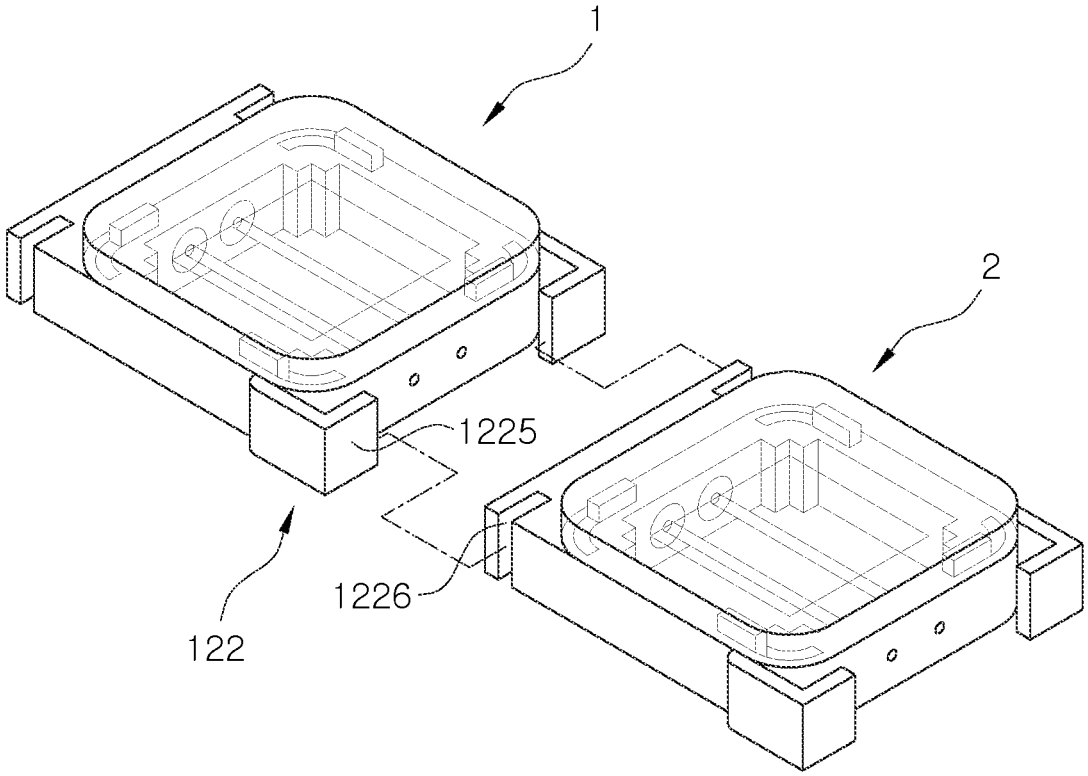

Referring to FIG. 17, the coupling unit 122 provided in the modular fluid chip 1 may include the fastening portion 1225 having a hook shape at an end thereof to thereby be coupled with the other modular fluid chip 2. In this case, a fastening groove 1226 corresponding to the fastening portion 1225 provided in the modular fluid chip 1 may be formed in the other modular fluid chip 2.

Figure 18:
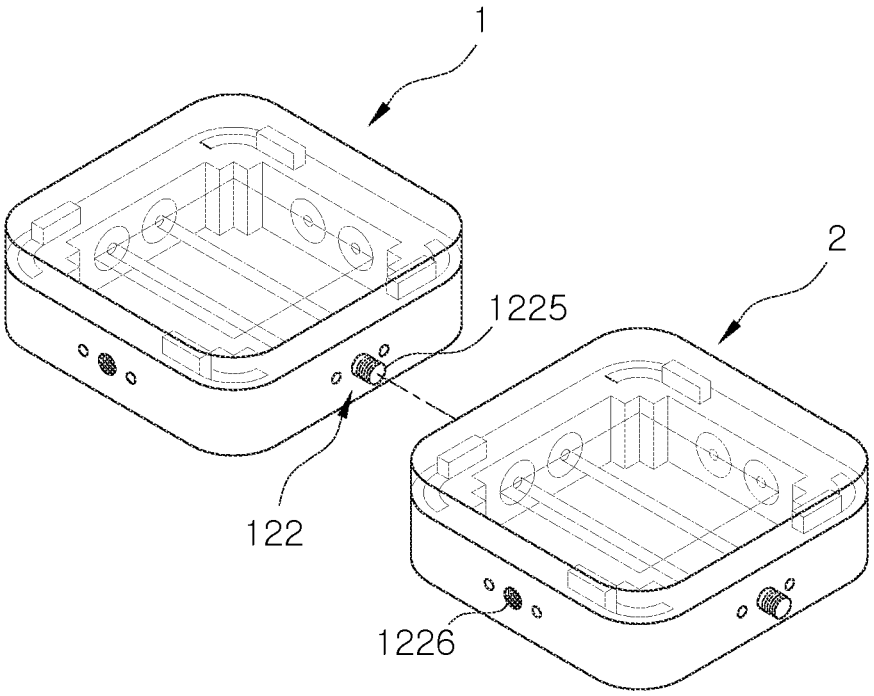

Referring to FIG. 18, the coupling unit 122 provided in the modular fluid chip 1 may include the fastening portion 1225 having a bolt shape with a thread on an outer circumferential surface thereof to thereby be coupled with the other modular fluid chip 2. In this case, the fastening groove 1226 corresponding to the fastening portion 1225 provided in the modular fluid chip 1 may be formed in the other modular fluid chip 2.

Figure 19:
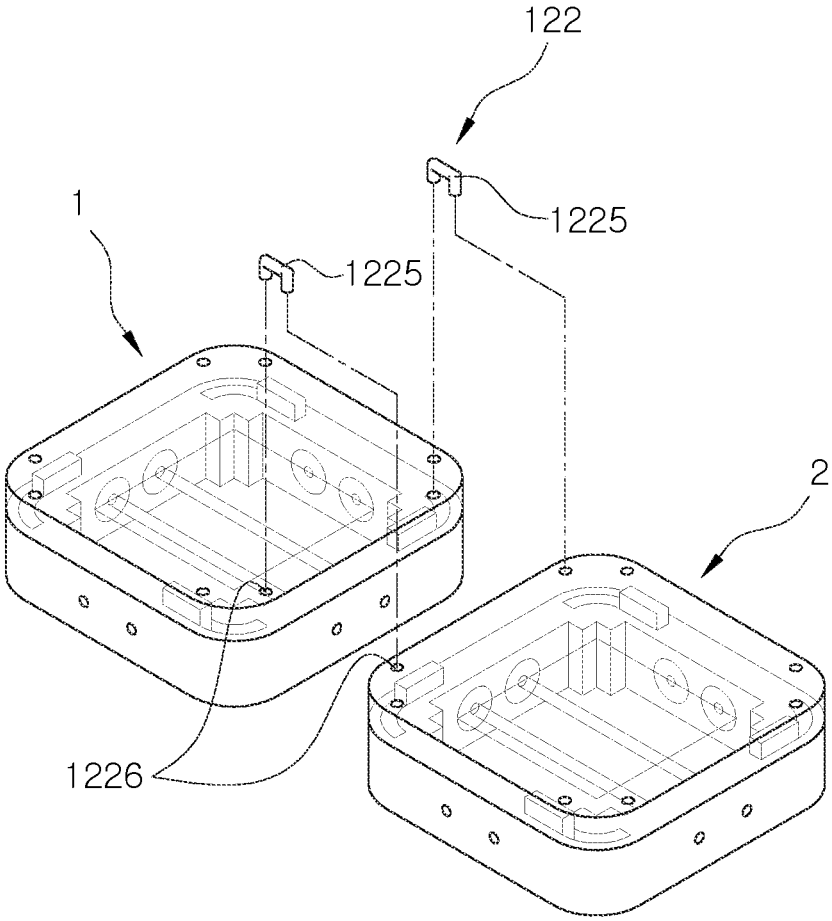

Referring to FIG. 19, the coupling unit 122 provided in the modular fluid chip 1 may include the fastening portion 1225 having a '∩' shape in the form of a pin to thereby be coupled with the other modular fluid chip 2. In this case, the fastening groove 1226 in which the fastening portion 1225 in the form of a pin can be inserted may be formed in the modular fluid chip 1 and the other modular fluid chip 2.

Figure 20:
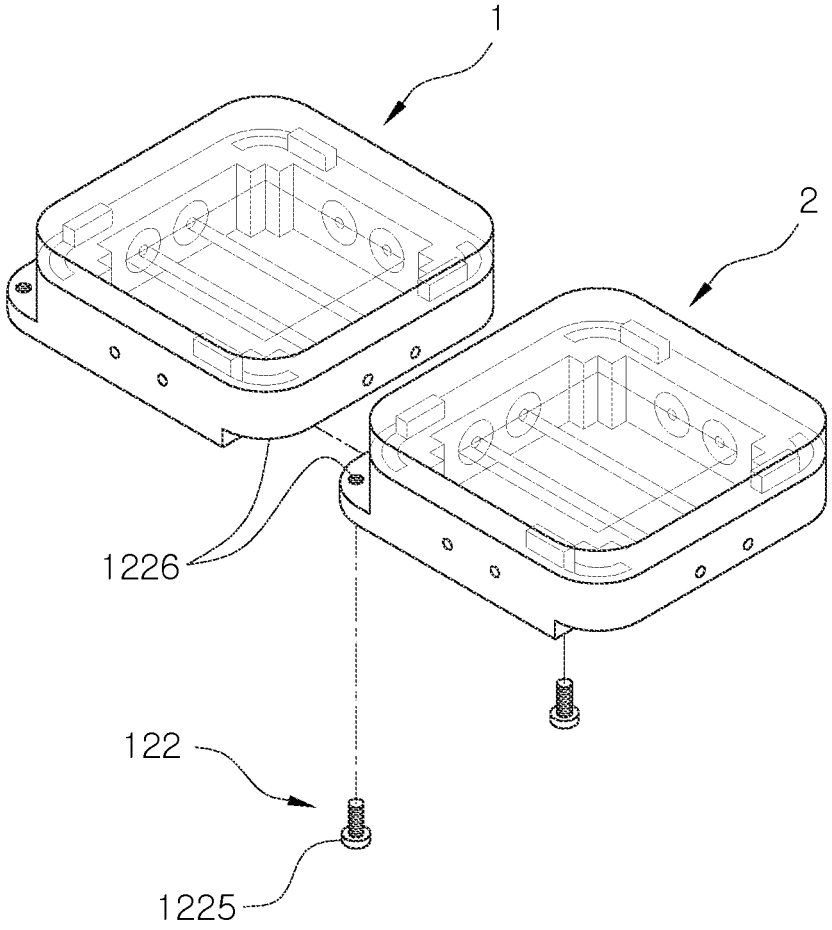

Referring to FIG. 20, the coupling unit 122 provided in the modular fluid chip 1 may be coupled to the other modular fluid chip 2 through the bolt-shaped fastening portion 1225. In this case, the fastening groove 1226 in which the bolt-shaped fastening portion 1225 can be fastened may be formed in the modular fluid chip 1 and the other modular fluid chip 2.

In addition, the modular fluid chip 1 according to the first embodiment of the present disclosure may further include a cover 13.

Referring to FIGS. 2 and 3, the cover 13 may be configured to be coupled to at least one of upper and lower portions of the housing 12 in the vertical direction (the Z-axis direction) and protect the body 11.

The cover 13 may be formed in a shape corresponding to the housing 12, and may be formed of a transparent material so that the body 11 can be seen from the outside when the cover 13 is coupled to the housing 12. Further, an optical or electrical cable (not shown) may be mounted on the inside of the cover 13 as necessary.

In addition, the cover 13 and the housing 12 may further include a fastening means 131 for mutual connection.

More specifically, the cover 13 and the housing 12 may each be provided with a coupling portion protruding outwardly from one surface thereof and an insertion groove in which the coupling portion provided at a relative position can be inserted. For example, the coupling portion formed in the cover 13 and the coupling portion formed in the housing 12 may be formed in the same shape or different shapes. However, the fastening means 131 provided on the cover 13 and the housing 12 are not limited thereto, and may be applied in various structures in which they are mutually fastened with each other.

Meanwhile, the modular fluid chip 1 may be connected to other modular fluid chips 2 in a vertical direction to implement one fluid flow system 1000.

Figure 11A:
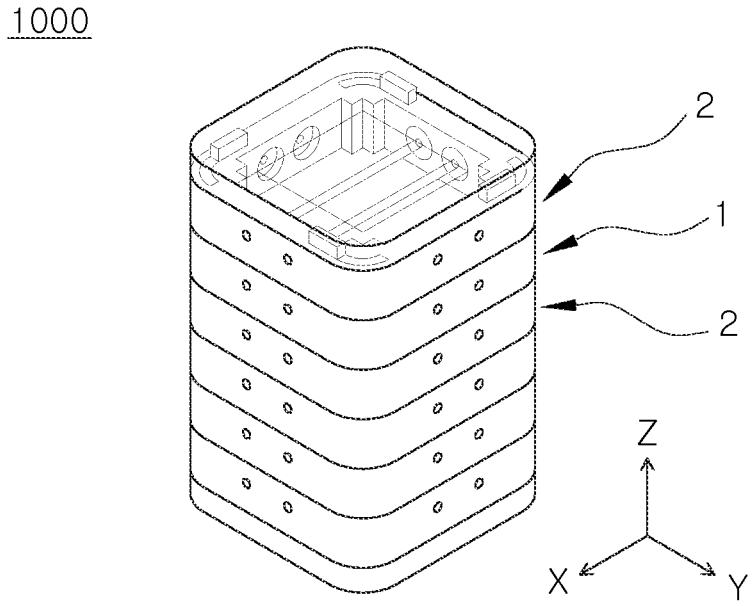
FIGS. 11A and 11B are perspective views each illustrating the fluid flow system in which the modular fluid chips are connected in a vertical direction according to an embodiment of the present disclosure.
Figure 11A:
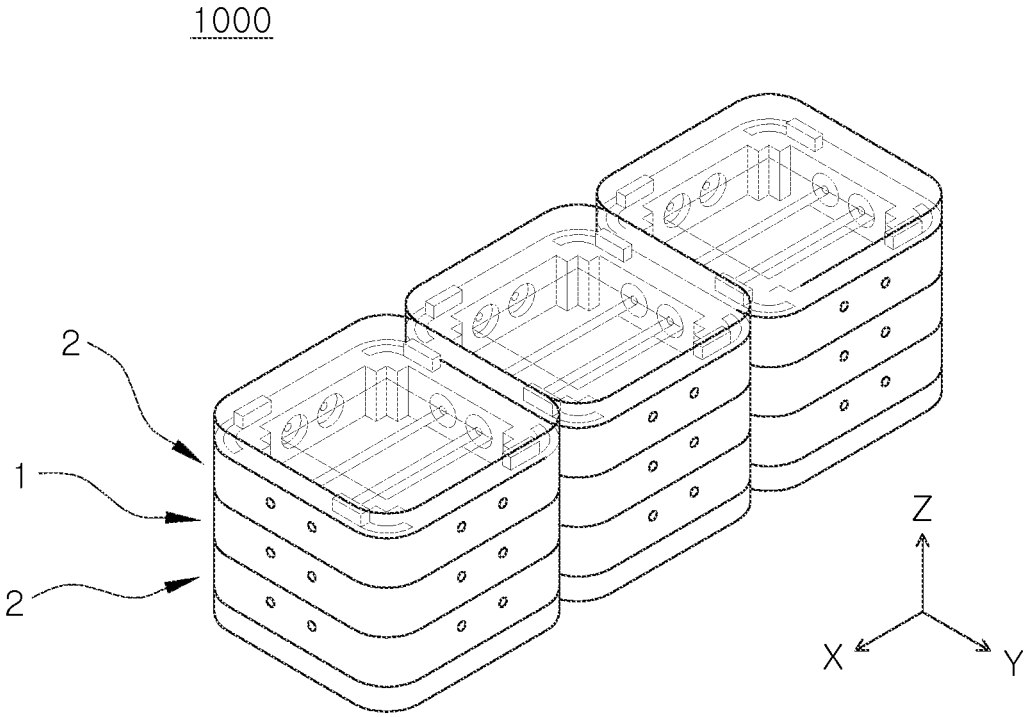

Referring to (a) of FIG. 11A, the modular fluid chip 1 may be connected to the other modular fluid chips 2 in the vertical direction (the Z-axis direction) to implement one fluid flow system 1000 including a plurality of fluid flow sections and fluid analysis sections. And, referring to (b) of FIG. 11A, the modular fluid chip 1 may be connected to the other modular fluid chips 2 in the horizontal direction (the X-axis direction) and vertical direction (the Z-axis direction) to implement another type of fluid flow system 1000. Here, the second hole 121 provided in the housing 12 of the modular fluid chip 1 may communicate with the second hole 121 provided in the housing 12 of the other modular fluid chip 2. Further, in (b) of FIG. 11A, the modular fluid chip 1 is shown to be connected to the other modular fluid chips 2 only in the X-axis direction. However, the modular fluid chip 1 may be connected to the other modular fluid chips 2 not only in the X-axis direction but also be connected to the other modular fluid chips 2 in the Y-axis direction or the X-axis direction.

That is, the modular fluid chip 1 is configured to be connected to other modular fluid chips 2 in the horizontal and vertical directions, thereby generating fluidic flow channels in various directions. For example, the number of a plurality of modular fluid chips 2 that are connected to each other in at least one direction of the horizontal direction and the vertical direction to thereby form the fluid flow system 1000 may be 1 to 10,000.

Meanwhile, referring to FIG. 11A, the modular fluid chip 1 connected to other modular fluid chips 2 in the vertical direction (the Z-axis direction) may be coupled to the other modular fluid chips 2 in a state in which the cover 13 is not coupled.

At this time, the second hole 121 provided in the housing 12 may be formed in a structure capable of guiding a flow of fluid to the second holes 121 provided in the other modular fluid chips 2 disposed on upper and lower sides of the modular fluid chip 1.

Figure 12A:
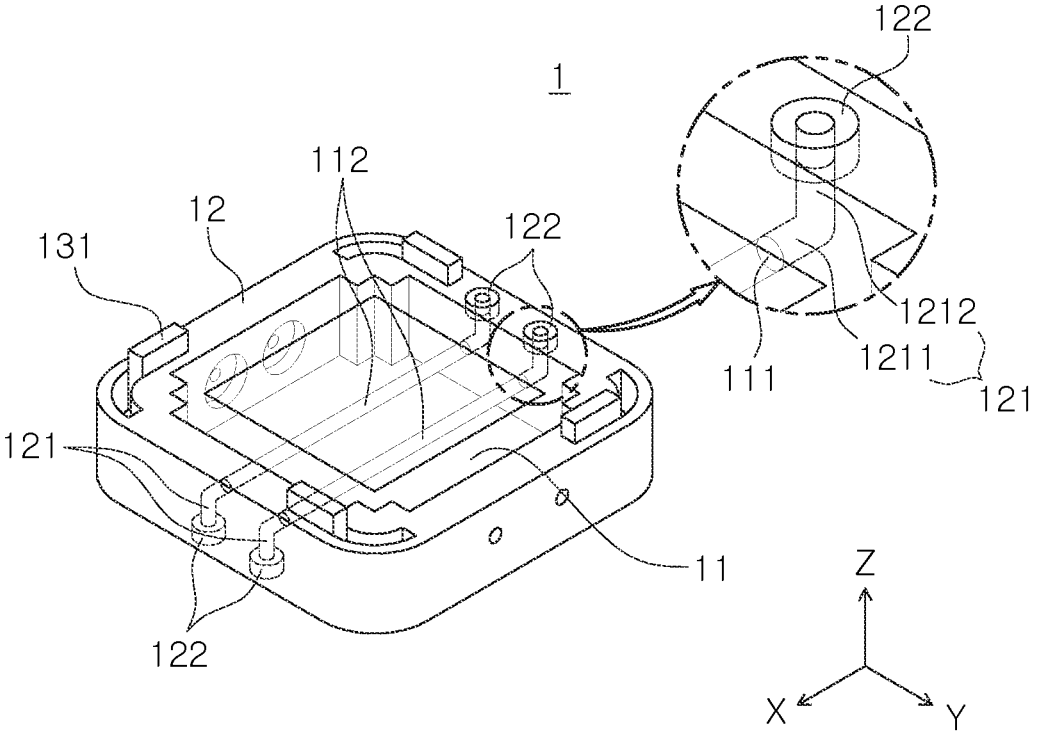
FIGS. 12A, 12B, 12C and 12D are perspective views each illustrating the modular fluid chip according to an embodiment of the present disclosure to which a vertical connection structure is applied.
Figure 13A:
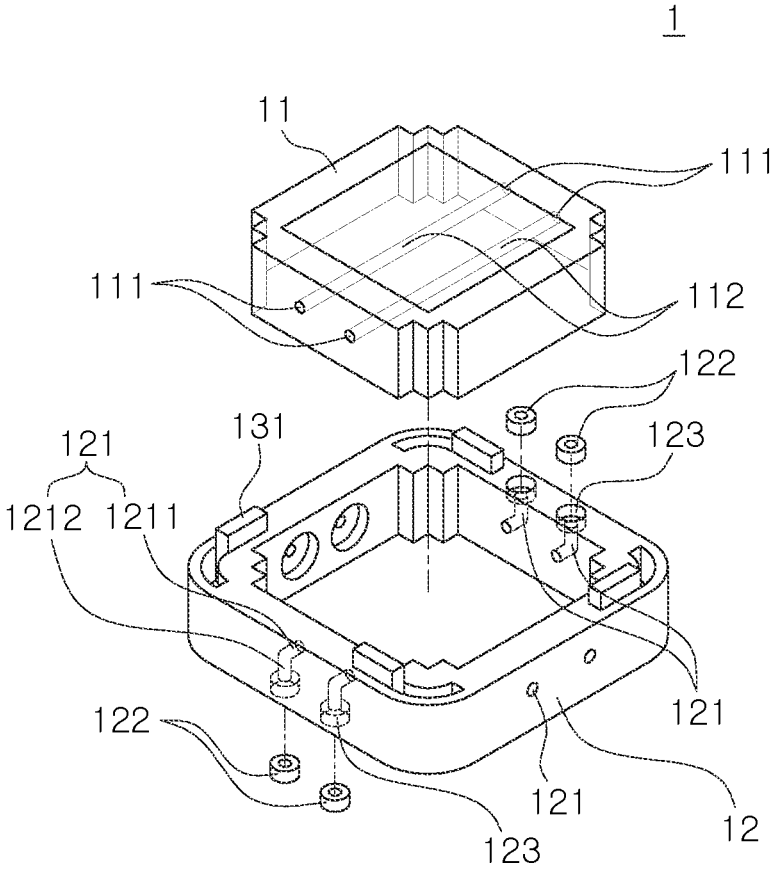
FIGS. 13A, 13B, 13C and 13D are exploded perspective views of FIGS. 12A, 12B, 12C and 12D.

Referring to FIGS. 12A and 13A, the modular fluid chip 1 connected to the other modular fluid chip 2 in the vertical direction (the Z-axis direction) is configured of the body 11 and the housing 12, and at least one second hole 121 formed in the housing 12 may include a horizontal portion 1211 which is in communication with the first hole 111 formed in the body 11 and disposed in parallel to the fluid channel 112, and vertical portions 1212 which is in communication with the horizontal portion 1211 and bent vertically in the housing 12 to communicate with an external space of the housing 12. Here, the housing 12 may include a plurality of coupling units 122 capable of connecting the other modular fluid chips 2 disposed on upper and lower sides of the housing 12 to the modular fluid chip 1. Each of the plurality of coupling units 122 may be formed of a magnetic body having an S-pole on one side thereof and an N-pole on the other side thereof, and may be installed in the seating grooves 123 provided in upper and lower surfaces of the housing 12. Further, the plurality of coupling units 122 may be provided with a through hole communicating with each vertical portion 1212 provided in the housing 12. The through hole is formed in a shape corresponding to the vertical portion 1212 and may have the same central axis as the vertical portion 1212.

Figure 15A:
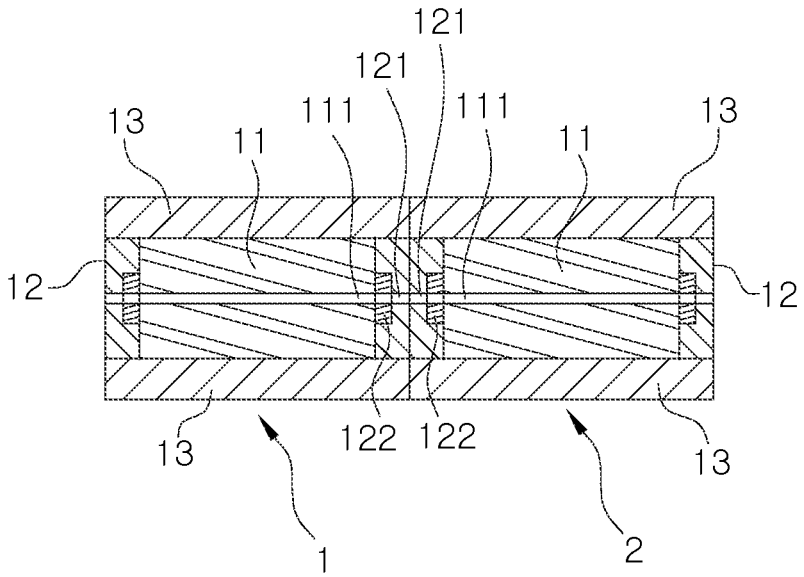
FIG. 15A is a schematic cross-sectional view illustrating a state in which the modular fluid chips are connected in a horizontal direction according to an embodiment of the present disclosure.
Figure 15B:
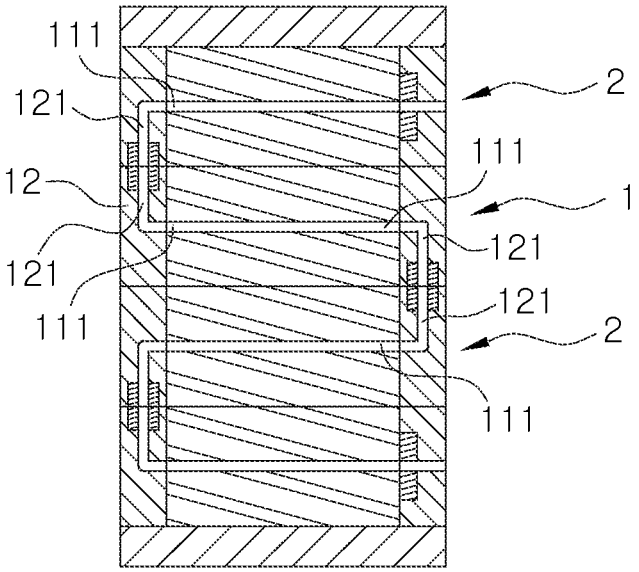
FIGS. 15B and 15C are schematic cross-sectional views illustrating a state in which the modular fluid chips are connected in a vertical direction.
Figure 15B:
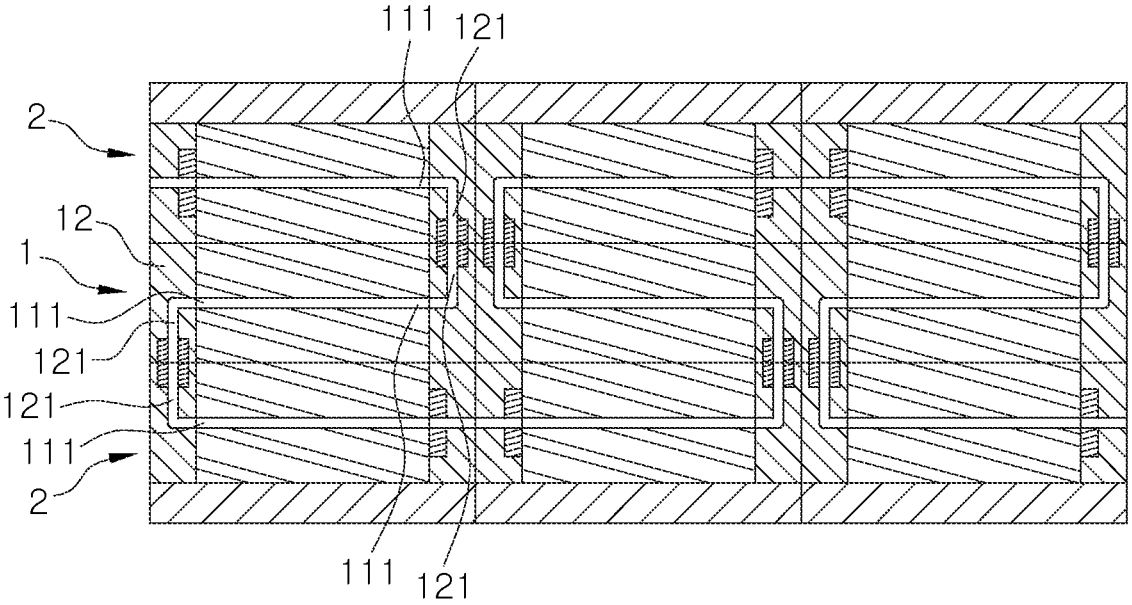

Therefore, as shown in FIGS. 15A and 15B, when the housing 12 of the modular fluid chip 1 and the other modular fluid chip 2 are connected in the horizontal or vertical direction, the first hole 111 and the second hole 121 provided in the modular fluid chip 1 may be aligned with and communicate with the first hole 111 and the second hole 121 provided in the other modular fluid chip 2.

In addition, the above-described modular fluid chip 1 may be formed in a structure capable of being connected to the other modular fluid chip 2 in a state in which the cover 13 is coupled to the housing 12.

Figure 12B:
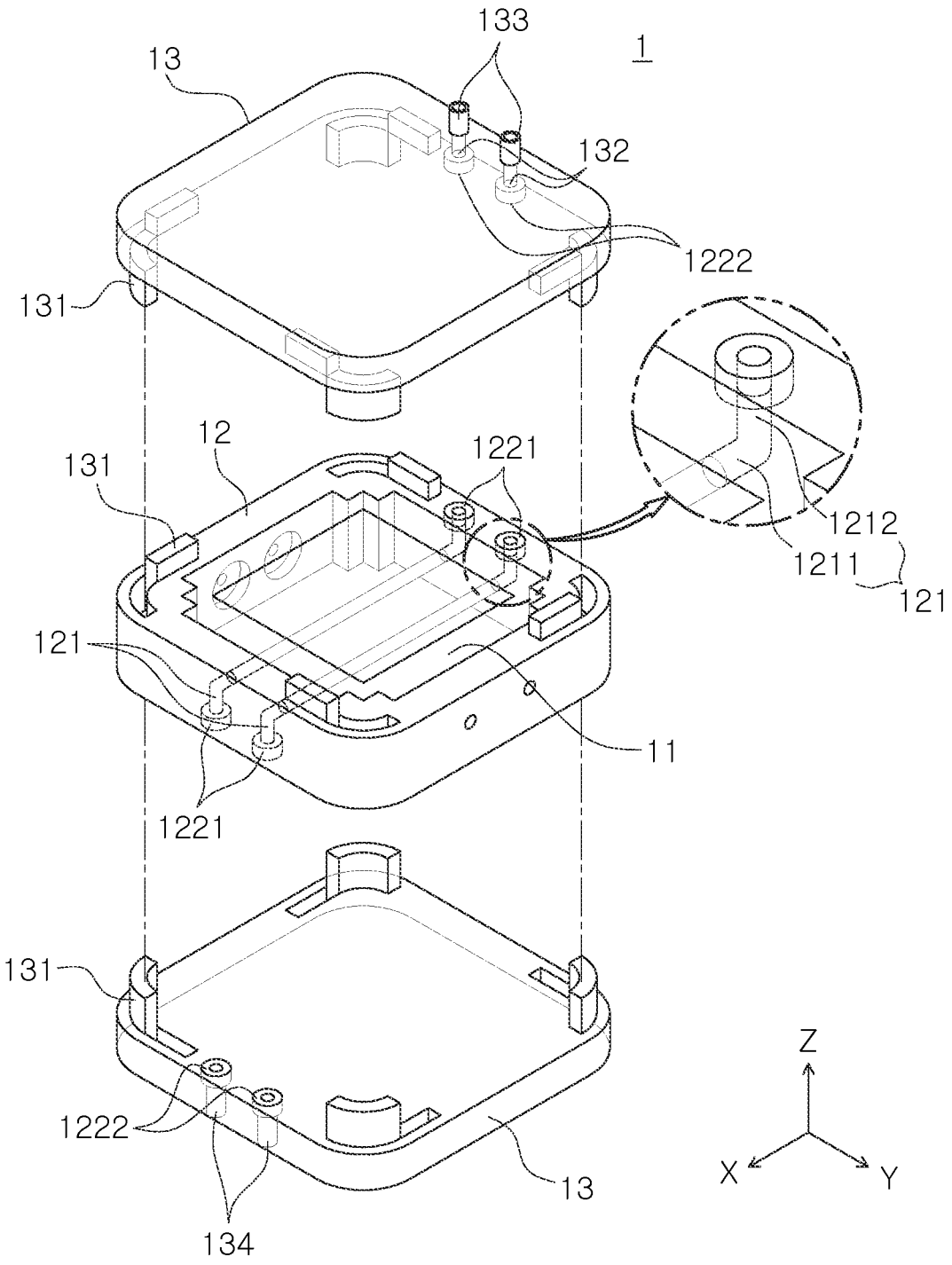
Figure 13B:
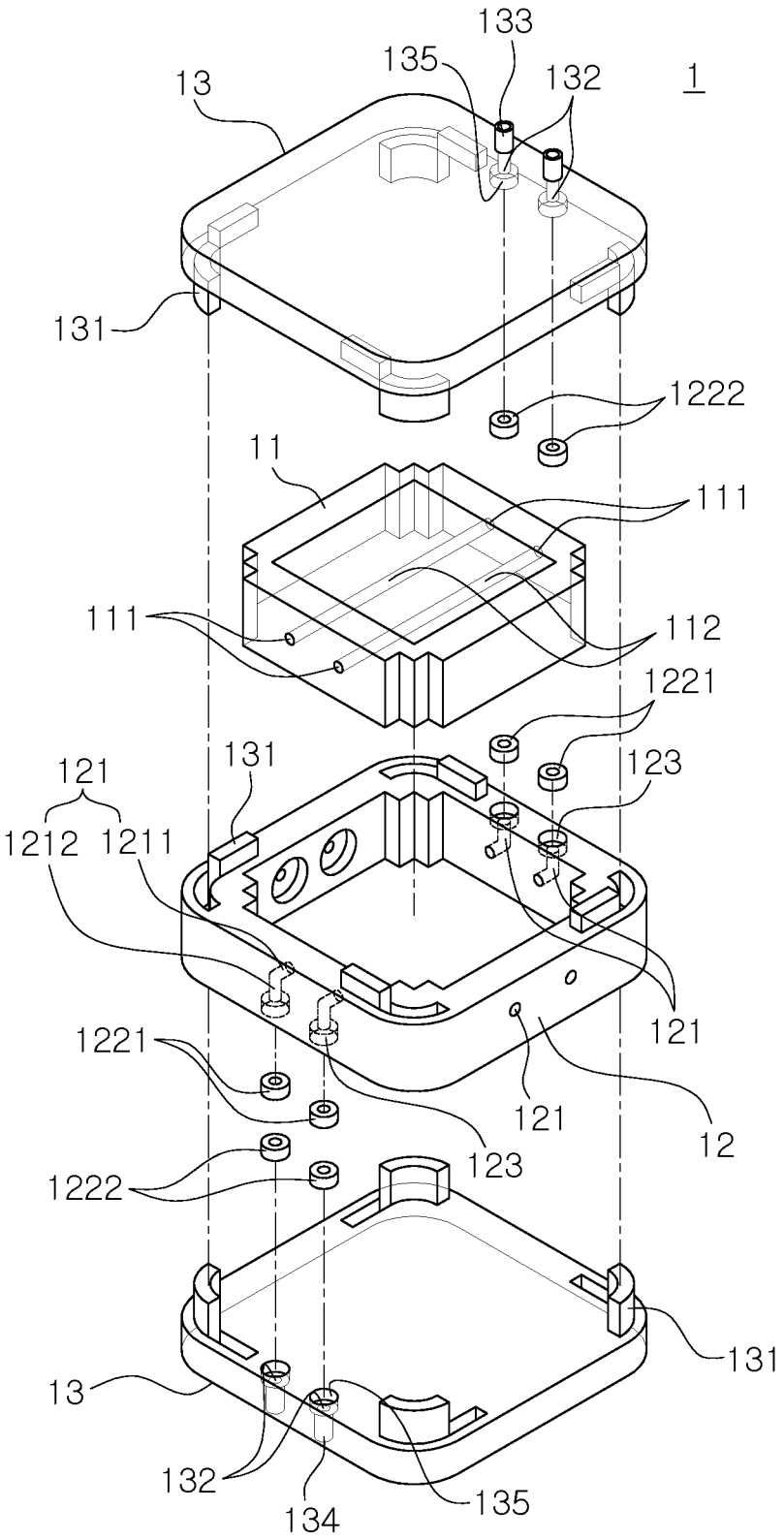

Referring to FIGS. 12B and 13B, the cover 13 may be provided with an extension hole 132 which is in communication with the vertical portion 1212 of the second hole 121 formed in the housing 12 and is in communication with the other modular fluid chip 2.

In addition, the housing 12 and the cover 13 may each include the plurality of coupling units 122 capable of connecting the other modular fluid chips 2 disposed on upper and lower sides of the modular fluid chip 1 to the modular fluid chip 1.

The plurality of coupling units 122 may be formed of a magnetic body having an S-pole on one side thereof and an N-pole on the other side thereof, and may be installed in the housing 12 and the cover 13.

More specifically, the plurality of coupling units 122 may include first magnetic portions 1221 installed in the upper and lower surfaces of the housing 12 and second magnetic portions 1222 installed in inner surfaces of the respective covers 13 coupled to the upper and lower sides of the housing 12. Here, one side of the second magnetic portion 1222 installed in the cover 13 may be connected to the first magnetic portion 1221 installed in the housing 12 by magnetism, and the other side of the second magnetic portion 1222 may be connected to the second magnetic portion 1222 installed in the cover 13 of the other modular fluid chip 2 by magnetism. And, the housing 12 and the cover 13 may be provided with the seating groove 123 in which the first magnetic portion 1221 and the second magnetic portion 1222 are received.

In addition, a through hole communicating with the vertical portion 1212 provided in the housing 12 may be formed in the first magnetic portion 1221. The through hole formed in the first magnetic portion 1221 is formed in a shape corresponding to the vertical portion 1212 and may have the same central axis as the vertical portion 1212. In addition, a through hole communicating with the extension hole 132 provided in the cover 13 may be formed in the second magnetic portion 1222. The through hole formed in the second magnetic portion 1222 is formed in a shape corresponding to the extension hole 132 and may have the same central axis as the extension hole 132.

In addition, the cover 13 coupled to the upper side of the housing 12 and the cover 13 coupled to the lower side of the housing 12 may further include coupling structures capable of being coupled with the other modular fluid chips 2 connected to upper and lower sides of the modular fluid chip 1.

More specifically, the cover 13 disposed on the upper side of the housing 12 may be provided with a protrusion 133 capable of being coupled with a groove 134 provided in the other modular fluid chip 2, and the cover 13 disposed on the lower side of the housing 120 may be provided with the groove 134 capable of being coupled with the protrusion 133 provided in the other modular fluid chip 2. For example, the protrusion 133 and the groove 134 may be formed in a shape in which they correspond to each other.

Figure 14A:
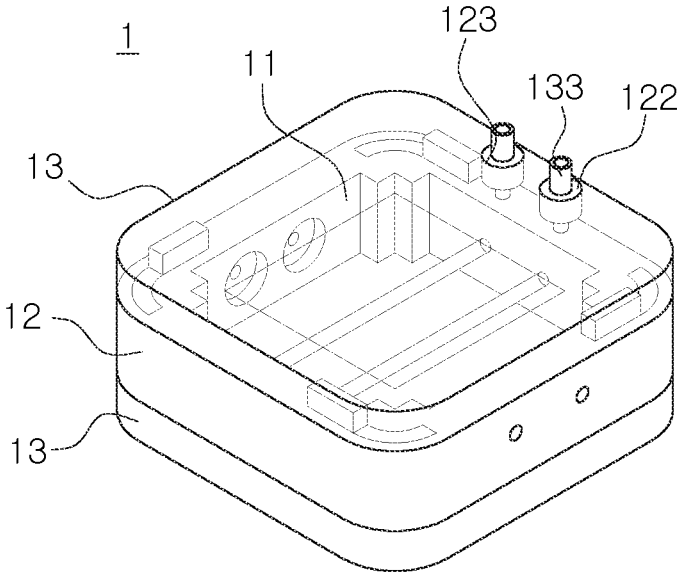
FIG. 14A is a perspective view illustrating a state in which the coupling unit having magnetism is installed on an outside of the cover in FIG. 12B.
Figure 14A:
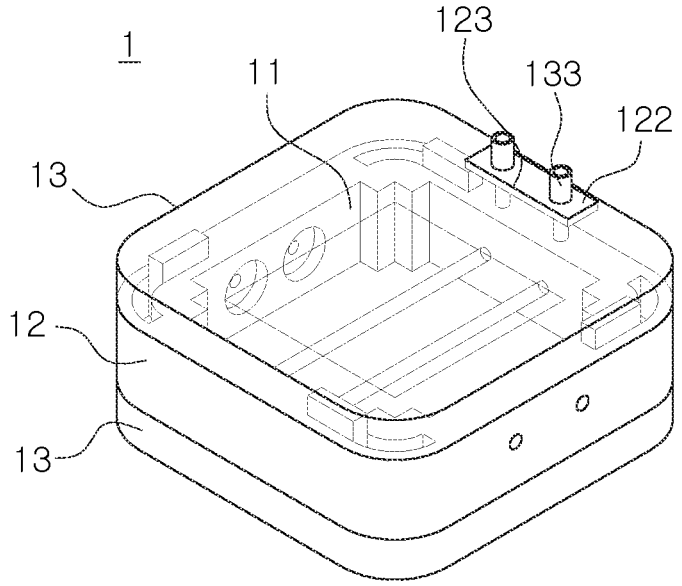

Referring to FIG. 14A, the coupling unit 122 in the form of a magnetic body may be installed on an outside of the cover 13 in order to further maximize the bonding force between the modular fluid chip 1 and the other modular fluid chip 2.

Here, the coupling unit 122 in the form of a magnetic body may be formed in a tablet shape as shown in (a) of FIG. 14A or formed in a panel shape as shown in (b) of FIG. 14A, and may be installed on an outer surface of the cover 13. In this case, the seating groove 123 in which the coupling unit 122 can be seated may be formed in the outer surface of the cover 13.

Figure 11B:
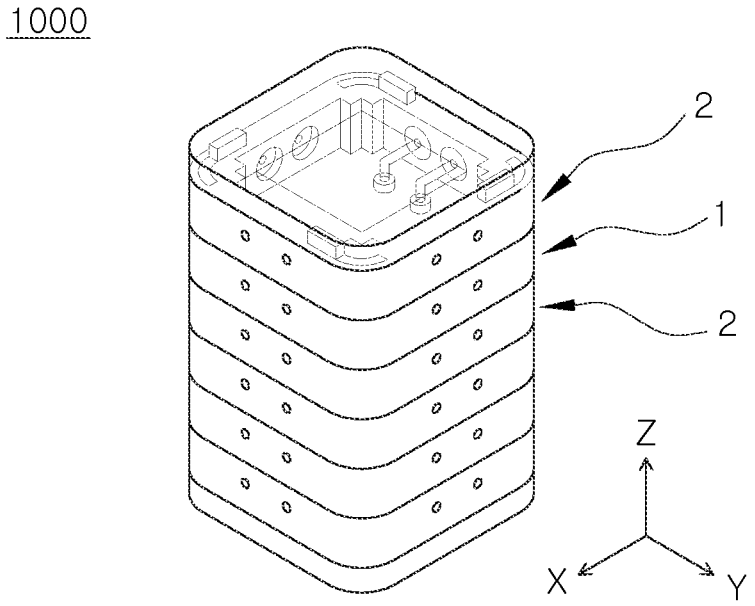
Figure 11B:
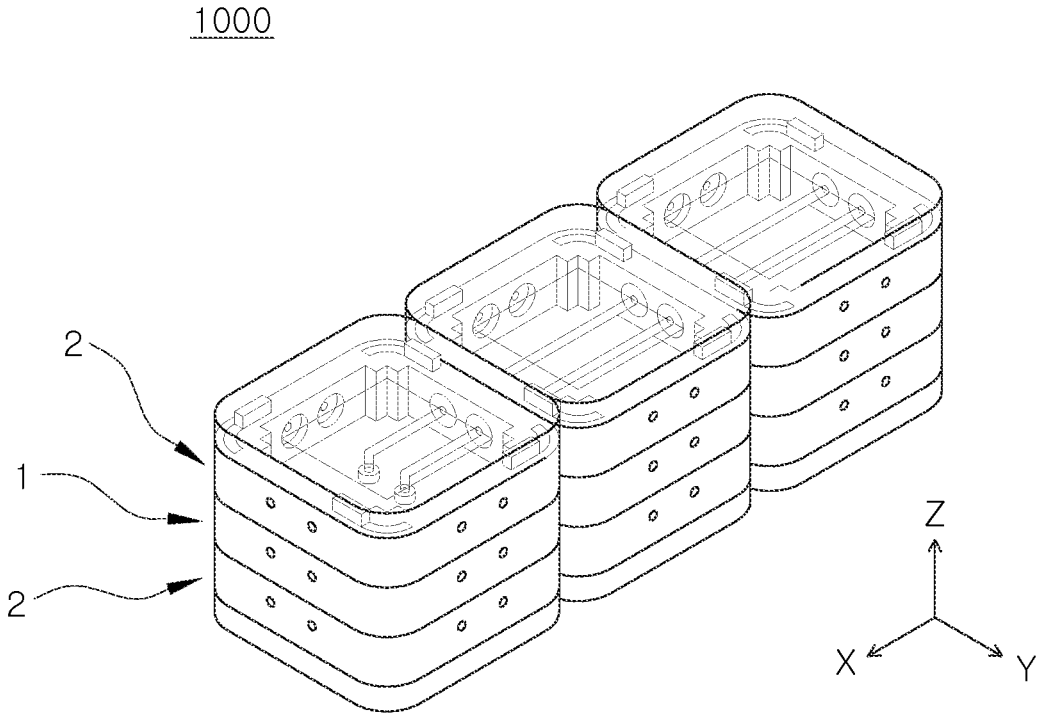

Meanwhile, referring to FIG. 11B, the modular fluid chip 1 connected to the other modular fluid chips 2 in the vertical direction (the Z-axis direction) may be formed in a structure in which the fluid channel 112 formed in the body 11 can guide a flow of fluid to the fluid channels 112 of the other modular fluid chips 2 disposed on the upper and lower sides of the modular fluid chip 1.

Figure 12C:
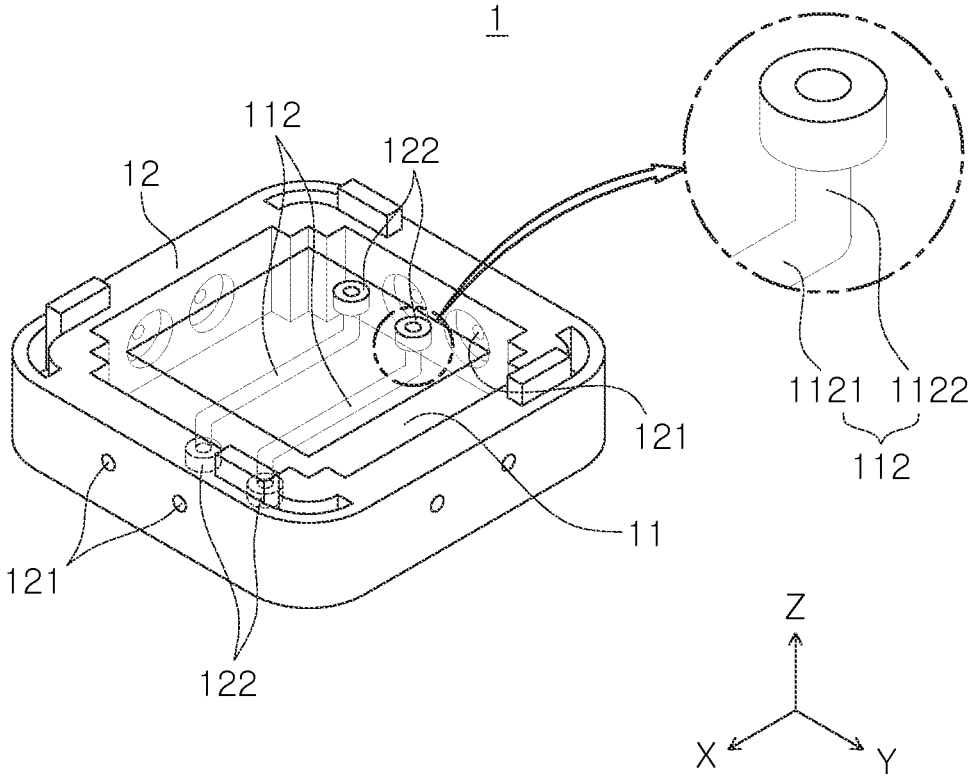
Figure 13C:
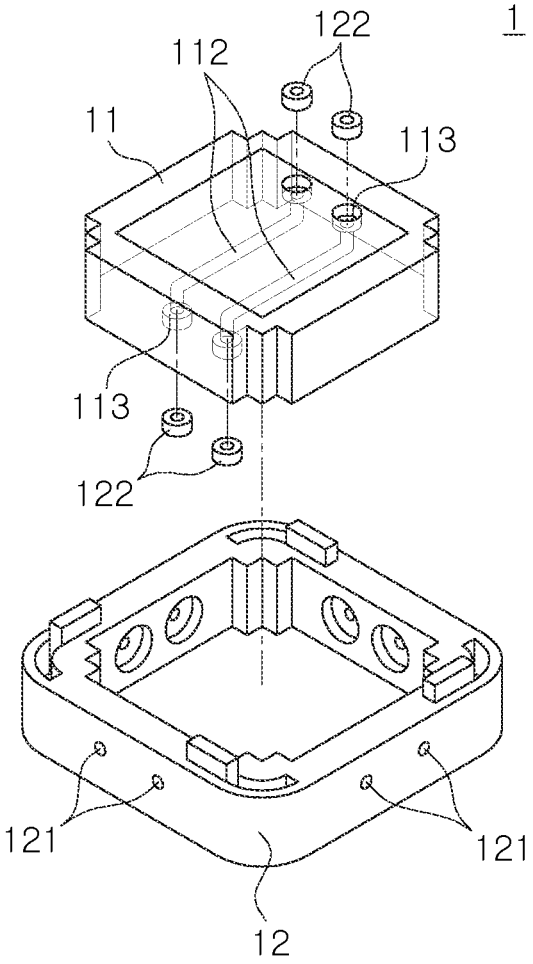

Referring to FIGS. 12C and 13C, the modular fluid chip 1 connected to the other modular fluid chips 2 in the vertical direction (the Z-axis direction) is configured of the body 11 and the housing 12, and the fluid channel 112 formed in the body 11 may include a horizontal portion 1121 which is disposed in parallel to the second hole 121 formed in the housing 12, and vertical portions 1122 which are in communication with one end and the other end of the horizontal portion 1121 and which are bent from horizontal portion 1121 upwardly and downwardly in the vertical direction to thereby communicate with an external space. Here, the body 11 may include the plurality of coupling units 122 capable of connecting the other modular fluid chips 2 disposed on the upper and lower sides of the housing 12 to the modular fluid chip 1. Each of the plurality of coupling units 122 may be formed of a magnetic body having an S-pole on one side thereof and an N-pole on the other side thereof, and may be installed in seating grooves 113 provided in upper and lower surfaces of the body 11. Further, the plurality of coupling units 122 may be provided with a through hole communicating with each vertical portion 1122 provided in the body 11. The through hole is formed in a shape corresponding to the vertical portion 1122 and may have the same central axis as the vertical portion 1122.

Figure 15C:
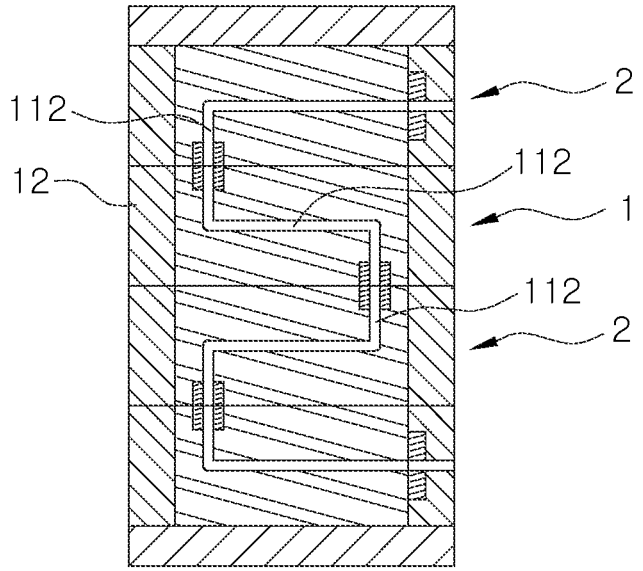
Figure 15C:
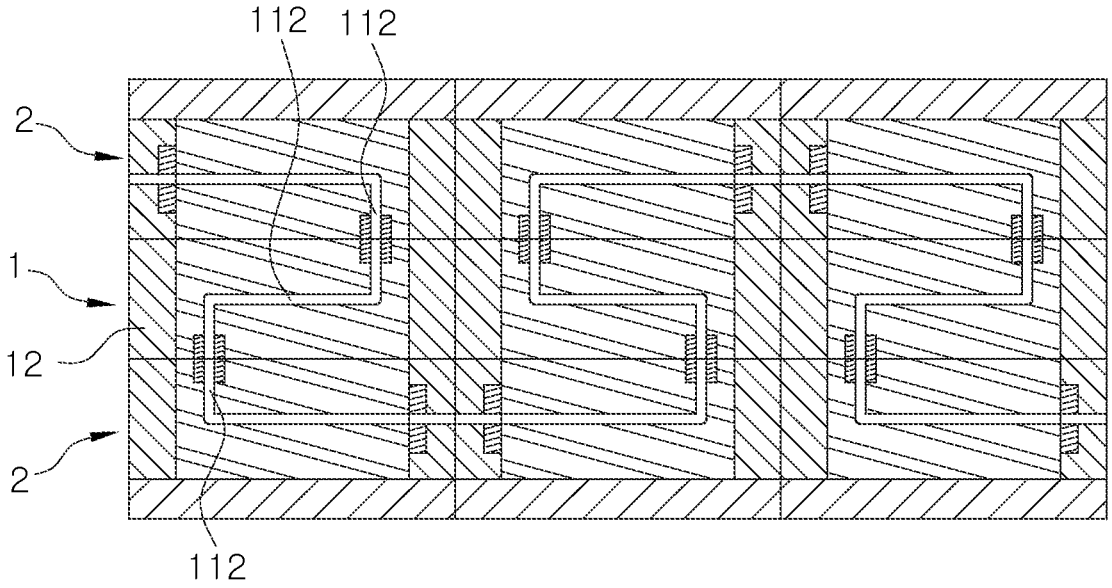

Therefore, as shown in FIG. 15C, when the housing 12 of the modular fluid chip 1 and the other modular fluid chip 2 are connected in the horizontal or vertical direction, the fluid channel 112 provided in the body 11 of the modular fluid chip 1 may be aligned with and communicate with the fluid channel 112 provided in the other modular fluid chip 2.

In addition, the above-described modular fluid chip 1 may be formed in a structure capable of being connected to the other modular fluid chip 2 in a state in which the cover 13 is coupled to the housing 12.

Figure 12D:
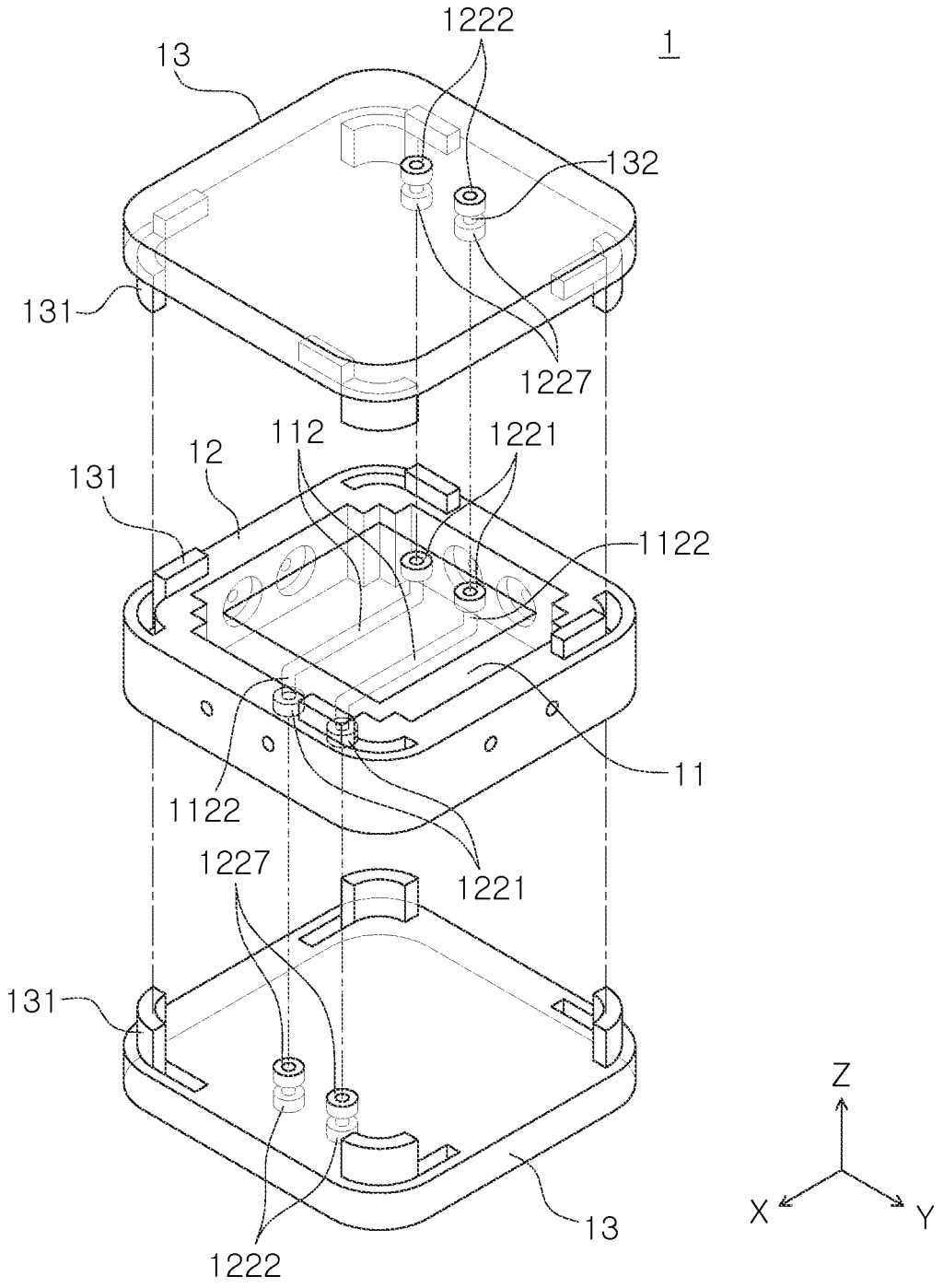
Figure 13D:
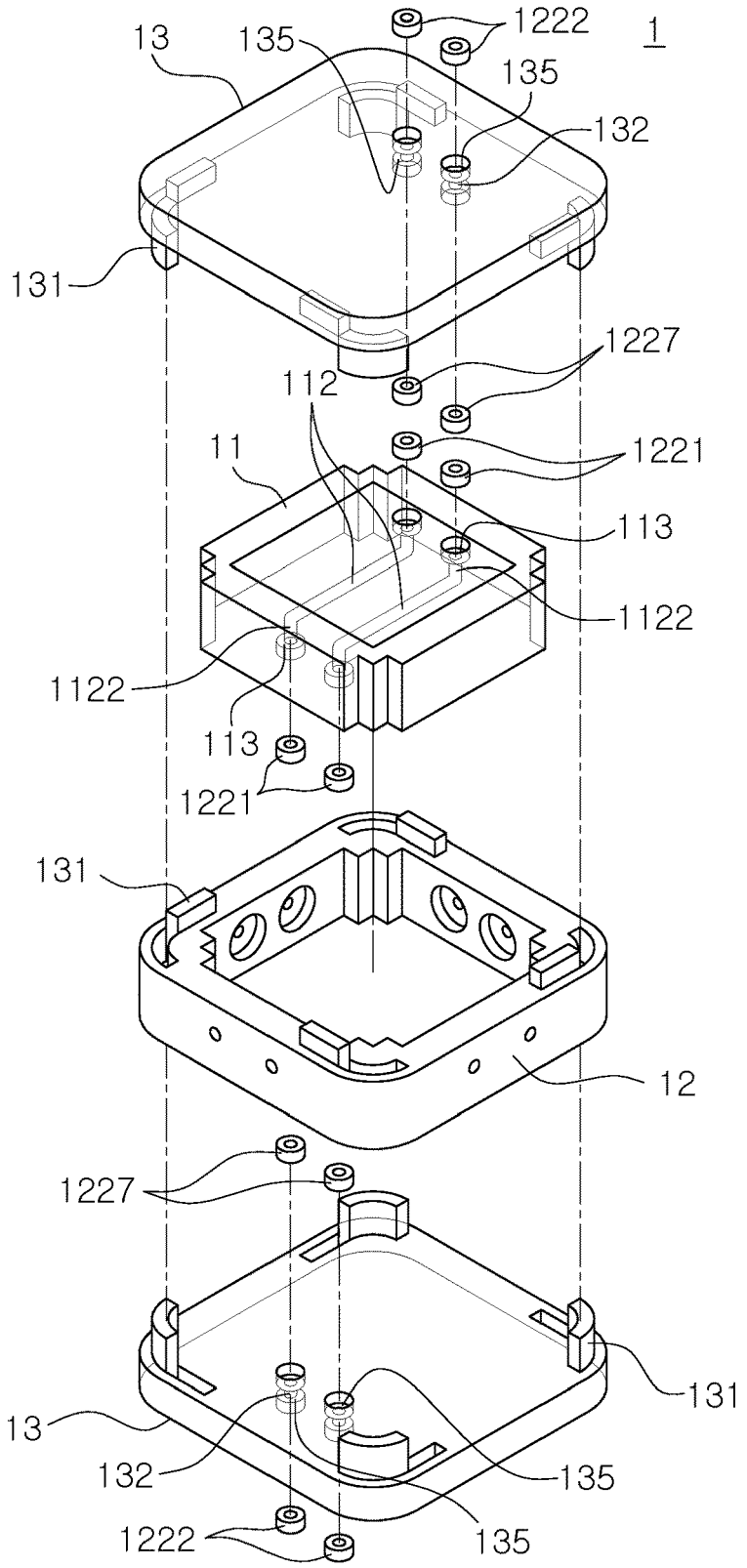

Referring to FIGS. 12D and 13D, the cover 13 may be provided with the extension hole 132 which is in communication with the vertical portion 1122 of the fluid channel 112 provided in the body 11 and is in communication with the other modular fluid chip 2.

In addition, the body 11 and the cover 13 may each include the plurality of coupling units 122 capable of connecting the other modular fluid chips 2 disposed on the upper and lower sides of the modular fluid chip 1 to the modular fluid chip 1.

The plurality of coupling units 122 may be formed of a magnetic body having an S-pole on one side thereof and an N-pole on the other side thereof, and may be installed in the body 11 and the cover 13.

More specifically, the plurality of coupling units 122 may include the first magnetic portions 1221 installed in upper and lower surfaces of the body 11, the second magnetic portions 1222 installed in outer surfaces of the respective covers 13, and third magnetic portions 1227 installed in the inner surfaces of the respective covers 13. Here, the third magnetic portion 1227 installed in the inner surface of the cover 13 may be connected to the first magnetic portion 1221 installed in the body 11 by magnetism, and the second magnetic portion 1222 installed in the outer surface of the cover 13 may be connected to the second magnetic portion 1222 installed in the cover 13 of the other modular fluid chip 2 by magnetism. Further, the body 11 may be provided with the seating groove 113 in which the first magnetic portion 1221 can be seated, and the cover 13 may be provided with a seating groove 135 in which the second magnetic portion 1222 and the third magnetic portion 1227 can be seated.

In addition, a through hole communicating with the vertical portion 1122 of the fluid channel 112 provided in the body 11 may be formed in the first magnetic portion 1221. The through hole formed in the first magnetic portion 1221 is formed in a shape corresponding to the vertical portion 1122 and may have the same central axis as the vertical portion 1122. In addition, a through hole communicating with the extension hole 132 provided in the cover 13 may be formed in the second magnetic portion 1222 and the third magnetic portion 1227. The through hole formed in the second magnetic portion 1222 and the third magnetic portion 1227 may be formed in a shape corresponding to the extension hole 132 and may have the same central axis as the extension hole 132.

Figure 14B:
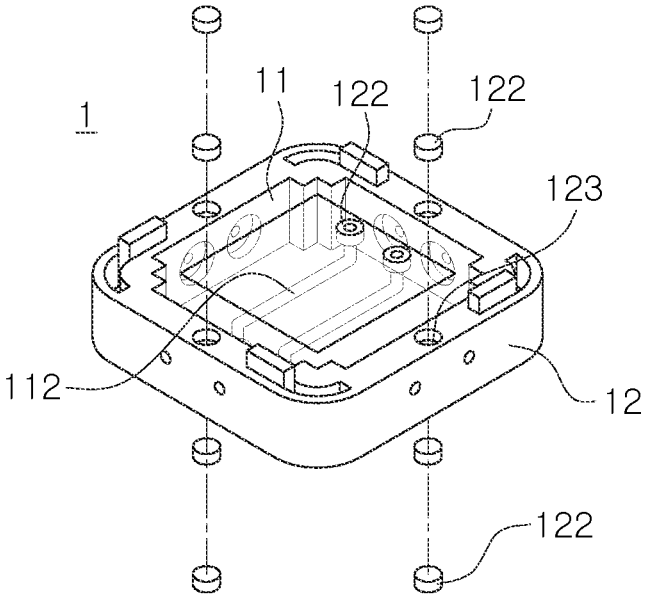
FIG. 14B is a perspective view illustrating a state in which the coupling unit having magnetism is further installed in the housing in FIG. 12C.
Figure 14B:
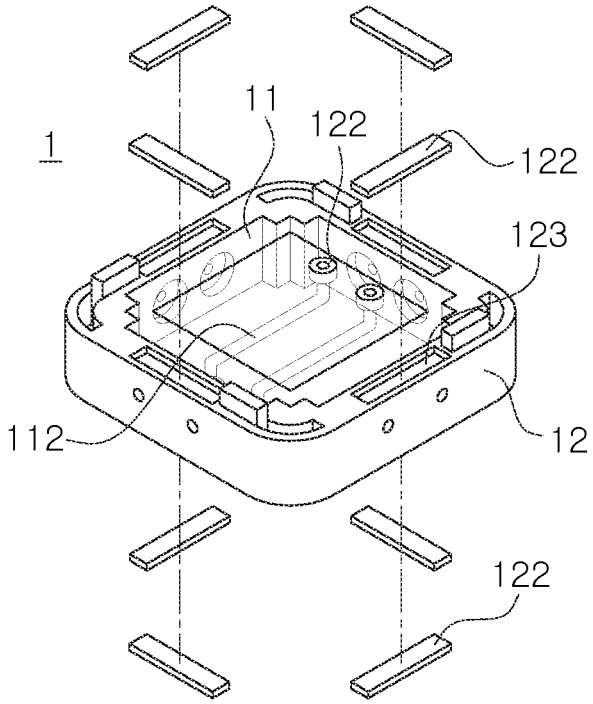

Referring to FIG. 14B, to further maximize the bonding force between the modular fluid chip 1 and other modular fluid chips 2, the coupling units 122 in the form of a magnetic body may be further installed in the upper and lower surfaces of the housing 12.

Here, the coupling unit 122 in the form of a magnetic body may be formed in a tablet shape as shown in (a) of FIG. 14B or formed in a panel shape as shown in (b) of FIG. 14B, and may be installed in the upper and lower surfaces of the housing 12. In this case, the seating groove 123 in which the coupling unit 122 can be seated may be formed in the upper and lower surfaces of the housing 12.

Moreover, the modular fluid chip 1 according to the first embodiment of the present disclosure may further include an imaging part 14, a light source 15, and a temperature controller 16.

Figure 21:
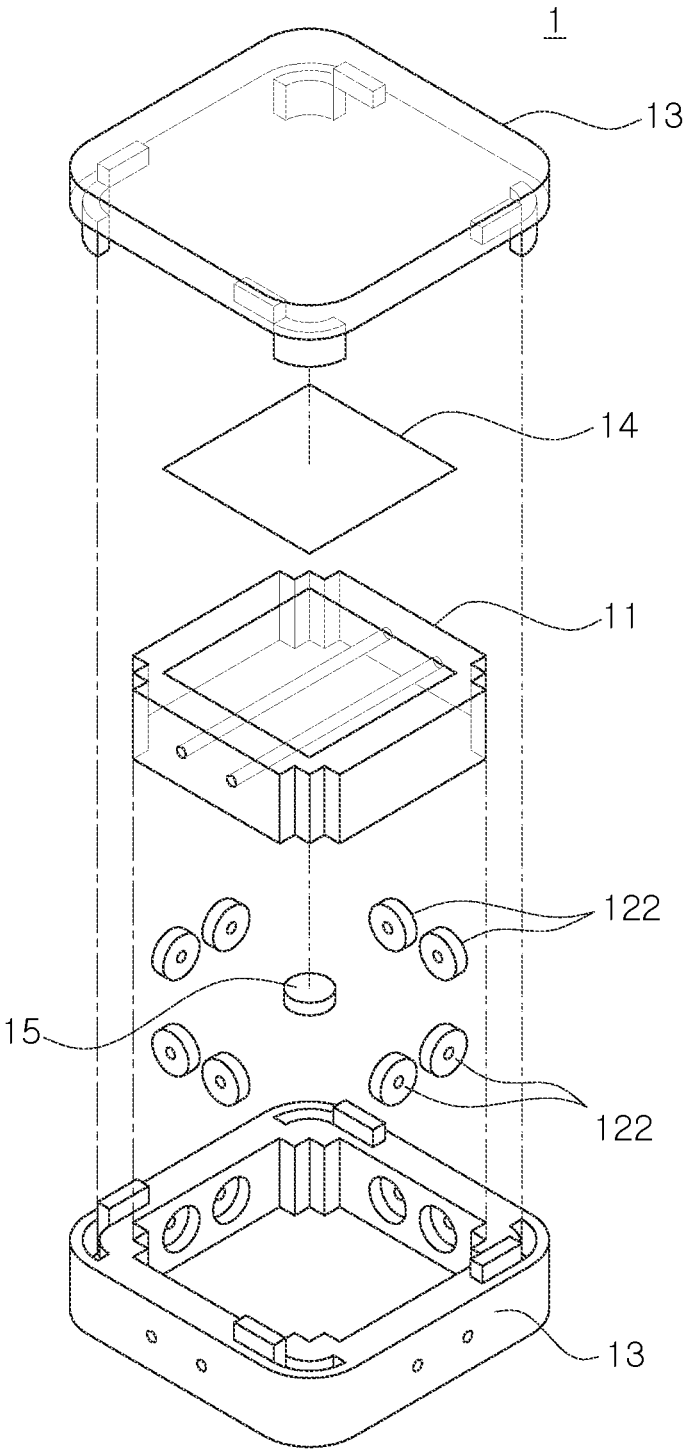
FIG. 21 is an exploded perspective view illustrating a state in which an imaging part and a light source are applied to the modular fluid chip according to an embodiment of the present disclosure.

Referring to FIG. 21, the modular fluid chip 1 may further include the imaging part 14 which is disposed on the cover 13 to image an entirety or a portion of the channel through which fluid flows, and the light source 15 which is disposed in the housing 12 or the cover 13 to irradiate predetermined light toward the channel.

Figure 22:
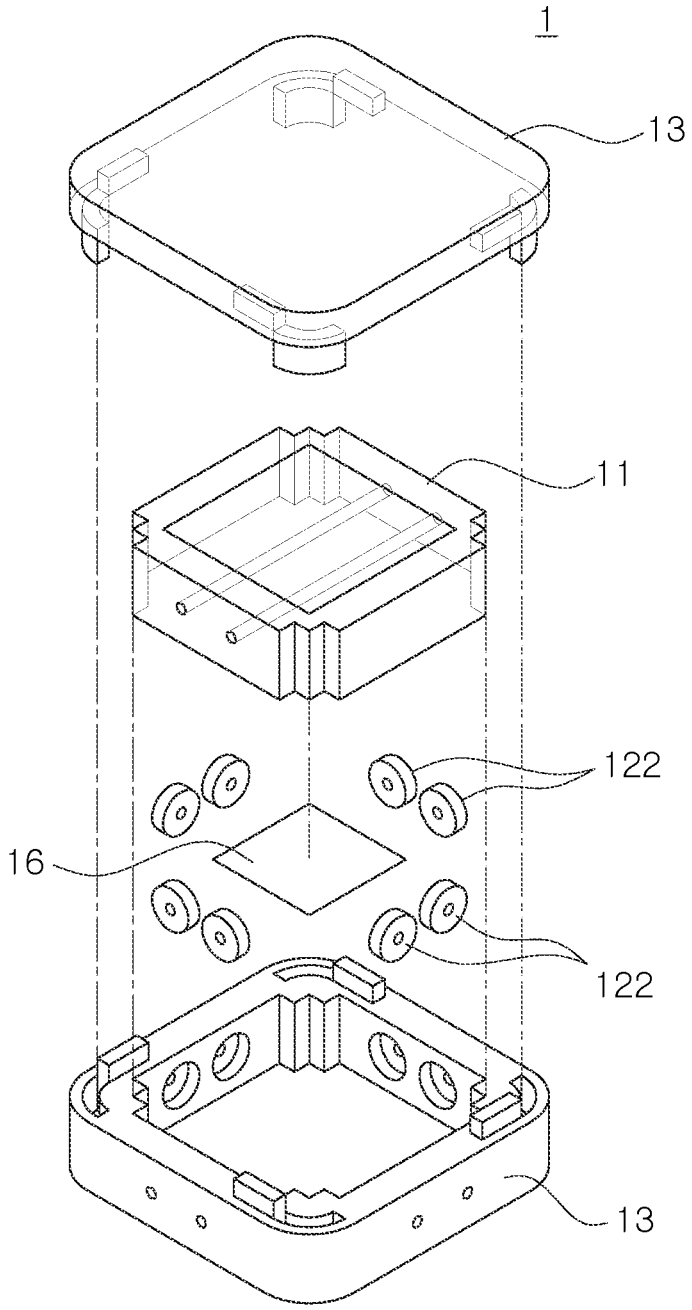
FIG. 22 is an exploded perspective view illustrating a state in which a temperature controller is applied to the modular fluid chip according to an embodiment of the present disclosure.

In addition, referring to FIG. 22, the modular fluid chip 1 may further include the temperature controller 16 which is installed in the housing 12 or the cover 13 to heat or cool the body 11 to a preset temperature. For example, a Peltier element or a resistance element may be used for the temperature controller 16. Unlike this, the temperature controller 16 may be formed in a channel structure that directly supplies gas or air of a predetermined temperature to the channel. However, the temperature controller 16 is not necessarily limited thereto, and may be changed into various structures and shapes to thereby be applied.

Further, although not shown in the drawings, the modular fluid chip 1 according to the first embodiment of the present disclosure may further include a gas supply part (not shown) and a circulator (not shown).

The gas supply part may supply gas of a set temperature to a clearance between the body 11 and the housing 12 or between the body 11 and the cover 13, or supply gas of a set temperature to the inside of the body 11 to thereby heat or cool the body 11 to a preset temperature.

The circulator may be connected to the first hole 111 of the body 11 and may transfer pressure to the first hole 111 and the fluid channel 112 using a difference in pressure through a pumping action, thereby stably moving fluid in one direction.

Hereinafter, the modular fluid chip 1 according to a second embodiment of the present disclosure will be described.

For reference, for respective components for describing the modular fluid chip 1 according to the second embodiment of the present disclosure, the same reference numerals as those used in describing the modular fluid chip 1 according to the first embodiment of the present disclosure will be used for convenience of description. The same or redundant descriptions will be omitted.

Referring to FIGS. 28 and 30, the modular fluid chip 1 according to the second embodiment of the present disclosure includes the body 11.

At least one first hole 111 is formed in the body 11 to guide a flow of fluid.

The first hole 111 communicates with the fluid channel 112 formed in the inside of the body 11 and the third hole 171 formed in the fluid connector 17 to be described later to thereby guide the flow of fluid in at least one direction of the X-axis direction and the Y-axis direction. And, the first hole 111 may be formed in a shape corresponding to the third hole 171 formed in the fluid connector 17 and the fluid channel 112 provided in the body 11.

In addition, the fluid channel 112 may be formed in the body 11.

The fluid channel 112 may communicate with at least one first hole 111 to thereby allow a flow of fluid. In addition, the fluid channel 112 may be configured to perform one preset function on the flowing fluid, as well as guiding the flow of fluid in various directions.

In addition, the modular fluid chip 1 according to the second embodiment of the present disclosure includes the housing 12.

Referring to FIGS. 28 and 30, the housing 12 is configured to receive the body 11 and the fluid connector 17 therein.

Further, the housing 12 includes a coupling unit 122.

The coupling unit 122 may be configured to couple the modular fluid chip 1 to the other modular fluid chips 2 in horizontal directions (the X-axis direction and Y-axis direction).

More specifically, the coupling unit 122 is received in the housing 12 or provided integrally with the housing 12 and may connect the modular fluid chip 1 to the other modular fluid chips 2 in the horizontal directions (the X-axis direction and Y-axis direction) and at the same time, may automatically align and fix the modular fluid chip 1 to the other modular fluid chips 2.

The coupling unit 122 may include a material having magnetism.

More specifically, the coupling unit 122 is formed of a magnetic body having an S-pole on one side thereof and an N-pole on the other side thereof, and may be installed on the inside or outside of the housing 12.

In addition, the coupling unit 122 may be formed in a structure capable of being directly connected to the coupling unit 122 provided in the other modular fluid chip 2.

Referring to FIG. 16, the coupling unit 122 provided in the modular fluid chip 1 and the coupling unit 122 of the other modular fluid chip 2 corresponding thereto may include the convex portion 1223 or the concave portion 1224 corresponding to each other.

Referring to FIG. 17, the coupling unit 122 provided in the modular fluid chip 1 may include the fastening portion 1225 having a hook shape at an end thereof to thereby be coupled with the other modular fluid chip 2. In this case, the fastening groove 1226 corresponding to the fastening portion 1225 provided in the modular fluid chip 1 may be formed in the other modular fluid chip 2.

Referring to FIG. 18, the coupling unit 122 provided in the modular fluid chip 1 may include the fastening portion 1225 having a bolt shape with a thread on an outer circumferential surface thereof to thereby be coupled with the other modular fluid chip 2. In this case, the fastening groove 1226 corresponding to the fastening portion 1225 provided in the modular fluid chip 1 may be formed in the other modular fluid chip 2.

Referring to FIG. 19, the coupling unit 122 provided in the modular fluid chip 1 may include the fastening portion 1225 having a '∩' shape in the form of a pin to thereby be coupled with the other modular fluid chip 2. In this case, the fastening groove 1226 in which the fastening portion 1225 in the form of a pin can be inserted may be formed in the modular fluid chip 1 and the other modular fluid chip 2.

Referring to FIG. 20, the coupling unit 122 provided in the modular fluid chip 1 may be coupled to the other modular fluid chip 2 through the fastening portion 1225 having a bolt shape. In this case, the fastening groove 1226 in which the bolt-shaped fastening portion 1225 can be fastened may be formed in the modular fluid chip 1 and the other modular fluid chip 2.

In addition, the modular fluid chip 1 according to the second embodiment of the present disclosure includes the fluid connector 17.

Referring to FIGS. 28 and 30, the fluid connector 17 may be formed in the form of a sheet or a pad, and may be detachably installed on the housing 12. Here, the seating groove 123 capable of receiving the fluid connector 17 may be formed in the housing 12. And, the third hole 171 aligned to correspond to the first hole 111 may be formed in the fluid connector 17.

In addition, the fluid connector 17 may be configured to form an interface when contacting another fluid connector 17.

More specifically, the fluid connector 17 may be formed of an elastically deformable elastomer material and form an interface at a contact portion when contacting another fluid connector 17 provided in the other modular fluid chip 2. Here, an adhesive layer may be provided on one surface of the fluid connector 17, and the adhesive layer can be adhered to one surface of another fluid connector 17 when the fluid connector 17 contacts the other fluid connector 17.

However, the fluid connector 17 is not limited thereto, and may be changed into various shapes or various materials to thereby be applied within conditions capable of performing the same function. For example, when the housing 12 is manufactured, the fluid connector 17 may be integrally provided with the outer surface of the housing 12 through double injection molding, and may be formed in a circular or polygonal ring shape with a hole formed in a center thereof, or may be formed in a plate-like stopper shape. In addition, the fluid connector 17 may be formed of at least one of a polymer resin, an amorphous material, and a metal, and may include at least one of chlorinated polyethylene, ethylene propylene dimethyl, silicone rubber, acrylic resin, amide resin, epoxy resin, phenol resin, polyester-based resin, polyethylene-based resin, ethylene-propylene rubber, polyvinyl butyral resin, polyurethane resin, and nitrile-butadiene-based rubber.

Therefore, when the modular fluid chip 1 and the other modular fluid chip 2 are connected, the fluid connector 17 provided in the modular fluid chip 1 is in close contact with the fluid connector 17 provided in the other modular fluid chip 2 and forms an interface. Through this, a connection portion between the modular fluid chip 1 and the other modular fluid chip 2 may be completely airtight to thereby block leakage of fluid.

In addition, the fluid connector 17 may be disposed on at least one of the outside and the inside of the housing 12.

Referring to FIG. 32, the fluid connector 17 disposed on the outside of the housing 12 may be in close contact with the other fluid connector 17 and form an interface, and the fluid connector 17 disposed on the inside of the housing 12 may be in close contact with the body 11 and form an interface.

In addition, the fluid connector 17 may be formed in a structure capable of being coupled to the housing 12.

Referring to FIGS. 28 and 30, the convex portion 173 having a protrusion shape may be formed on the fluid connector 17, and the convex portion 173 protrudes from an outer surface of the fluid connector 17 by a predetermined length and is inserted into the seating groove 123 formed in the housing 12. Accordingly, the fluid connector 17 is more stably coupled to the housing 12 to limit the movement thereof and further, even when the modular fluid chip 1 is coupled to the other modular fluid chip 2, it is feasible to prevent the fluid connector 17 from being separated from the housing 12.

Meanwhile, although not shown in the drawings, a concave portion having a groove shape may be formed in the fluid connector 17, and the concave portion may be recessed from the outer surface of the fluid connector 17 to a predetermined depth and coupled to the protrusion formed in the housing 12.

However, a coupling structure provided in the fluid connector 17 is not necessarily limited thereto, and may be changed into various shapes to thereby be applied.

In addition, the fluid connector 17 may be formed in a structure capable of directly communicating with the body 11 to thereby be connected to the other modular fluid chip 2.

Referring to FIG. 30, the fluid connector 17 is received in the housing 12, but may pass through the housing 12 to thereby be in close contact with the outer surface of the body 11. Accordingly, the third hole 171 provided in the fluid connector 17 directly communicates with the first hole 111 provided in the body 11 and allows the flow of fluid.

That is, the fluid connector 17 installed by passing through the housing 12 is in close contact with the fluid connector 17 of the other modular fluid chip 2 at one side thereof to thereby form an interface, and is in close contact with the outer surface of the body 11 at the other side thereof to thereby form an interface, so that points at which fluid may leak may be minimized. Through this, a stable fluidic flow may be allowed.

For example, the fluid connector 17 may include the seating portion 172 which is seated in the seating groove 123 formed in the outer surface of the housing 12 and which is connected to the other modular fluid chip 2, and the convex portion 173 which protrudes from one surface of the seating portion 172 by a predetermined length and passes through the housing 12 and which is in close contact with the outer surface of the body 11 and forms an interface. Here, the concave portion 1231 may be provided in the inner surface of the housing 12, and the concave portion 1231 is formed in a shape corresponding to the outer surface of the convex portion 173 and supports the convex portion 173.

In addition, the fluid connector 17 may be formed in a structure in which it is divided into plural numbers, while directly communicating with the body 11.

Referring to FIGS. 31 and 32, the fluid connector 17 may include the seating portion 172, the convex portion 173, and the O-ring 174.

The seating portion 172 may be seated in the seating groove 123 formed in the outer surface of the housing 12 and may be in close contact with the other modular fluid chip 2 to thereby form an interface.

The convex portion 173 may be separated from the seating portion 172 and received in the concave portion 1231 provided inside the housing 12, and may be in close contact with the outer surface of the body 11 and form an interface.

The O-ring 174 is disposed between the seating portion 172 and the convex portion 173 to connect the seating portion 172 and the convex portion 173 to each other and uniformly distributes a load which acts on the fluid connector 17 in the axial direction when connecting the modular fluid chip 1 and other modular fluid chip 2, thereby preventing deformation of the seating portion 172 or the convex portion 173. For example, the O-ring 174 is formed of an elastic body, plastic or metallic material, and another hole communicating with the third hole 171 formed in the seating portion 172 and the convex portion 173 may be formed inside the O-ring 174.

However, the fluid connector 17 is not necessarily limited thereto, and may be changed into various forms to thereby be applied.

Hereinafter, the modular fluid chip 1 according to a third embodiment of the present disclosure will be described.

For reference, for respective components for describing the modular fluid chip 1 according to the third embodiment of the present disclosure, the same reference numerals as those used in describing the modular fluid chip 1 according to the first embodiment of the present disclosure will be used for convenience of description. The same or redundant descriptions will be omitted.

Referring to FIGS. 3 and 7, the modular fluid chip 1 according to the third embodiment of the present disclosure includes the body 11.

At least one first hole 111 is formed in the body 11 to guide a flow of fluid.

The first hole 111 communicates with the second hole 121 of the housing 12 to be described later and the fluid channel 112 to be described later that is formed in the inside of the body 11 to thereby guide the flow of fluid in at least one direction of the X-axis direction and the Y-axis direction. In addition, the first hole 111 may be formed in a shape corresponding to the second hole 121 provided in the housing 12 and the fluid channel 112 provided in the body 11.

In addition, the fluid channel 112 may be formed in the body 11.

The fluid channel 112 may communicate with at least one first hole 111 to thereby allow for a flow of fluid. In addition, the fluid channel 112 may be configured to perform one preset function on the flowing fluid, as well as guiding the flow of fluid in various directions.

In addition, the modular fluid chip 1 according to the third embodiment of the present disclosure includes the housing 12.

The housing 12 is formed in a frame structure having a receiving space formed therein, and is configured to receive the body 11 therein. In addition, the second hole 121 is formed in the housing 12, and the second hole 121 corresponds to at least one first hole 111 provided in the body 11 and allows for the flow of fluid, when the body 11 is received in the receiving space.

In addition, the housing 12 includes the fluid connector 17.

The fluid connector 17 is configured to connect the modular fluid chip 1 with the other modular fluid chip 2.

Referring to FIGS. 23 and 24, the fluid connector 17 may be formed in the form of a sheet or a pad, and may be detachably installed on the outer surface of the housing 12. Here, the seating groove 123 which corresponds to the fluid connector 17 so that the fluid connector 17 can be seated therein may be formed in the outer surface of the housing 12. And, the third hole 171 which is aligned to correspond to the first hole 111 and the second hole 121 may be formed in the fluid connector 17.

In addition, referring to FIGS. 25 and 26, the fluid connector 17 may be configured to form an interface when contacting another fluid connector 17.

More specifically, the fluid connector 17 may be formed of an elastically deformable elastomer material and form an interface at a contact portion when contacting another fluid connector 17. Here, an adhesive layer may be provided on one surface of the fluid connector 17, and the adhesive layer can be adhered to one surface of another fluid connector 17 when the fluid connector 17 contacts the other fluid connector 17.

However, the fluid connector 17 is not limited thereto, and may be changed into various shapes or various materials to thereby be applied within conditions capable of performing the same function. For example, when the housing 12 is manufactured, the fluid connector 17 may be integrally provided with the outer surface of the housing 12 through double injection molding, and may be formed in a circular or polygonal ring shape with a hole formed in a center thereof, or may be formed in a plate-like stopper shape. In addition, the fluid connector 17 may be formed of at least one of a polymer resin, an amorphous material, and a metal, and may include at least one of chlorinated polyethylene, ethylene propylene dimethyl, silicone rubber, acrylic resin, amide resin, epoxy resin, phenol resin, polyester-based resin, polyethylene-based resin, ethylene-propylene rubber, polyvinyl butyral resin, polyurethane resin, and nitrile-butadiene-based rubber.

Therefore, when the modular fluid chip 1 and the other modular fluid chip 2 are connected in the horizontal or vertical direction, the fluid connector 17 provided in the modular fluid chip 1 is in close contact with the fluid connector 17 provided in the other modular fluid chip 2 and forms an interface. Through this, the connection portion between the modular fluid chip 1 and the other modular fluid chip 2 may be completely airtight to thereby block leakage of fluid. Here, the coupling units 122 to be described later that have magnetism so as to maximize adhesion of the fluid connectors 17 may be further disposed on the inner surfaces of the respective housings 12 provided in the modular fluid chip 1 and the other modular fluid chip 2.

In addition, the fluid connector 17 may be disposed on at least one of the outside and the inside of the housing 12.

Referring to FIG. 27, the fluid connector 17 disposed on the outside of the housing 12 may be in close contact with the other fluid connector 17 and form an interface, and the fluid connector 17 disposed on the inside of the housing 12 may be in close contact with the body 11 and form an interface.

In addition, the fluid connector 17 may be formed in a structure capable of being coupled to the housing 12.

Referring to FIGS. 28 and 29, the convex portion 173 having a protrusion shape may be formed on the fluid connector 17, and the convex portion 173 protrudes from an outer surface of fluid connector 17 by a predetermined length and is inserted into the seating groove 123 formed in the housing 12.

Meanwhile, although not shown in the drawings, a concave portion having a groove shape may be formed in the fluid connector 17, and the concave portion may be recessed from the outer surface of the fluid connector 17 to a predetermined depth and coupled to the protrusion formed in the housing 12.

However, a coupling structure provided in the fluid connector 17 is not necessarily limited thereto, and may be changed into various shapes to thereby be applied.

In addition, the fluid connector 17 may be formed in a structure capable of directly communicating with the body 11 to thereby be connected to the other modular fluid chip 2.

Referring to FIG. 30, the fluid connector 17 is received in the housing 12, but may pass through the housing 12 to thereby be in close contact with the outer surface of the body 11. Accordingly, the third hole 171 provided in the fluid connector 17 directly communicates with the first hole 111 provided in the body 11 and allows the flow of fluid.

That is, the fluid connector 17 installed by passing through the housing 12 is in close contact with the fluid connector 17 of the other modular fluid chip 2 at one side thereof to thereby form an interface, and is in close contact with the outer surface of the body 11 at the other side thereof to thereby form an interface, so that points at which fluid may leak may be minimized. Through this, a stable fluidic flow may be allowed.

In addition, the fluid connector 17 may be formed in a structure in which it is divided into plural numbers, while directly communicating with the body 11.

Referring to FIGS. 31 and 32, the fluid connector 17 may include the seating portion 172, the convex portion 173, and the O-ring 174.

The seating portion 172 may be seated in the seating groove 123 formed in the outer surface of the housing 12 and may be in close contact with the other modular fluid chip 2 to form an interface.

The convex portion 173 may be separated from the seating portion 172 and received in the concave portion 1231 provided inside the housing 12, and may be in close contact with the outer surface of the body 11 and form an interface.

The O-ring 174 is disposed between the seating portion 172 and the convex portion 173 to connect the seating portion 172 and the convex portion 173 to each other and uniformly distributes a load which acts on the fluid connector 17 in the axial direction when connecting the modular fluid chip 1 and other modular fluid chip 2, thereby preventing deformation of the seating portion 172 or the convex portion 173.

In addition, the modular fluid chip 1 according to the third embodiment of the present disclosure may further include at least one sensor 18.

Figure 33:
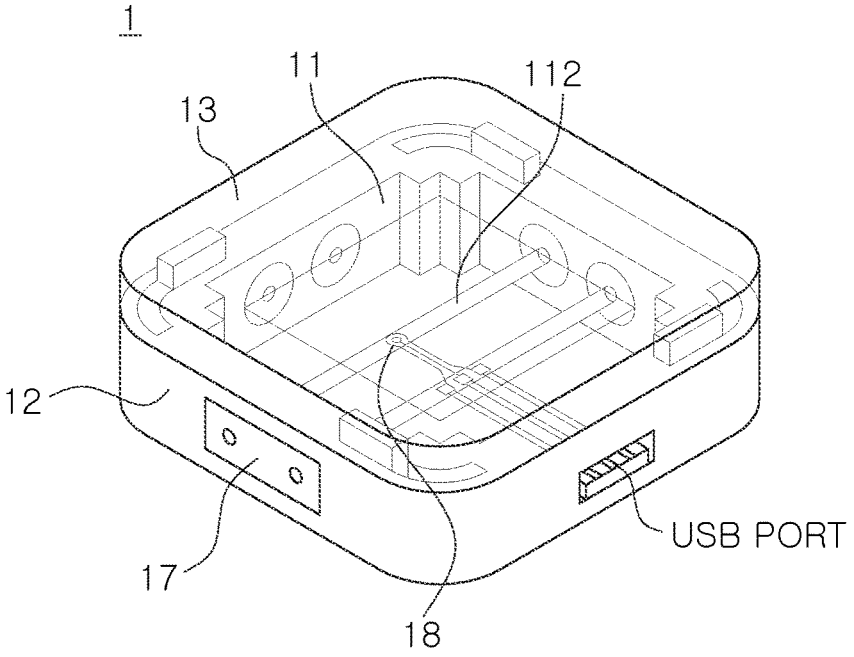
FIG. 33 is a perspective view schematically illustrating a state in which a sensor is installed in the modular fluid chip according to an embodiment of the present disclosure.
Figure 33:
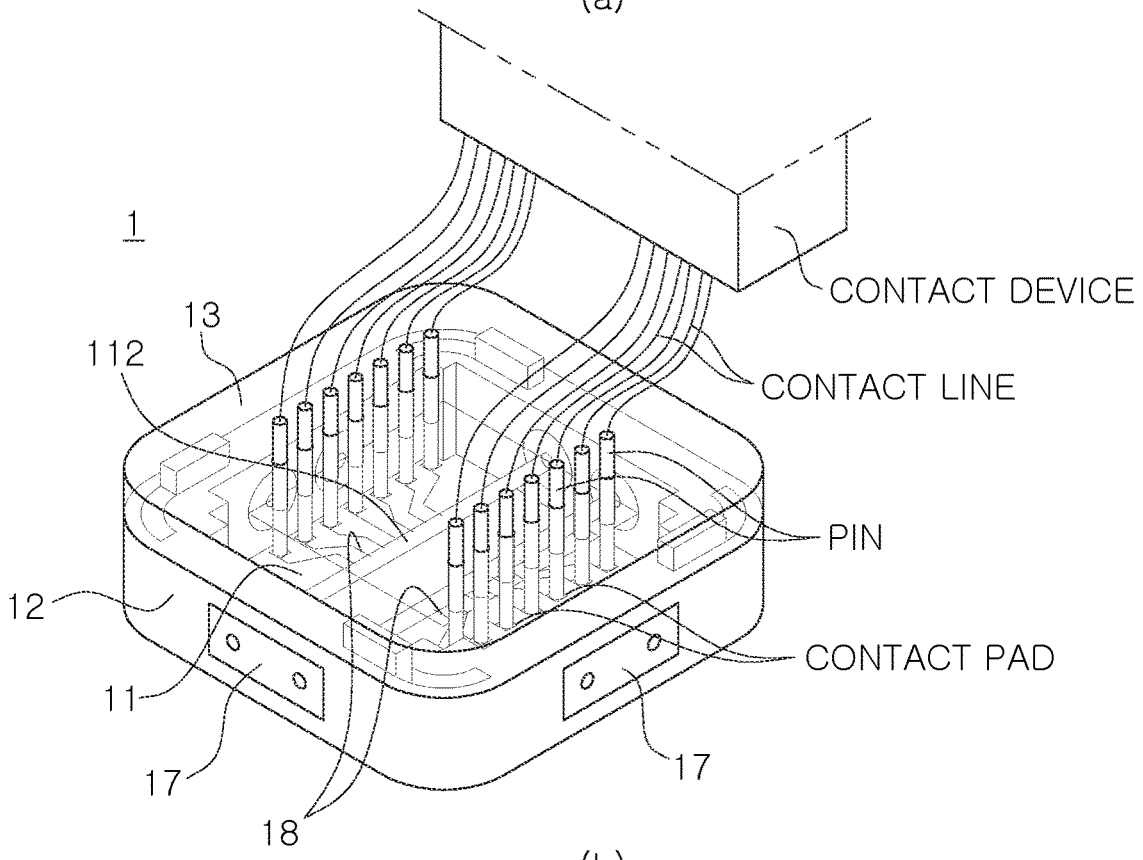

Referring to FIG. 33, at least one sensor 18 is installed in the inside of the body 11 in which the fluid channel 112 is formed, and is connected to the fluid channel 112 through a microchannel. When fluid flows in the fluid channel 112, the at least one sensor 18 may detect a signal generated from the fluid.

Here, at least one sensor 18 may be configured to detect at least one of an electric signal, a fluorescent signal, an optical signal, an electrochemical signal, a chemical signal, and a spectroscopic signal.

In addition, at least one sensor 18 may be formed of any one of a metal, an organic-inorganic composite, and an organic conductor.

More specifically, at least one sensor 18 may be formed of a metal electrode including at least one material of Au, Mg, Ti, Cr, Mn, Fe, Co, Ni, Cu, Zn, Ga, Al, Zr, Nb, Mo, Ru, Ag, and Sn, may be formed of an organic electrode including at least one material of a conductive polymer and carbon, or may be formed of an organic-inorganic composite electrode in which at least one material among the materials constituting the metal electrode and at least one material among the materials constituting the organic electrode are mixed.

In addition, at least one sensor 18 may be formed of a material having transparency so as to detect at least one of a fluorescent signal, an optical signal, and a spectroscopic signal.

For example, as shown in FIG. 33(*a*), at least one sensor 18 may include an electrode that is installed in the inside of the body 11 and connected to the fluid channel 112, and a USB port that is electrically connected to the electrode and connectable from the outside through a USB connector. In addition, as shown in FIG. 33(*b*), at least one sensor 18 may include a plurality of electrodes that are installed in the inside of the body 11 and connected to the fluid channel 112 at a plurality of positions, contact pads that are connected to the plurality of electrodes, a plurality of communication holes that are formed in the cover 13 to allow an external space and a plurality of the contact pads to communicate with each other, pins (fixation pins) that are inserted into the plurality of communication holes and contact the plurality of contact pads, and contact lines that connect the fixation pins and an external connection device (contact device) to each other and transmit a signal sensed through the fixation pin to the external connection device (contact device). However, at least one sensor 18 is not limited thereto, and may be changed in various forms to thereby be applied.

Hereinafter, the modular fluid chip 1 according to a fourth embodiment of the present disclosure will be described.

For reference, for respective components for describing the modular fluid chip 1 according to the fourth embodiment of the present disclosure, the same reference numerals as those used in describing the modular fluid chip 1 according to the first embodiment of the present disclosure will be used for convenience of description. The same or redundant descriptions will be omitted.

Figure 35:
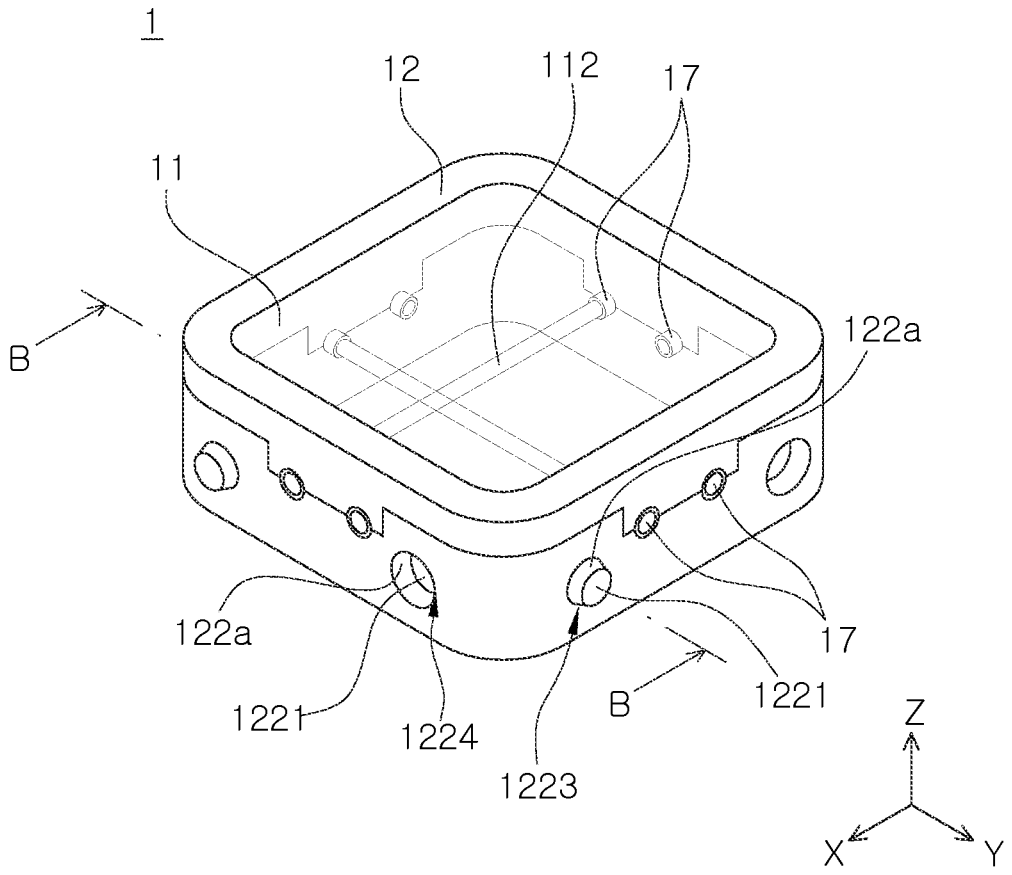
FIG. 35 is a perspective view illustrating a modular fluid chip according to another embodiment of the present disclosure.

Referring to FIGS. 34 and 35, the modular fluid chip 1 according to the fourth embodiment of the present disclosure includes the housing 12.

The housing 12 is formed in a frame structure having a receiving space formed therein, and is configured to receive the body 11 therein. In addition, when the housing 12 is connected to the other modular fluid chip 2, the housing 12 is configured such that the body 11 received therein communicates with the body 11 provided in the other modular fluid chip 2.

Figure 37:
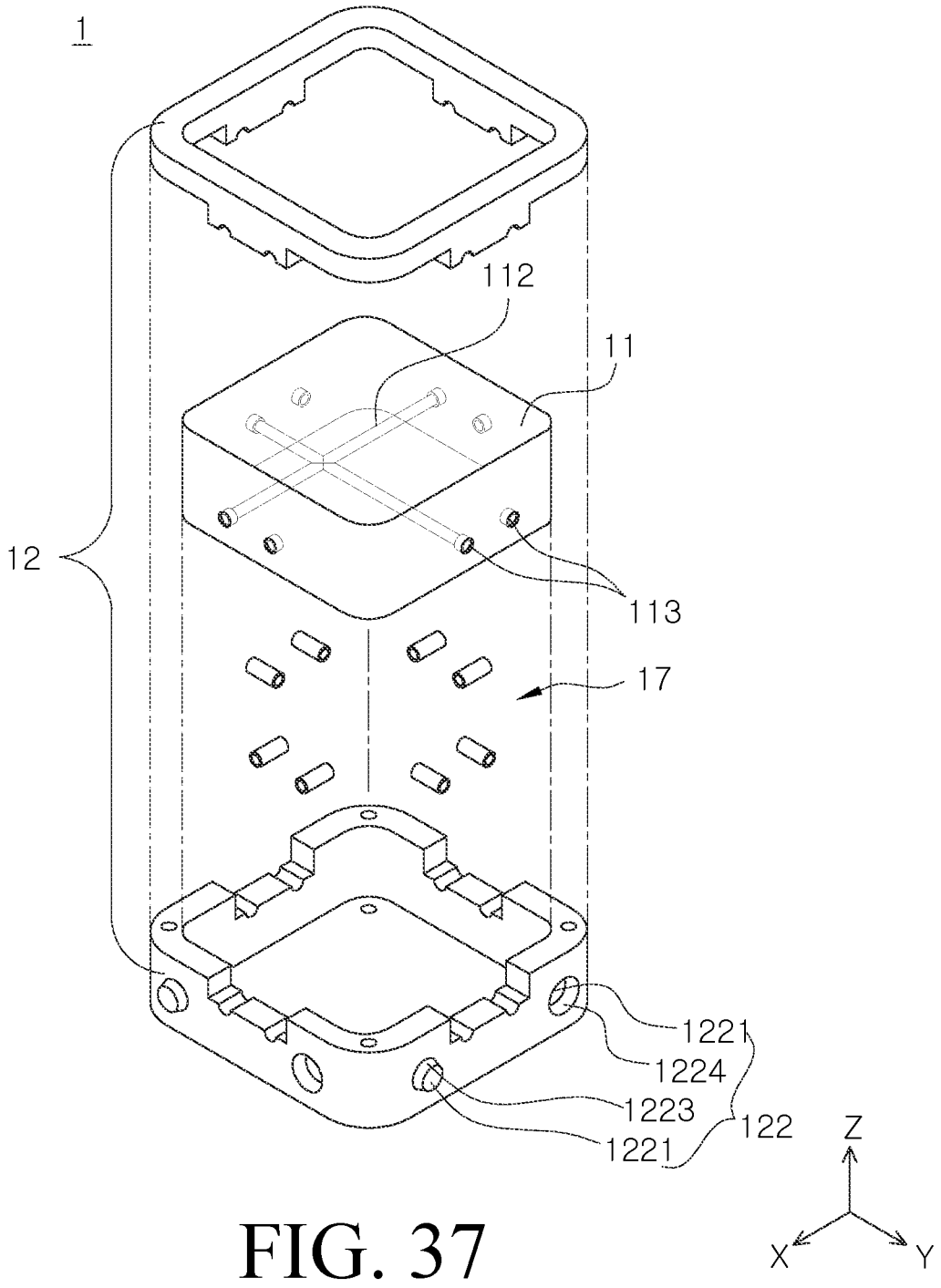
FIG. 37 is an exploded perspective view illustrating the modular fluid chip according to another embodiment of the present disclosure.

Referring to FIG. 37, the housing 12 may be composed of a plurality of parts that may be divided and assembled.

More specifically, the housing 12 may be composed of a lower part configured to support a lower surface of the body 11 and an upper part configured to be coupled to the lower part and support a circumferential surface of the body 11 exposed to the outside of the lower part.

Here, a seating groove where a lower side of the body 11 is received may be formed in a lower portion, and a through hole which exposes an upper surface of the body 11 to an external space may be formed in an upper portion.

In addition, the plurality of parts constituting the housing 12 may be coupled to each other using magnetism.

For example, although not illustrated in the drawings, magnetic bodies capable of being coupled to each other may be provided on an upper surface of the lower part and a lower surface of the upper part corresponding thereto. However, the plurality of parts are not necessarily combined using magnetism, and may be combined with each other through various combining methods.

In addition, the modular fluid chip 1 according to the fourth embodiment of the present disclosure includes a coupling portion 122.

Referring to FIG. 34, the coupling portion 122 is provided in the housing 12 and is configured to couple the modular fluid chip 1 with the other modular fluid chips 2.

The coupling portion 122 may be formed in a structure capable of connecting the modular fluid chip 1 to the other modular fluid chips 2 in various directions and at various angles.

Figure 36:
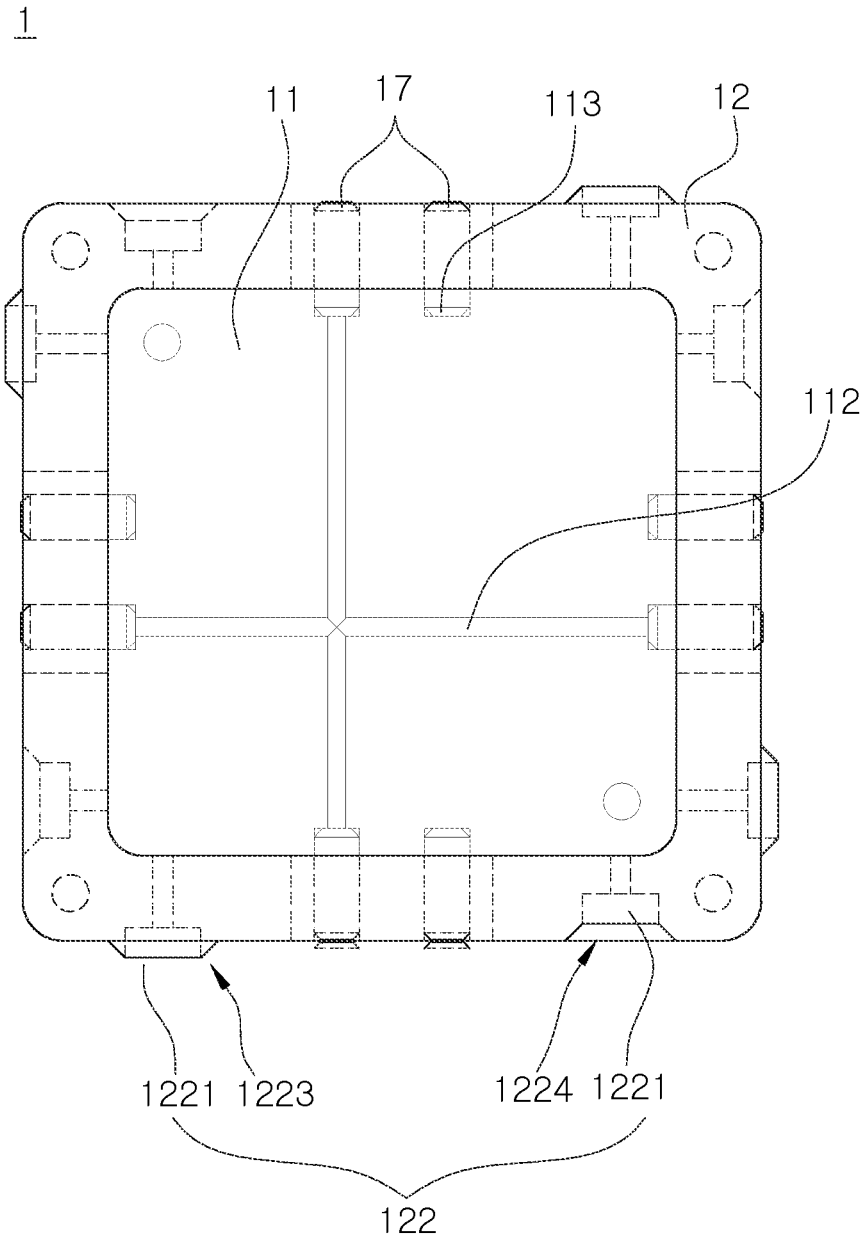
FIG. 36 is a plan view illustrating the modular fluid chip according to another embodiment of the present disclosure.

Referring to FIGS. 35 and 36, the coupling portion 122 may include at least one protrusion 1223 protruding from the outer surface of the housing 12 and at least one receiving groove 1224 provided in the outer surface of the housing 12.

Here, at least one protrusion 1223 and at least one receiving groove 1224 are formed in a shape in which they correspond to each other, and may be alternately arranged along a circumference of the housing 12.

For example, the protrusion 1223 and the receiving groove 1224 provided in one surface of the housing 12 may be disposed at positions symmetrical to each other in a horizontal or vertical direction. In addition, each of the protrusion 1223 and the receiving groove 1224 provided in one surface of the housing 12 may be provided in plural numbers, and a plurality of protrusions 1223 and a plurality of receiving grooves 1224 may be disposed to be spaced apart from each other at equal intervals in a horizontal or vertical direction. In this case, the plurality of protrusions 1223 and the plurality of receiving grooves 1224 which are provided in one surface of the housing 12 may be alternately disposed in a direction in which they are arranged or may be disposed in a state in which they are divided by type. However, the protrusion 1223 and the receiving groove 1224 are not necessarily limited thereto, and may be changed into various forms to thereby be applied.

In addition, at least one protrusion 1223 and at least one receiving groove 1224 provided in the modular fluid chip 1 are coupled to the protrusion 1223 and the receiving groove 1224 provided in the other modular fluid chip 2, they may be configured to align the protrusion 1223 and the receiving groove 1224 provided in the other modular fluid chip 2.

More specifically, at least one protrusion 1223 and at least one receiving groove 1224 may be provided with inclined surfaces 122*a* for guiding the protrusion 1223 and receiving groove 1224 provided in the other modular fluid chip 2 to predetermined positions.

For example, the inclined surfaces 122*a* may be formed at ends of the protrusion 1223 and the receiving groove 1224.

Accordingly, the protrusion 1223 and the receiving groove 1224 provided in the other modular fluid chip 2, which are to be coupled to the at least one protrusion 1223 and at least one receiving groove 1224 provided in the modular fluid chip 1, may be guided to predetermined positions through the inclined surfaces 122*a* and aligned with the protrusion 1223 and the receiving groove 1224 of the modular fluid chip 1, thereby being disposed at positions where they have the same central axis as the protrusion 1223 and the receiving groove 1224 of the modular fluid chip 1.

In addition, the coupling portion 122 may further include a plurality of magnetic members 1221.

Figure 38:
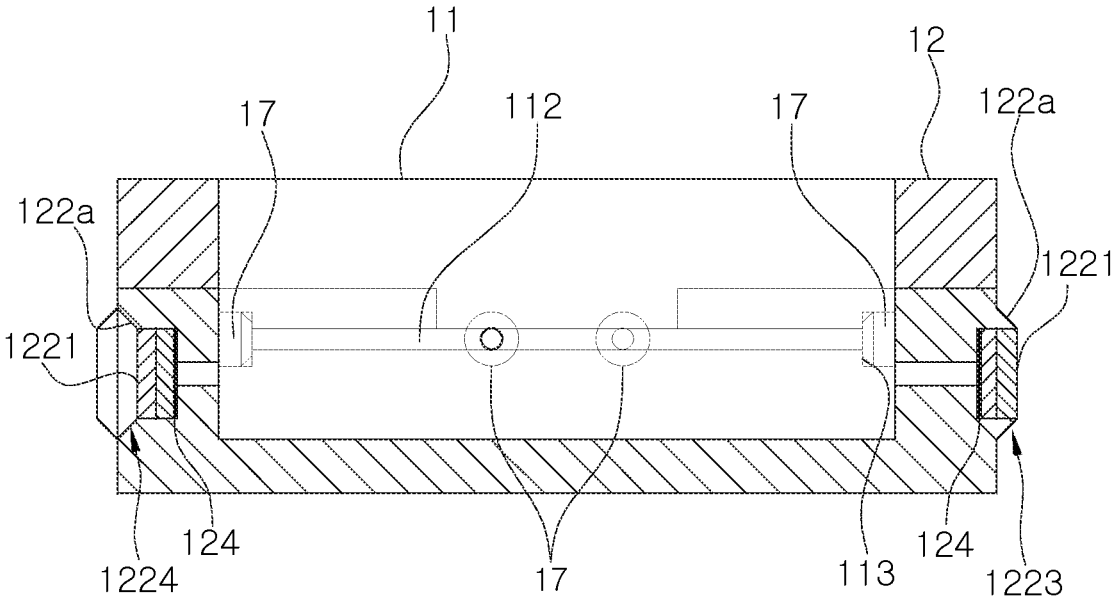
FIG. 38 is a cross-sectional view taken along line B-B of FIG. 35.

Referring to FIGS. 36 and 38, the plurality of magnetic members 1221 may be formed of a magnetic material having an S-pole on one side thereof and an N-pole on the other side thereof, and may be disposed inside the housing 12.

More specifically, the plurality of magnetic members 1221 may be disposed inside the protrusion 1223 and the receiving groove 1224 provided in the housing 12. Here, the magnetic member 1221 disposed inside the protrusion 1223 may have the same central axis as the protrusion 1223, and the magnetic member 1221 disposed inside the receiving groove 1224 may have the same central axis as the receiving groove 1224. In addition, the magnetic member 1221 disposed inside the protrusion 1223 and the magnetic member 1221 disposed inside the receiving groove 1224 may be disposed such that polarities thereof are opposite to each other in consideration of coupling with the other modular fluid chip 2.

Therefore, when the modular fluid chip 1 and the other modular fluid chip 2 are connected, the modular fluid chip 1 and the other modular fluid chip 2 may be continuously kept in close contact with each other through binding force of the magnetic members 1221 provided in the modular fluid chip 1 and the other modular fluid chip 2.

However, the plurality of magnetic members 1221 are not necessarily disposed inside the protrusion 1223 and the receiving groove 1224 provided in the housing 12, and may be disposed in various positions as necessary.

Figure 43:
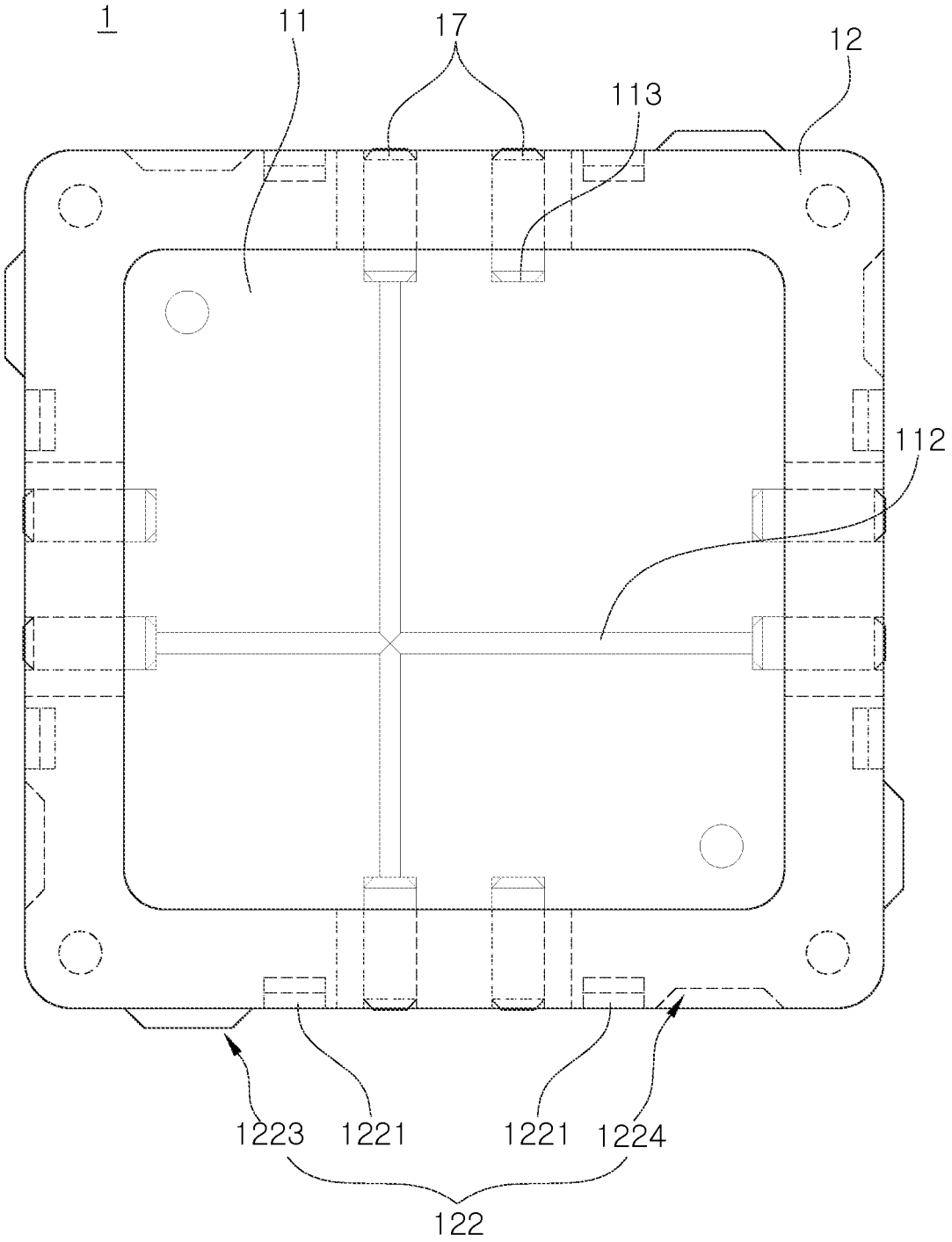
FIG. 43 is a view schematically illustrating a state in which a magnetic member applied to the modular fluid chip according to another embodiment of the present disclosure is disposed at a position different from those of a protrusion and a receiving groove.

Referring to FIG. 43, the plurality of magnetic members 1221 are installed on the outer surface of the housing 12 along the circumference of the housing 12, but may be disposed at positions different from those of the protrusion 1223 and the receiving groove 1224.

In addition, although not shown in the drawings, the plurality of magnetic members 1221 may be disposed inside the protrusion 1223 and inside the receiving groove 1224 provided in the housing 12, and may be further disposed at positions different from those of the protrusion 1223 and the receiving groove 1224.

In addition, the coupling portion 122 may further include a blocking member 124.

Referring to FIG. 38, the blocking member 124 may be disposed on one side of the magnetic member 1221 and block magnetism of the magnetic member 1221.

That is, the blocking member 124 may affect the magnetism of the magnetic member 1221 acting toward the flow channel 112 to thereby reduce the magnetism or block the magnetism. Accordingly, it is feasible to prevent the occurrence of abnormality in the flow of fluid or the occurrence of abnormality in a function of the modular fluid chip 1, due to the magnetism.

For example, the blocking member 124 may be formed of a conductive material or a magnetic material. As one example, the blocking member 124 may be formed of an alloy using iron, nickel, chromium, and copper. However, the blocking member 124 is not limited thereto, and may be changed into various materials or structures capable of performing the same function, to thereby be applied.

In addition, the coupling portion 122 may further include a tightening portion 160.

Figure 44:
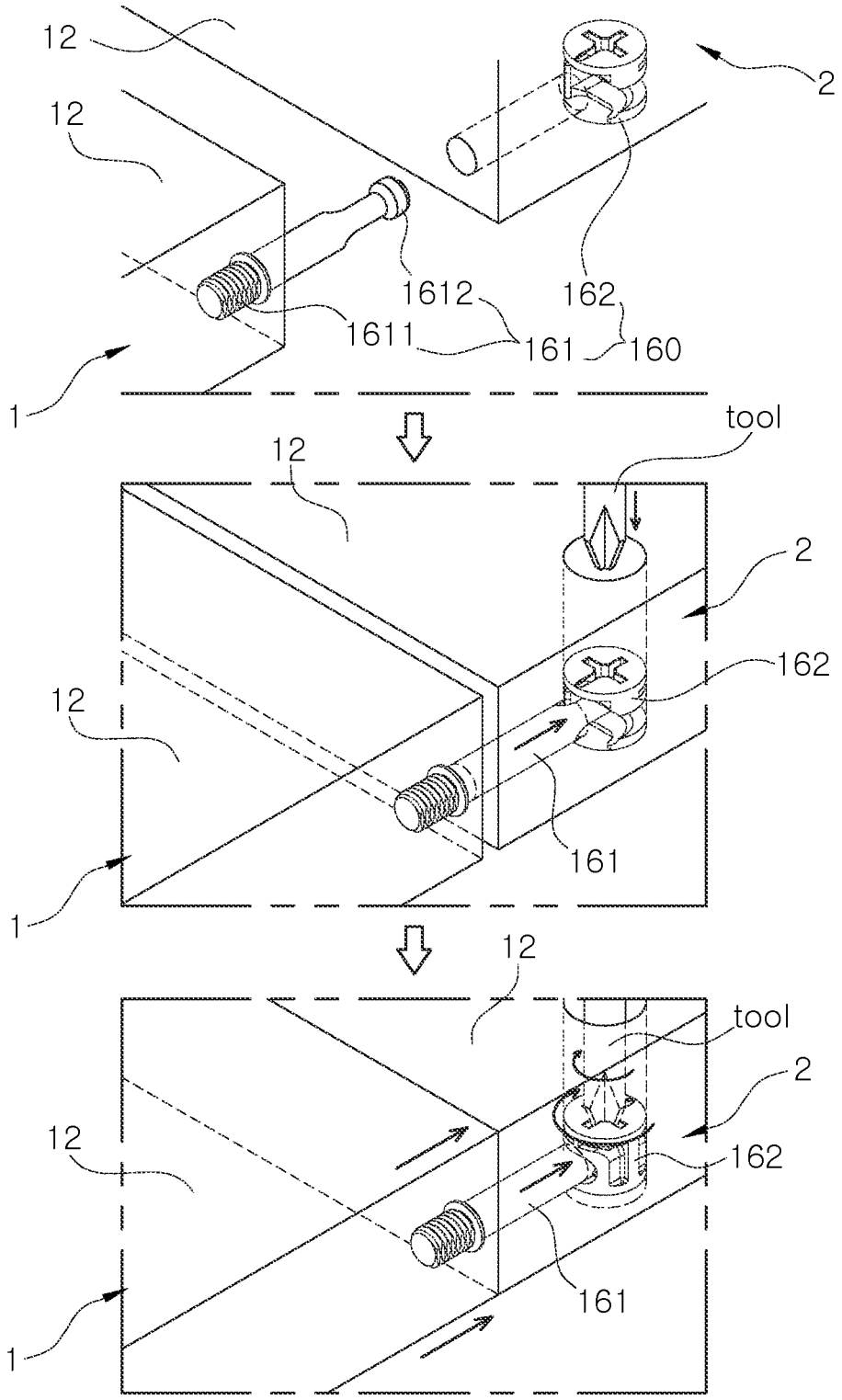
FIG. 44 is a view schematically illustrating a process in which the modular fluid chip according to another embodiment of the present disclosure is connected to another modular fluid chip through a tightening portion.

Referring to FIG. 44, the tightening portion 160 is installed in each of the housing 12 of the modular fluid chip 1 and the housing 12 of the other modular fluid chip 2 and is coupled through a separate tool to thereby allow the modular fluid chip 1 and the other modular fluid chip 2 to be in close contact with each other.

Here, the tightening portion 160 converts a rotational motion into a linear motion, so that the modular fluid chip 1 and the other modular fluid chip 2 may be in close contact with each other.

More specifically, the tightening portion 160 installed in the other modular fluid chip 2 performs a rotational motion through a tool, and the tightening portion 160 installed in the modular fluid chip 1 which is coupled to the tightening portion 160 installed in the other modular fluid chip 2 performs a linear motion through the tightening portion 160 of the other modular fluid chip 2 performing a rotational motion, so that the modular fluid chip 1 may move toward the other modular fluid chip 2.

The tightening portion 160 may include a shaft portion 161 and a cam portion 162.

The shaft portion 161 may be formed in a rod shape having a preset length. And, a fastener 1611 capable of being fastened to the housing 12 of the modular fluid chip 1 (or the housing 12 of the other modular fluid chip 2) may be provided at one side of the shaft portion 161, and a caught portion 1612 having a projection shape may be provided at the other side of the shaft portion 161.

The cam portion 162 is installed in the other modular fluid chip 2 (or the housing 12 of the modular fluid chip 1) to receive the caught portion 1612 therein, and when subjected to external force by a tool, it presses the caught portion 1612 received therein while rotating in a circumferential direction to thereby linearly move the caught portion 1612 in an axial direction. Here, the housing 12 of the other modular fluid chip 2 may be provided with a first insertion hole which communicates with a space where the cam portion 162 is received, and into which the shaft portion 161 is insertable and a second insertion hole which communicates with the space where the cam portion 162 is received, and into which a tool is insertable.

That is, the tightening portion 160 may couple the modular fluid chip 1 and the other modular fluid chip 2 more firmly through the cam portion 162 performing a rotational motion by a tool and the shaft portion 161 performing a linear motion by the rotational motion of the cam portion 162.

In addition, the modular fluid chip 1 according to the fourth embodiment of the present disclosure may further include the body 11.

Referring to FIGS. 34 and 37, the body 11 is formed in the form of a replaceable module and may be received in the housing 12. Thus, the body 11 can be selectively replaced as needed.

In addition, at least one flow channel 112 capable of guiding the flow of fluid in various directions may be formed in the body 11.

When the housing 12 is connected to the other modular fluid chip 2, the flow channel 112 is aligned with and may communicate with the flow channel 112 provided in the other modular fluid chip.

However, only the flow channel 112 is not necessarily formed in the body 11, and various functional units may be provided as necessary. For example, various functional units such as a quantitative chamber, a gene extraction chamber, a waste chamber, a mixing chamber, a buffer chamber, a valve and the like may be provided in the body 11. Accordingly, the modular fluid chip 1 may perform various functions such as fluid mixture or distribution, as well as guiding the flow of fluid.

In addition, a coating layer may be further formed on the flow channel 112 of the modular fluid chip 1.

More specifically, a coating layer of a hydrophobic or hydrophilic material may be further formed on the flow channel 112 of the modular fluid chip 1. Here, a type of the coating layer described above may be selectively applied to the modular fluid chip 1 according to a type of fluid, whereby fluid flow performance may be improved. However, the coating layer is not necessarily formed only on the flow channel 112 and may be further formed on various functional units such as a quantitative chamber, a gene extraction chamber, a waste chamber, a mixing chamber, a buffer chamber, a valve, and the like, if necessary.

Hereinafter, the modular fluid chip 1 according to a fifth embodiment of the present disclosure will be described.

For reference, for respective components for describing the modular fluid chip 1 according to the fifth embodiment of the present disclosure, the same reference numerals as those used in describing the modular fluid chips 1 according to the first embodiment and the fourth embodiment of the present disclosure will be used for convenience of description. The same or redundant descriptions will be omitted.

Referring to FIGS. 34 and 37, the modular fluid chip 1 according to the fifth embodiment of the present disclosure includes a connection member 17.

The connection member 17 is connected to another connection member 17 provided in the other modular fluid chip 2, so that at least one flow channel 112 provided in the modular fluid chip 1 may communicate with the flow channel 112 provided in the body 11 of the other modular fluid chip 2.

The connection member 17 is formed in a tube shape having a flow channel therein, and may be detachably installed on an outer surface of the body 11 to be described later. Here, a coupling groove 113 which communicates with the flow channel 112 provided in the body 11 and into which a portion of the connection member 17 is insertable may be formed in the outer surface of the body 11. Accordingly, when the connection member 17 is inserted into the coupling groove 113, the flow channel provided in the connection member 17 may be aligned with the flow channel 112 provided in the body 11 to communicate therewith. For example, the coupling groove 113 may be formed in a shape corresponding to an outer surface of the connection member 17.

In addition, the connection member 17 may be received in and supported by the housing 12 to be described later. Here, the housing 12 may have a receiving groove corresponding to the outer surface of the connection member 17 and supporting the outer surface of the connection member 17.

In addition, the connection member 17 may be configured to form interfaces at contact portions when contacting the body 11 and another connection member 17.

More specifically, the connection member 17 may be formed of an elastic material capable of elastic deformation and form an interface at contact portions when contacting the body 11 and the other connection member 17. Here, an adhesive layer may be provided on one surface and the other surface of the connection member 17.

However, the connection member 17 is not limited thereto, and may be changed into various shapes or various materials to thereby be applied within conditions capable of performing the same function. For example, when the body 11 is manufactured, the connection member 17 may be configured to be formed integrally with the outer surface of the body 11 through double injection molding and form an interface only on one side thereof. In addition, the connection member 17 may be formed of at least one of a polymer resin, an amorphous material, and a metal, and may include at least one of chlorinated polyethylene, ethylene propylene dimethyl, silicone rubber, acrylic resin, amide resin, epoxy resin, phenol resin, polyester-based resin, polyethylene-based resin, ethylene-propylene rubber, polyvinyl butyral resin, polyurethane resin, and nitrile-butadiene-based rubber.

Therefore, one side of the connection member 17 is in close contact with the body 11 to thereby form an interface, and the other side of the connection member 17 is in close contact with the connection member 17 provided in the other modular fluid chip 2 to thereby form an interface, leakage of fluid can be completely blocked.

In addition, the connection member 17 may directly connect the modular fluid chip 1 and the other modular fluid chip 2.

Figure 39:
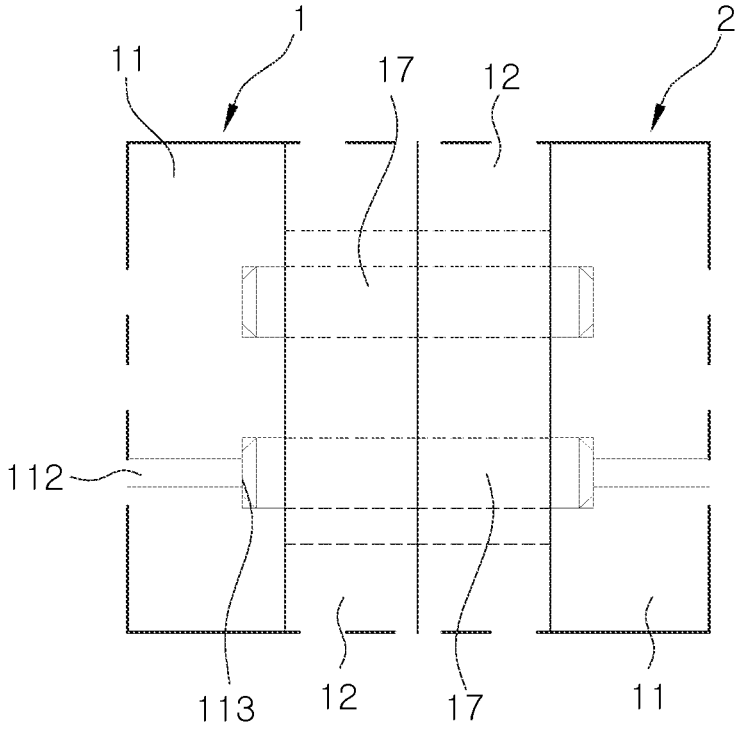
FIGS. 39 to 41 are views each schematically illustrating a modified embodiment of a connection member applied to the modular fluid chip according to another embodiment of the present disclosure.

Referring to FIG. 39, the connection member 17 coupled to the body 11 of the modular fluid chip 1 does not pass through the connection member 17 provided in the other modular fluid chip 2 and may be directly coupled to the body 11 of the other modular fluid chip 2.

Therefore, one side of the connection member 17 is in close contact with the body 11 of the modular fluid chip 1 to form an interface, and the other side of the connection member 17 is in close contact with the body 11 of the other modular fluid chip 2 to form an interface, thereby minimizing leakage points of fluid.

In addition, the connection member 17 may be configured such that a movement thereof in an axial direction is restricted when it is received in the housing 12.

Figure 40:
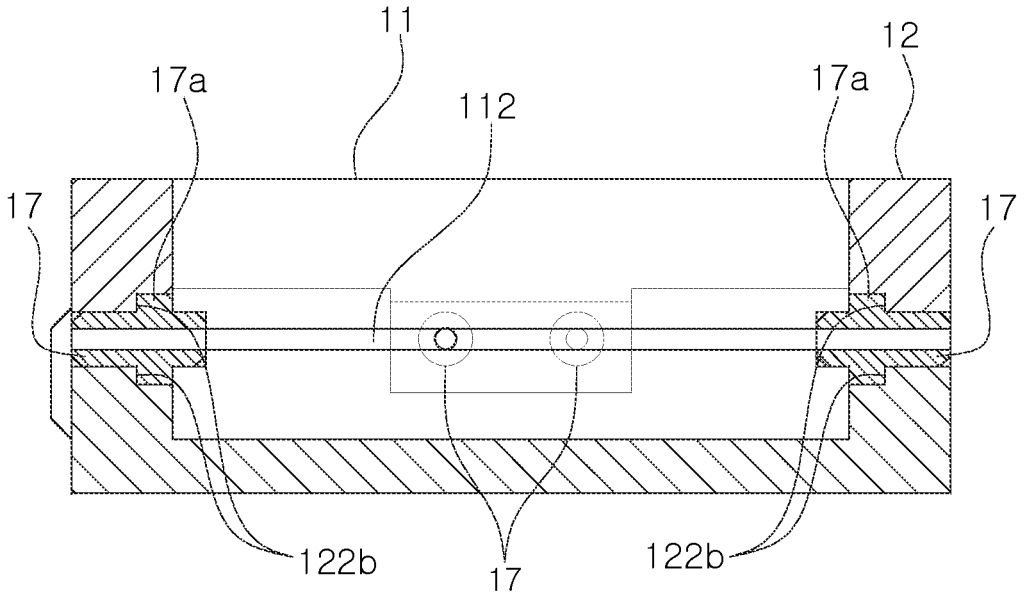

Referring to FIG. 40, the connection member 17 may include a flange portion 17*a* that protrudes radially from an outer surface thereof and is supported on an inner surface of the housing 12. Here, the housing 12 may be provided with a flange receiving groove 122*b* that receives and supports the flange portion 17*a* to thereby limit the movement of the connection member 17 in the axial direction. For example, the flange receiving groove 122*b* may be formed in a shape corresponding to the flange portion 17*a*.

Accordingly, even when the modular fluid chip 1 is separated from the other modular fluid chip 2, the flange portion 17*a* may be supported on the inner surface of the housing 12 to thereby fix the connection member 17 in a determined position.

In addition, the connection member 17 may be formed in a structure capable of minimizing deformation in the axial direction when coupled with the connection member 17 provided in the other modular fluid chip 2.

Figure 41:
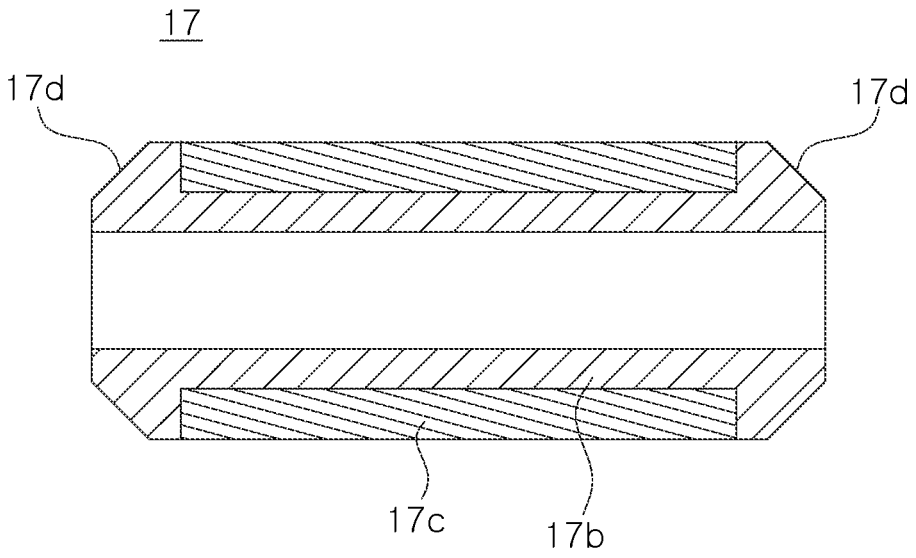

Referring to FIG. 41, the connection member 17 may include a plurality of bodies formed of different materials.

More specifically, the connection member 17 may include a first body 17*b* and a second body 17*c* having different materials.

The first body 17*b* may have a tube shape having a hollow inside thereof so as to communicate with the flow channel 112 provided in the body 11.

The second body 17*c* may be coupled to surround a circumference of the first body 17*b*. Here, the second body 17*c* may be formed of a material having a higher hardness than that of the first body 17*b*. For example, the first body 17*b* may be formed of an elastic material, and the second body 17*c* may be formed of a material having a higher hardness than that of the first body 17*b* such as an elastic material, metal or plastic. However, the second body 17*c* is not necessarily limited thereto, and may be formed of various materials. And, the first body 17*b* and the second body 17*c* may be individually manufactured and combined with each other, or may be integrally manufactured through double injection molding.

Therefore, even when the modular fluid chip 1 and the other modular fluid chip 2 are coupled to each other to thereby apply a load to the connection member 17 in the axial direction, deformation of the first body 17*b* may be minimized through the second body 17*c*. Through this, deformation of the flow channel provided in the connection member 17 may be minimized, so that fluid stably passes through the flow channel.

In addition, inclined surfaces 17*d* may be formed at both ends of the connection member 17.

Accordingly, when the connection member 17 is inserted into the coupling groove 113 of the body 11, it is feasible to prevent an edge of the end of the connection member 17 from contacting an inner surface of the body 11. Accordingly, insertion of the connection member 17 may be easily performed.

In addition, as a predetermined clearance space is formed in the coupling groove 113 through the inclined surface 17*d*, even when a load is applied to the connection member 17 from the other modular fluid chip 2, the connection member 17 is compressed in a state in which it is received in the coupling groove 113 so as to fill the clearance space, so that the modular fluid chip 1 and the other modular fluid chip 2 can be completely in close contact with each other.

In addition, the modular fluid chip 1 according to the fifth embodiment of the present disclosure may further include the body 11.

Referring to FIGS. 34 and 37, the body 11 is formed in the form of a replaceable module and may be received in the housing 12. In addition, at least one flow channel 112 capable of guiding a flow of fluid in various directions may be formed in the body 11. However, only the flow channel 112 is not necessarily formed in the body 11, and various functional units may be provided as necessary. For example, various functional units such as a quantitative chamber, a gene extraction chamber, a waste chamber, a mixing chamber, a buffer chamber, a valve and the like may be provided in the body 11.

In addition, the body 11 may be formed of at least one of an amorphous material such as glass, wood, a polymer resin, a metal, and an elastomer, or may be formed through a combination thereof.

In addition, the body 11 may be connected to the other modular fluid chip 2 through the above-described connection member 17.

Referring to FIGS. 34, 36 and 37, the coupling groove 113 which communicates with at least one flow channel 112 and into which a portion of the connection member 17 is inserted may be formed in the body 11. Accordingly, the connection member 17 may communicate with the at least one flow channel 112 provided in the body 11 through the coupling groove 113. In addition, when the above-described body 11 is connected to the other modular fluid chip 2 through the connection member 17, the flow channel 112 provided in the body 11 and the flow channel provided in the connection member 17 may be aligned and communicate with the flow channel 112 provided in the other modular fluid chip 2.

In addition, the modular fluid chip 1 according to the fifth embodiment of the present disclosure may further include the housing 12.

Referring to FIGS. 34 and 35, the housing 12 is formed in a frame structure having a receiving space formed therein, and may be configured to receive the body 11 and the connection member 17 therein.

In addition, the housing 12 may be composed of a plurality of parts that may be divided and assembled.

Referring to FIG. 37, the housing 12 may be composed of a lower part configured to support a lower surface of the body 11 and an upper part configured to be coupled to the lower part and support a circumferential surface of the body 11 exposed to the outside of the lower part.

In addition, the modular fluid chip 1 according to the fifth embodiment of the present disclosure may further include a sealing portion 19.

Figure 42:
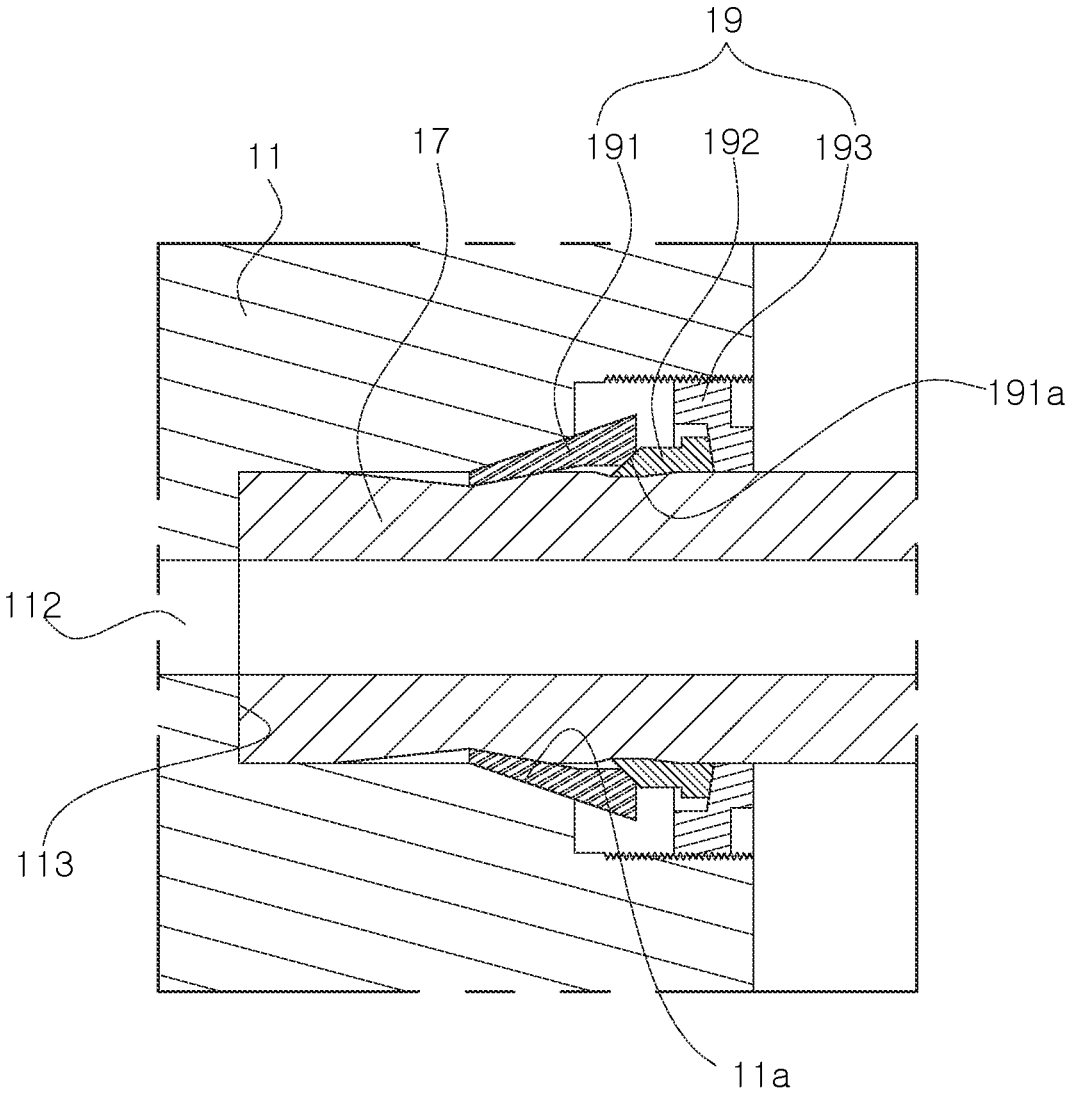
FIG. 42 is a schematic view illustrating a state in which a sealing portion is installed on an outer surface of the connection member applied to the modular fluid chip according to another embodiment of the present disclosure.

Referring to FIG. 42, the sealing portion 19 is press-fitted between the body 11 and the connection member 17 to allow for sealing between the body 11 and the connection member 17, and may fix the connection member 17 to the body 11.

The sealing portion 19 may include a front ferrule portion 191 formed in a ring shape, a rear ferrule portion 192, and a press portion 193.

The front ferrule portion 191 may be disposed between the inner surface of the body 11, which forms the coupling groove 113, and the outer surface of the connection member 17, which is inserted into the coupling groove 113. In addition, when subjected to external force in an axial direction, the front ferrule portion 191 moves toward the coupling groove 113 along the inclined surface Ila provided on the inner surface of the body 11 and may be press-fitted between the body 11 and the connection member 17.

The rear ferrule portion 192 may be disposed between an inner surface of the front ferrule portion 191 and the outer surface of the connection member 17. And, the rear ferrule portion 192 presses the front ferrule portion 191 when subjected to external force in the axial direction, and at the same time, moves toward the coupling groove 113 along an inclined surface 191*a* provided on the inner surface of the front ferrule portion 191 and may be press-fitted between the front ferrule portion 191 and the connection member 17.

The press portion 193 is fastened to the body 11 and disposed at the rear of the rear ferrule portion 192, and may press the rear ferrule portion 192 forward or release pressure, when rotating.

Hereinafter, the fluid flow system 1000 (hereinafter, referred to as 'fluid flow system 1000') including the modular fluid chips according to embodiments of the present disclosure will be described.

For reference, for respective components for describing the fluid flow system 1000, the same reference numerals as those used in describing the modular fluid chip 1 according to the first embodiment of the present disclosure will be used for convenience of description. The same or redundant descriptions will be omitted.

Referring to FIGS. 1 and 2, the fluid flow system 1000 is a fluid flow system 1000 for molecular diagnosis, capable of performing processes of sample collection, gene extraction from the collected sample, amplification using a polymerase chain reaction, and analysis, from fluid such as body fluid or blood. The fluid flow system 1000 includes a first modular fluid chip 1 capable of implementing a first function, and at least one second modular fluid chip 2 capable of implementing a second function different from the first function and being connected to the first modular fluid chip 1 in at least one direction of a horizontal direction and a vertical direction. Here, the second modular fluid chip 2 does not necessarily implement a function different from that of the first modular fluid chip 1, and may be applied to implement the same function as the first modular fluid chip 1 as needed.

Referring to FIGS. 2 and 3, each of the first modular fluid chip 1 and the second modular fluid chip 2 may include the body 11 which includes at least one first hole 111 allowing fluid to flow therethrough, and the housing 12 which receives the body 11 therein and which includes the second hole 121 and the coupling unit 122 aligned to correspond to the at least one first hole 111 and allowing fluid to flow therethrough. Here, the housing 12 provided in the first modular fluid chip 1 and the housing 12 provided in the second modular fluid chip 2 may be formed to have the same shape or size specification.

Referring to FIG. 15A, when the first modular fluid chip 1 and the second modular fluid chip 2 are connected, the holes 111 and 121 provided in the first modular fluid chip 1 and the holes 111 and 121 provided in the modular fluid chip 2 communicate with each other, and portions where the holes 111 and 121 provided in the first modular fluid chip 1 and the holes 111 and 121 provided in the modular fluid chip 2 communicate with each other may be formed in sizes and shapes in which they correspond to each other.

Here, the holes 111 and 121 provided in the first modular fluid chip 1 and the holes 111 and 121 provided in the second modular fluid chip 2 may have a shape in which a change in fluid pressure is minimized at the portions where the holes 111 and 121 provided in the first modular fluid chip 1 and the holes 111 and 121 provided in the modular fluid chip 2 communicate with each other, and a composition of fluid or a shape of micro-droplets is maintained. In addition, the holes 111 and 121 provided in the first modular fluid chip 1 and the holes 111 and 121 provided in the second modular fluid chip 2 may be aligned horizontally or vertically with respect to the fluid channels 112 formed in the body 11.

Referring to FIGS. 23 and 24, each of the first modular fluid chip 1 and the second modular fluid chip 2 may further include the fluid connector 17 including the third hole 171 aligned to correspond to the first hole 111 and the second hole 121.

As described above, according to the embodiments of the present disclosure, a fluid chip capable of performing one function is formed in the form of a module, whereby the fluid flow system 1000 of various structures can be implemented without restriction in shape or size by connecting a plurality of fluid chips capable of performing different functions as necessary. Through this, various and accurate experimental data can be obtained, and when a specific portion is deformed or damaged, only the fluid chip corresponding thereto can be replaced, thereby reducing manufacture and maintenance costs.

In addition, the housing 12 which is connectable to another modular fluid chip 2, and the body 11 which has the fluid channel 112 formed therein and is selectively replaced in the housing 12 are each formed in a module shape. Accordingly, it is feasible to easily change a position of a selected section and a shape of the fluid channel in one fluid flow system 1000, as needed. Through this, it is feasible to promptly change experimental conditions, thereby allowing for a variety of experiments during a preset period of time, as compared to the fluid flow system 1000 according to the prior art, and when a part is defective or damaged, only the housing 12 or the body 11 corresponding to the part can be promptly replaced.

In addition, when the modular fluid chip 1 and the other modular fluid chip 2 are connected, holes of the respective fluid chips are in an aligned state and communicate with each other, and at connection portions of the modular fluid chip 1 and other modular fluid chip 2, the fluid connectors 17 that are in close contact with each other and form an interface are provided. Thus, leakage of fluid at the connection portions during the flow of fluid is prevented, and a change in fluid pressure is minimized, and furthermore, a composition of the fluid or a shape of microdroplets can be maintained.

In the above, preferred embodiments of the present disclosure have been illustrated and described, but the present disclosure is not limited to the specific embodiments described above, and those skilled in the art will appreciate that various modifications are possible, without departing from the scope and spirit of the invention as disclosed in the accompanying claims. Such modifications should not be individually understood from the technical spirit or prospect of the present disclosure.

What is claimed is:

1. A modular fluid chip comprising: a body including at least one first hole and is configured to allow fluid to flow therethrough; and a housing receiving the body therein, and including a second hole which corresponds to the at least one first hole and allows the fluid to flow therethrough, and a fluid connection part which is connectable to another modular fluid chip.

2. The modular fluid chip of claim 1, wherein the body is formed in a form of a module capable of performing one function and is selectively replaceable in the housing.

3. The modular fluid chip of claim 2, wherein the other modular fluid chip includes a body capable of performing a function different from the one function.

4. The modular fluid chip of claim 1, wherein the housing is connectable to the other modular fluid chip in a horizontal or vertical direction, and when the housing and the other modular fluid chip are connected in a horizontal or vertical direction, the first hole and the second hole are aligned with and communicate with a first hole and a second hole provided in the other modular fluid chip.

5. The modular fluid chip of claim 1, wherein the body further includes a fluid channel which is in communication with the first hole and allows the fluid to flow therethrough.

6. The modular fluid chip of claim 1, further comprising: a coupling unit for coupling with the other modular fluid chip, wherein the coupling unit includes a material having magnetism.

7. The modular fluid chip of claim 6, wherein the coupling unit includes a convex portion and a concave portion corresponding to each other.

8. The modular fluid chip of claim 7, wherein the coupling unit includes a fastening portion connectable to the other modular fluid chip.

9. A modular fluid chip comprising: a housing; and at least one coupling portion provided in the housing of the modular fluid chip and configured to couple with another modular fluid chip.

10. The modular fluid chip of claim 9, wherein the coupling portion includes, at least one protrusion which protrudes from an outer surface of the housing; and at least one receiving groove which is provided in the outer surface of the housing.

11. The modular fluid chip of claim 10, wherein the protrusion and the receiving groove are alternately arranged along a circumference of the housing.

12. The modular fluid chip of claim 9, wherein the coupling portion further includes a plurality of magnetic members.

13. The modular fluid chip of claim 12, wherein the plurality of magnetic members are disposed inside the protrusion and the receiving groove.

14. The modular fluid chip of claim 12, wherein the plurality of magnetic members are installed on the outer surface of the housing along a circumference of the housing, but are disposed at positions different from those of the protrusion and the receiving groove.

15. The modular fluid chip of claim 12, wherein the coupling portion includes a blocking member which is configured to be disposed on one side of the magnetic member and block magnetism of the magnetic member.

* * * * *